US009217309B2

(12) United States Patent
Kalb et al.

(10) Patent No.: US 9,217,309 B2
(45) Date of Patent: Dec. 22, 2015

(54) HYBRID-TIEBACK SEAL ASSEMBLY USING METHOD AND SYSTEM FOR INTERVENTIONLESS HYDRAULIC SETTING OF EQUIPMENT WHEN PERFORMING SUBTERRANEAN OPERATIONS

(71) Applicants: Frank D. Kalb, Cypress, TX (US); Andrew J. Webber, Cypress, TX (US); John M. Yokley, Kingwood, TX (US); Curtis W. Payne, Richmond, TX (US)

(72) Inventors: Frank D. Kalb, Cypress, TX (US); Andrew J. Webber, Cypress, TX (US); John M. Yokley, Kingwood, TX (US); Curtis W. Payne, Richmond, TX (US)

(73) Assignee: Dril-Quip, Inc., Houston, TX (US)

( * ) Notice: Subject to any disclaimer, the term of this patent is extended or adjusted under 35 U.S.C. 154(b) by 350 days.

(21) Appl. No.: 13/706,166

(22) Filed: Dec. 5, 2012

(65) Prior Publication Data

US 2014/0151064 A1 Jun. 5, 2014

Related U.S. Application Data

(63) Continuation-in-part of application No. 13/691,014, filed on Nov. 30, 2012, now Pat. No. 9,080,404.

(51) Int. Cl.

| | |
|---|---|
| ***E21B 23/01*** | (2006.01) |
| ***E21B 33/13*** | (2006.01) |
| ***E21B 33/12*** | (2006.01) |

(52) U.S. Cl.

CPC ..... *E21B 33/13* (2013.01); *E21B 23/01* (2013.01); *E21B 33/1212* (2013.01)

(58) Field of Classification Search

CPC ..... E21B 23/00; E21B 23/01; E21B 23/04; E21B 23/06

See application file for complete search history.

(56) References Cited

U.S. PATENT DOCUMENTS

| | | | | |
|---|---|---|---|---|
| 4,537,258 | A * | 8/1985 | Beck | 166/374 |
| 5,944,111 | A * | 8/1999 | Bridges | 166/348 |
| 2007/0246227 | A1* | 10/2007 | Ezell et al. | 166/387 |
| 2011/0147015 | A1* | 6/2011 | Mickey et al. | 166/387 |

OTHER PUBLICATIONS

Office Action issued in related U.S. Appl. No. 13/692,014, filed Nov. 3, 2014.

* cited by examiner

*Primary Examiner* — Brad Harcourt
(74) *Attorney, Agent, or Firm* — Baker Botts L.L.P.

(57) ABSTRACT

Hybrid-tieback seal assemblies, interventionless setting assemblies, and associated methods of setting downhole components of the hybrid-tieback seal assemblies using such interventionless setting assemblies are disclosed. A hybrid-tieback seal assembly comprises one or more anchoring bodies, one or more packer seal assemblies, and one or more interventionless hydraulic setting systems. A method of setting downhole equipment comprises applying a pressure to a compensating volume and providing a working volume, wherein the working volume is separated from the compensating volume by one or more hydraulic control devices. A pressure is applied to the working volume in response to the pressure applied to the compensating volume. The pressure applied to the compensating volume is then reduced and the pressure applied to the working volume is captured by the hydraulic control devices. The captured pressure in the working volume is applied to set one or more of the anchoring bodies and packer seal assemblies.

27 Claims, 57 Drawing Sheets

FIG.5P
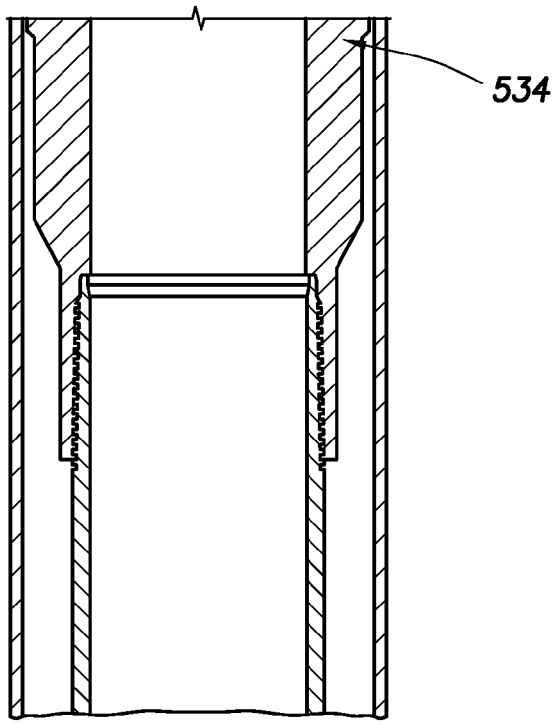
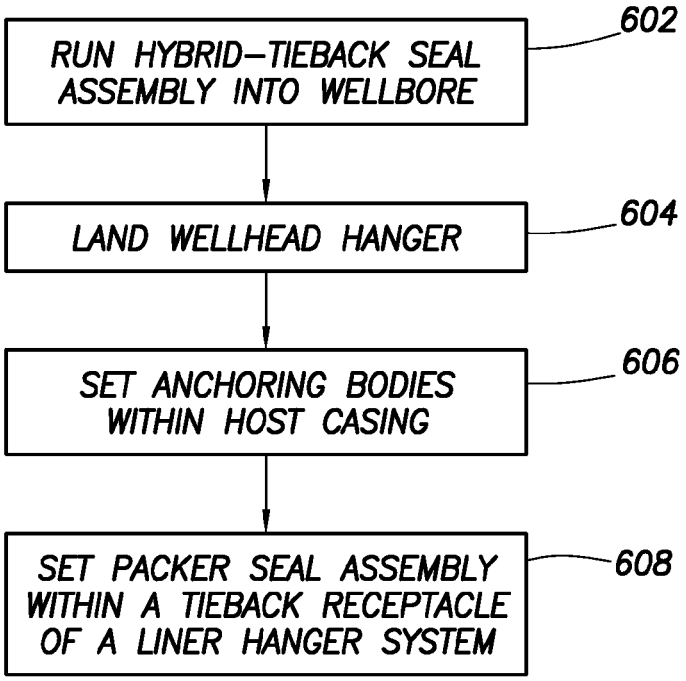
FIG.6

HYBRID-TIEBACK SEAL ASSEMBLY USING METHOD AND SYSTEM FOR INTERVENTIONLESS HYDRAULIC SETTING OF EQUIPMENT WHEN PERFORMING SUBTERRANEAN OPERATIONS

CROSS-REFERENCE TO RELATED APPLICATIONS

This application is a continuation-in-part of U.S. patent application Ser. No. 13/691,014, filed on Nov. 30, 2012, which is incorporated by reference herein in its entirety.

BACKGROUND

The present invention relates generally to tieback assemblies and, more particularly, to hybrid-tieback seal assemblies and associated methods of setting such assemblies.

Hydrocarbons, such as oil and gas, are commonly obtained from subterranean formations. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation. Controlling the operation of downhole equipment that may be used at each step is an important aspect of performing subterranean operations.

Downhole equipment includes any equipment used downhole to perform subterranean operations. For instance, downhole equipment may include, but is not limited to, equipment used to set wellheads, liner hangers, completion equipment, and/or intervention equipment.

In some instances, mechanical manipulation may be used to control operation of the downhole equipment. Specifically, a setting tool may be lowered into the wellbore on a work string to manipulate downhole equipment to set the device. Alternatively, the setting tool may be lowered downhole on the work string as part of a downhole tool and may be retained therein or retrieved. The term "set(ting)" a device as used herein refers to manipulating a device so that it goes from a first mode of operation to a second mode of operation. Traditional methods of mechanical manipulation of downhole equipment consume precious rig time rendering them undesirable.

In certain other instances, setting pistons (or hydraulic pistons) may be used to set downhole equipment. Specifically, setting pistons may be provided downhole independently (e.g., a setting tool) or as part of downhole equipment (e.g., internal pistons in a hydraulically set packer). However, typically the hydraulic pistons are source referenced in that pressure can be applied to and relieved from the same location in the system. Specifically, the system is typically pressure balanced at the time pressure is applied to the system. This pressure balance prohibits the ability to build a pressure differential and displace volumes, limiting the system's ability to set downhole equipment.

It is therefore desirable to develop methods and systems to more efficiently manipulate downhole equipment.

Current methods used to tie a well back to the surface or subsea wellhead from an existing downhole liner hanger entail running a tieback string into the well. These tieback strings typically have seals at their bottom end that stab into a tieback receptacle or polished bore receptacle of a previously installed downhole system. This typical approach may be problematic in applications where the existing tieback receptacle of the system has limited pressure rating. When performing typical tieback methods with similar systems, there is a risk of pressure induced failure (i.e., bursting or collapsing) in the tieback receptacle and/or the tieback string. As a result, a new and improved method of tying a well back to the surface or subsea wellhead is desirable.

Moreover, a tubing plug or similar device is typically used to hydraulically set various components downhole, including but not limited to hold down and hold up tubular bodies and/or packer seals. The setting typically occurs when the system is pressured up by applying hydraulic pressure by way of hydraulic ports in the system. Once the components are set, the plugging device may be removed by means of drilling, which requires an intervention run to remove any downhole impediments. Hydraulic ports are required for the application of hydraulic pressure to set various downhole components. These hydraulic ports do not allow for tubular metal integrity of the tieback string.

Typically, hydraulic pressure that is applied to the current system elastically deforms the tubulars that the components must set against. Once the pressure is removed, the tubulars relax and a proportion of the setting load may be lost in the components, which may compromise the quality of the component set. Moreover, once the plugging device is removed, the current system cannot be re-pressurized to apply an additional setting load until a second plugging device (e.g., production hanger) has been installed.

It is therefore desirable to develop an improved system of tying a well back to the surface or subsea wellhead that does not utilize a tubing plug or similar device.

BRIEF DESCRIPTION OF THE DRAWINGS

Some specific exemplary embodiments of the disclosure may be understood by referring, in part, to the following description and the accompanying drawings.

FIG. 6 is a flowchart depicting a method of tying a well back to the surface using the HTSA of FIG. 5, in accordance with an illustrative embodiment of the present disclosure.

Figure 1A:
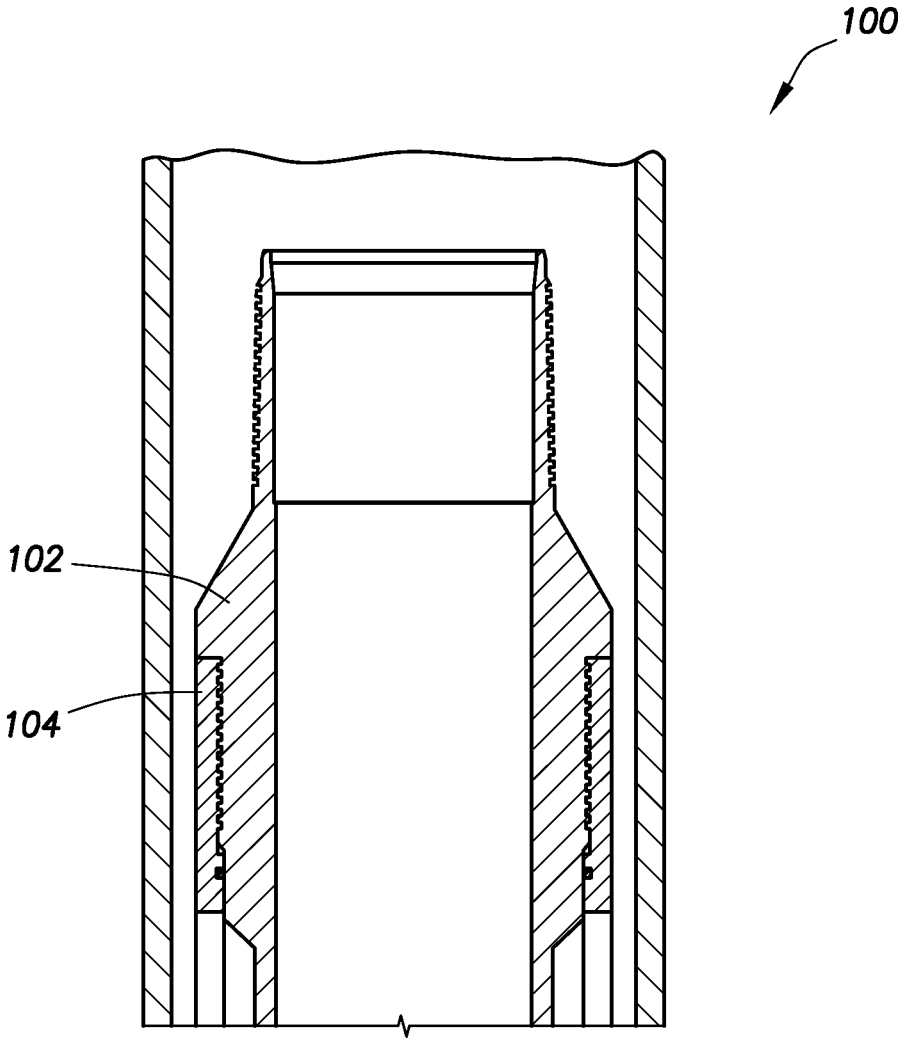
FIGS. 1A-1E depict a cross-sectional view of an Interventionless Hydraulic Setting System ("IHSS") in accordance with an illustrative embodiment of the present disclosure as it extends downhole.
Figure 1B:
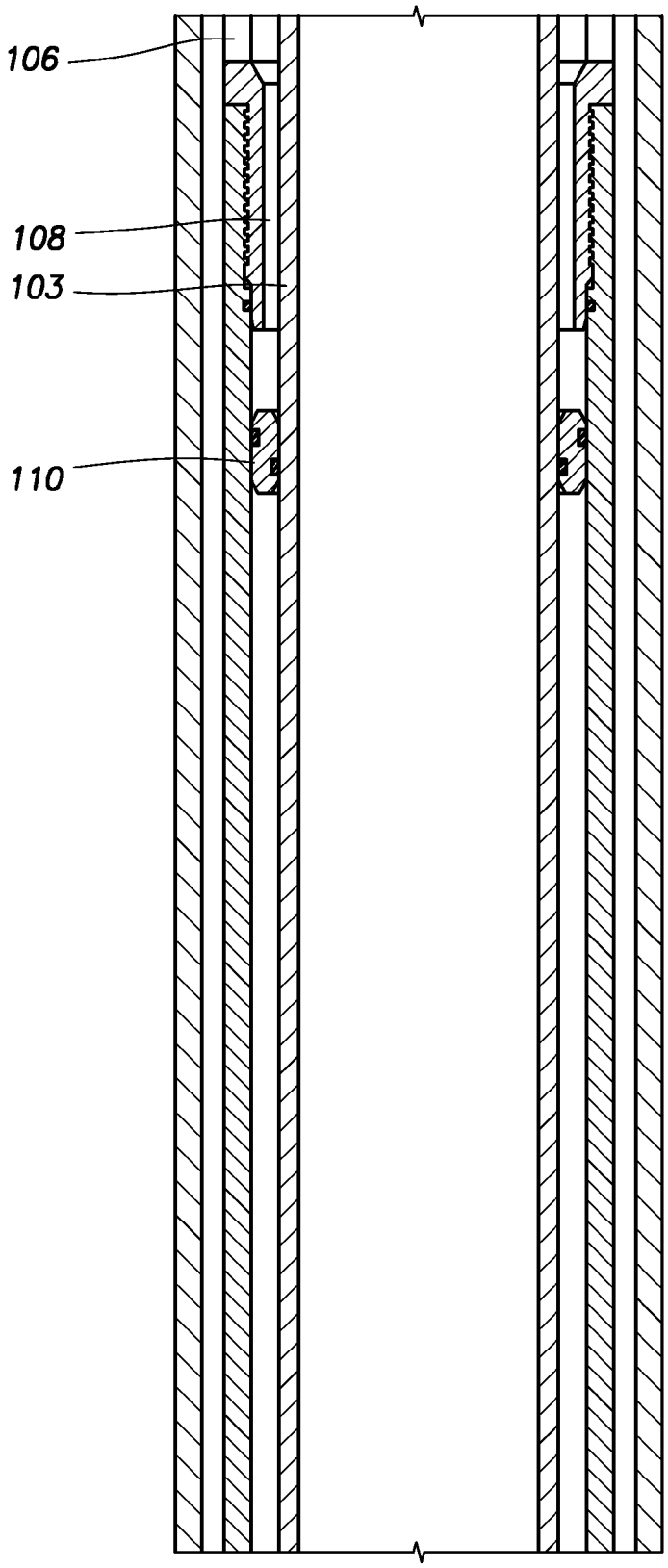
Figure 1C:
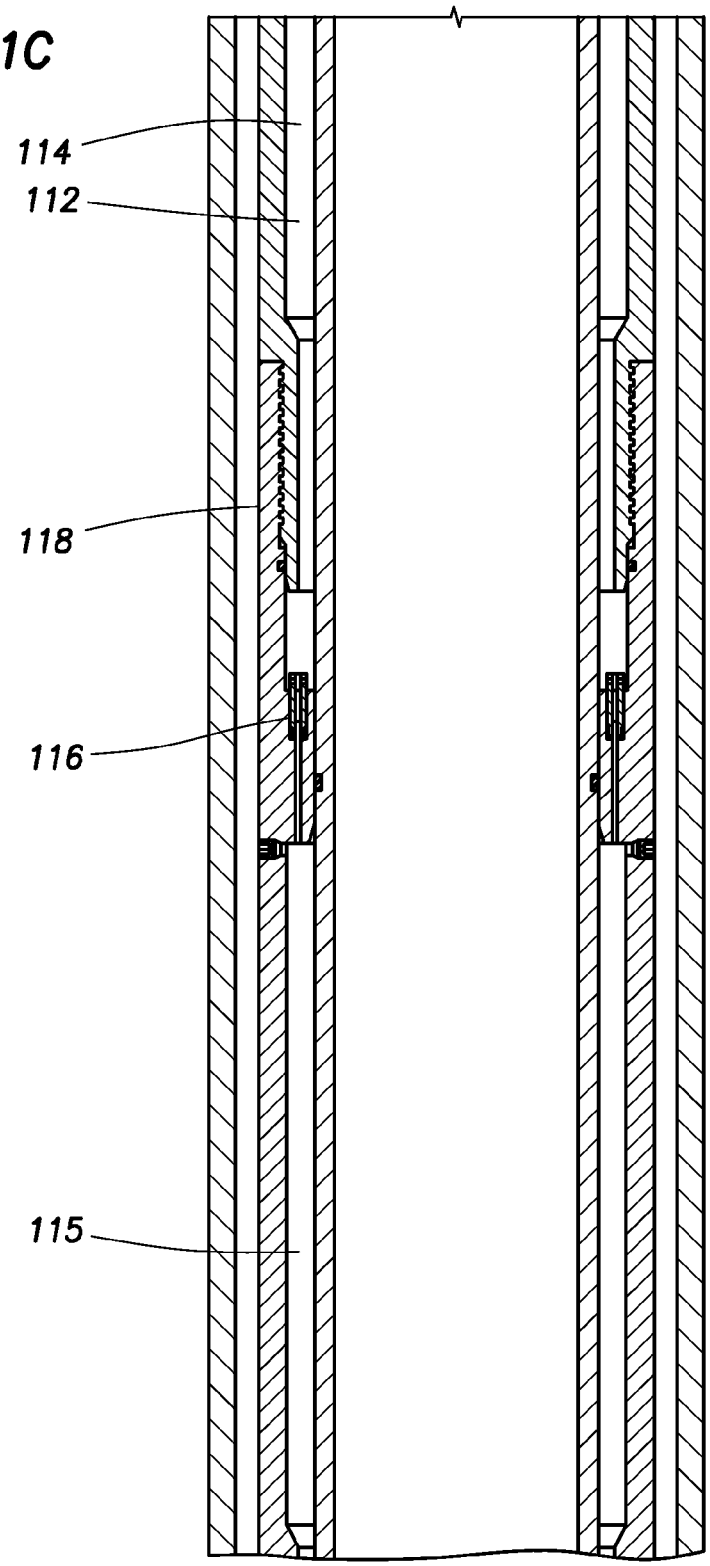
Figure 1D:
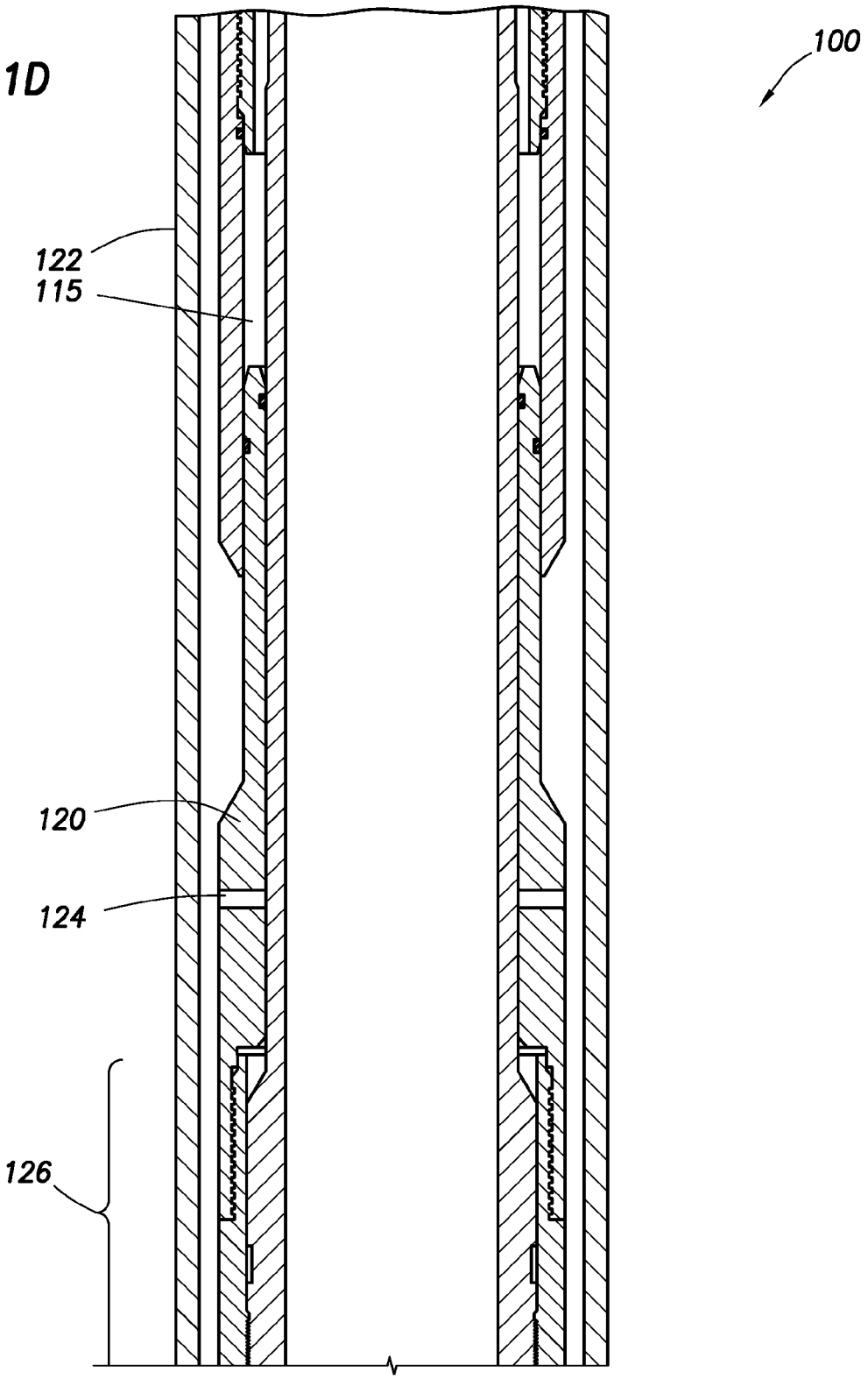
Figure 1E:
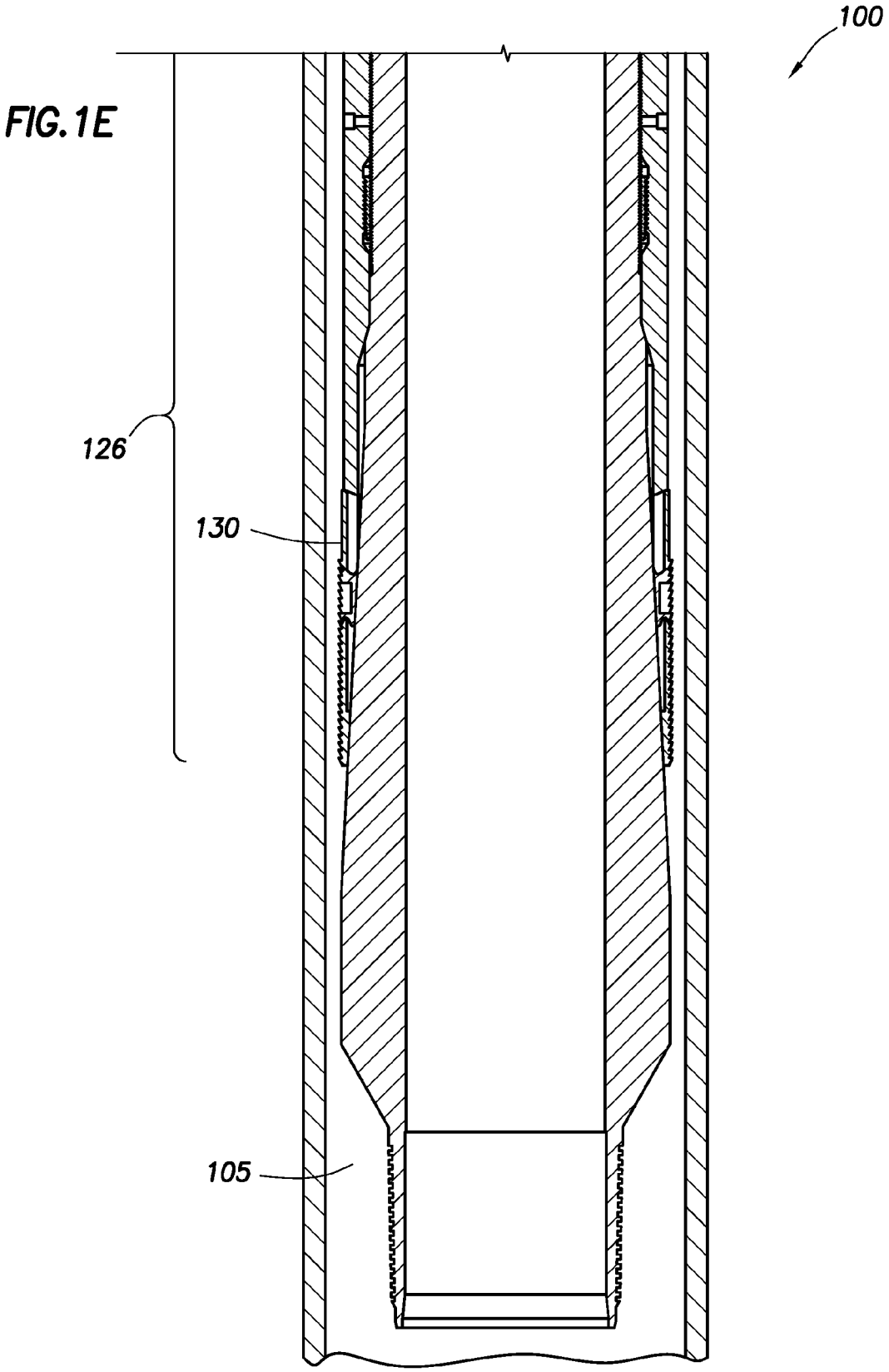

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present invention relates generally to the setting of downhole equipment and, more particularly, to interventionless setting assemblies and associated methods.

The terms "couple" or "couples" as used herein are intended to mean either an indirect or direct connection. Thus, if a first device couples to a second device, that connection may be through a direct connection, or through an indirect mechanical or electrical connection via other devices and connections. Similarly, the term "fluidically coupled" as used herein is intended to mean that there is either a direct or an indirect fluid flow path between two components. The term "uphole" as used herein means along the drillstring or the hole from the distal end towards the surface, and "downhole" as used herein means along the drillstring or the hole from the surface towards the distal end.

The present application discloses a method and system for delivering a pressure charge to a setting piston on a delayed basis. Specifically, a hydraulic volume may be pre-filled with a compressible fluid. The compressible fluid may be any fluid having a low Bulk Modulus, such as, for example, silicone oil. The term "Bulk Modulus" of a substance as used herein refers to the substance's resistance to uniform compression as indicated by the ratio of the infinitesimal pressure increase to the resulting relative decrease of the volume of the substance. As would be appreciated by those of ordinary skill in the art, having the benefit of the present disclosure, silicone oil is mentioned as an illustrative example only and a number of other fluids may be used without departing from the scope of the present disclosure. Specifically, any fluid may be used by adjusting the size of the setting device (discussed below) in proportion to the fluid's Bulk Modulus. Moreover, in certain implementations, the different chambers (e.g., compensating volume and working volume) may contain different compressible fluids without departing from the scope of the present disclosure.

The hydraulic volume may be pressure-filled by a pressure compensating volume and held in place by a hydraulic control device. In certain implementations, the pressure compensating volume may be pressurized from the application of rig pump pressure. Although the illustrative embodiments are discussed in conjunction with utilizing rig pump pressure, the present disclosure is not limited to this specific embodiment. For instance, another device may be used to apply pressure. Moreover, in certain implementations, a differential pressure may be applied by circulating fluids having differing weights which can create different corresponding hydrostatic pressures downhole.

Once the rig pump pressure is released, the compensating volume may substantially instantaneously respond to the lack of pump pressure, creating a differential pressure across a hydraulic control device. This trapped pressure may then be used to perform work on a piston body to set any number of downhole devices. The method and system disclosed will now be discussed in further detail in conjunction with the illustrative embodiments of FIGS. 1 and 3.

Illustrative embodiments of the present invention are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be used with any wellhead system. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

FIGS. 1A-1E depict an Interventionless Hydraulic Setting System ("IHSS") in accordance with an illustrative embodiment of the present disclosure denoted generally with reference numeral 100 as it extends downhole.

In this illustrative embodiment, the IHSS 100 includes a bottom sub 102 coupled to a hydraulic tubing 103. As would be appreciated by one of ordinary skill in the art, specific nomenclature used herein to refer to components of the embodiments is not limiting. For example, the term "bottom sub" is used without reference to the actual location or position of the component relative to other components. A communication port housing 104 is coupled to and extends along an external surface of the bottom sub 102 and the hydraulic tubing 103. The communication port housing 104 forms an annular space 108 around the bottom sub 102 and the hydraulic tubing 103 and includes a charge port 106 that provides a path for fluid flow into that annular space 108. A floating piston 110 is provided in the annular space 108 and separates the charge port 106 from a compensating volume 112. The compensating volume 112 may be filled with a compressible fluid 114. The compensating volume 112 may in turn be separated from a working volume 115 in the annular space extending along the outer circumference of the hydraulic tubing 103. One or more hydraulic control devices 116 may be provided in a first hydraulic housing 118 between the compensating volume 112 and the working volume 115. The hydraulic control devices 116 may operate to regulate fluid flow from the compensating volume 112 to the working volume 115 and vice versa. The term "hydraulic control device" as used herein refers to any device that may be used to regulate fluid flow from one volume or chamber to another. For instance, the term "hydraulic control device" may include, but is not limited to, check valves, restrictors or a combination thereof.

The working volume 115 extends downhole along the outer surface of the bottom sub 102 and the hydraulic tubing 103 between the bottom sub 102/hydraulic tubing 103 and the communication port housing 104 up to a distal end of the bottom sub 102. The distal end of the bottom sub 102 refers to the end of the bottom sub 102 which is located proximate to the downhole equipment to be manipulated. At the distal end, a hydraulic piston 120 is provided. The hydraulic piston 120 extends from a second hydraulic housing 122. One end of the hydraulic piston 120 interfaces with the working volume 115. Accordingly, the working volume 115 may apply pressure to the hydraulic piston 120 and the applied pressure may move the hydraulic piston between a first position and a second position. One or more vents 124 may also be provided to prevent pressure lock and allow fluid displacement in the system.

The hydraulic piston 120 may be used to set downhole equipment as it moves in response to changes in pressure in the working volume 115 between a first position and a second position. In the illustrative embodiment of FIG. 1, the downhole equipment is a hold down body 126. In the illustrative embodiment of FIG. 1, the hold down body 126 includes a pusher sleeve 128 having an anti-backlash system to prevent movement at one end and a hold down slip 130 at the opposite end. Although a hold down body 126 is depicted in the illustrative embodiment of FIG. 1, it would be appreciated that the methods and systems disclosed herein are not limited to manipulating hold down bodies and can be used in conjunction with other downhole equipment without departing from the scope of the present disclosure.

Figure 2:
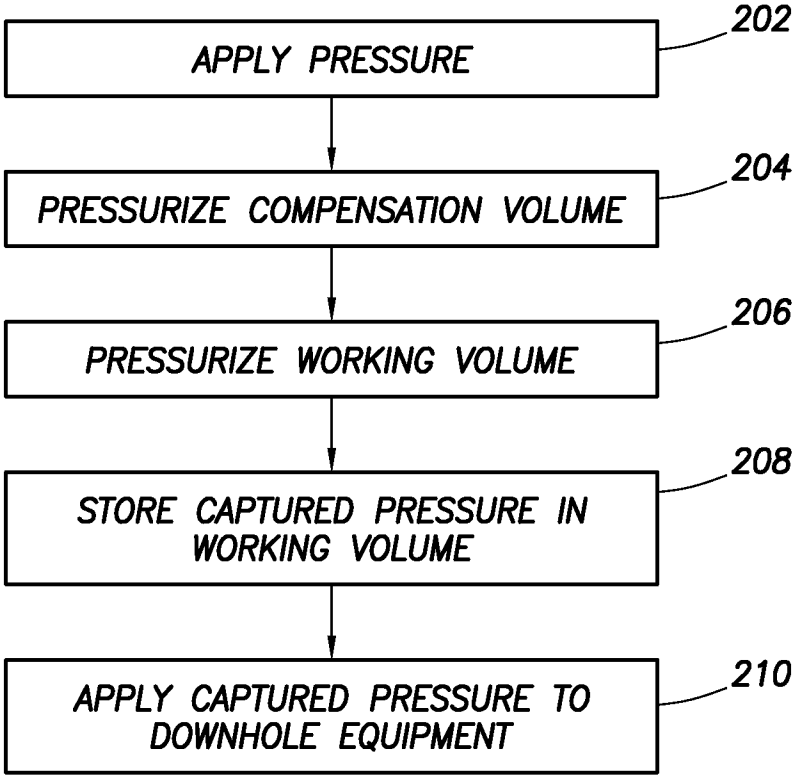
FIG. 2 depicts illustrative method steps associated with a setting cycle using the IHSS of FIG. 1.
Figure 3A:
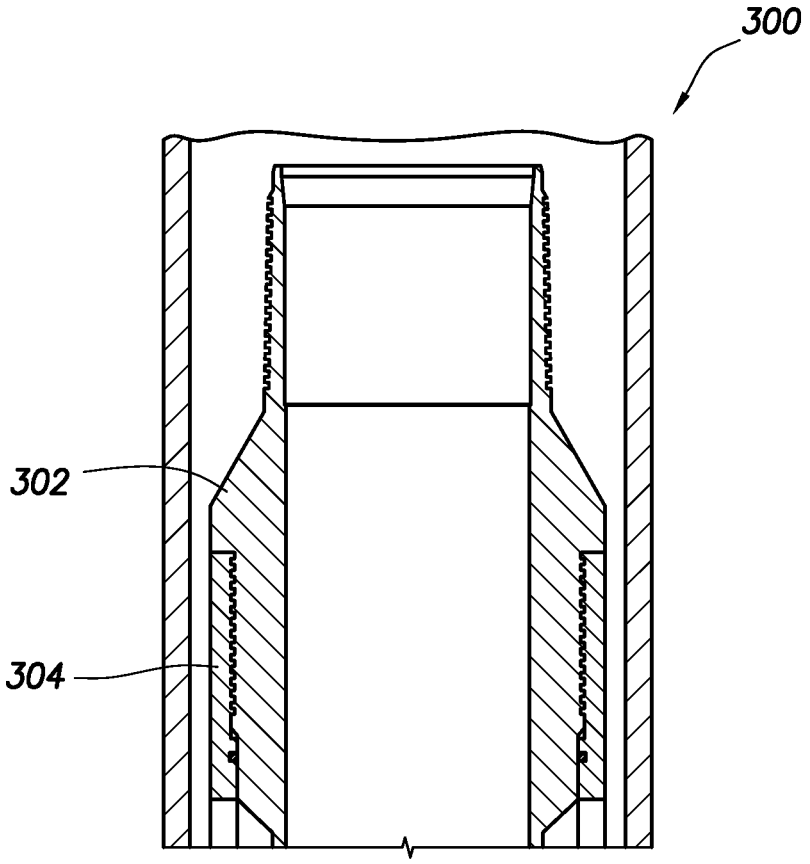
FIGS. 3A-3D depict a cross-sectional view of an IHSS in accordance with another illustrative embodiment of the present disclosure as it extends downhole.
Figure 3B:
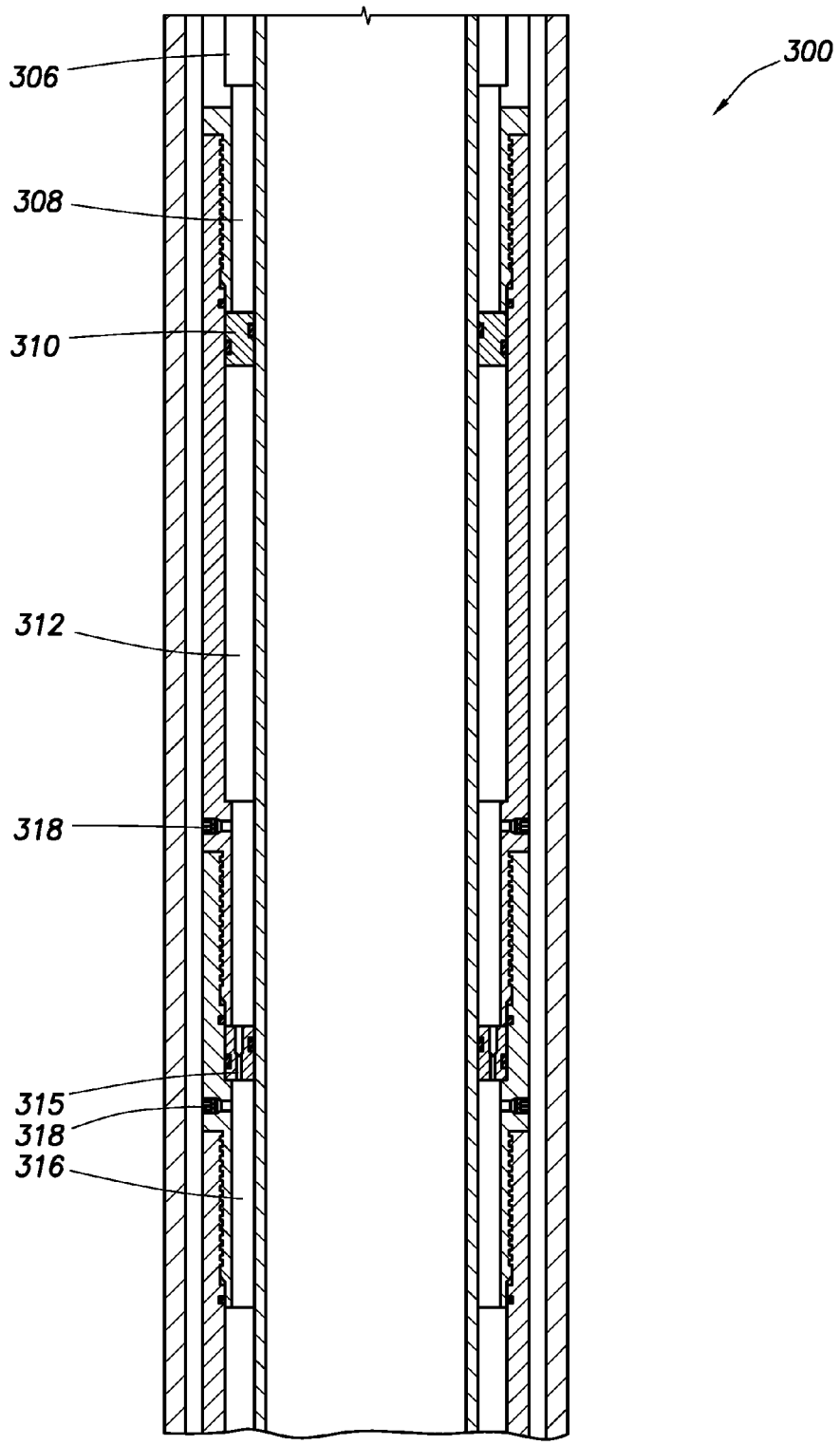
Figure 3C:
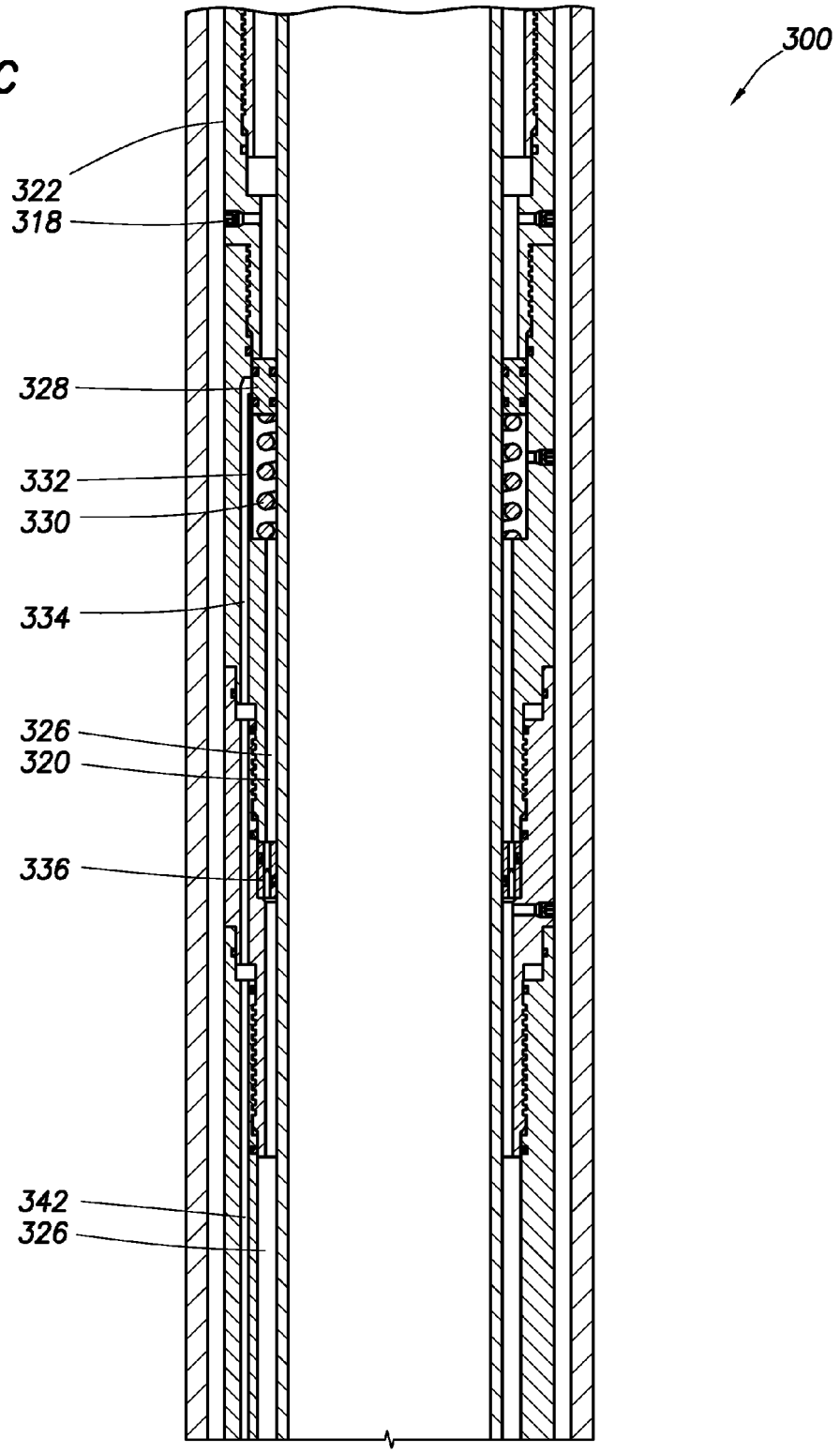
Figure 3D:
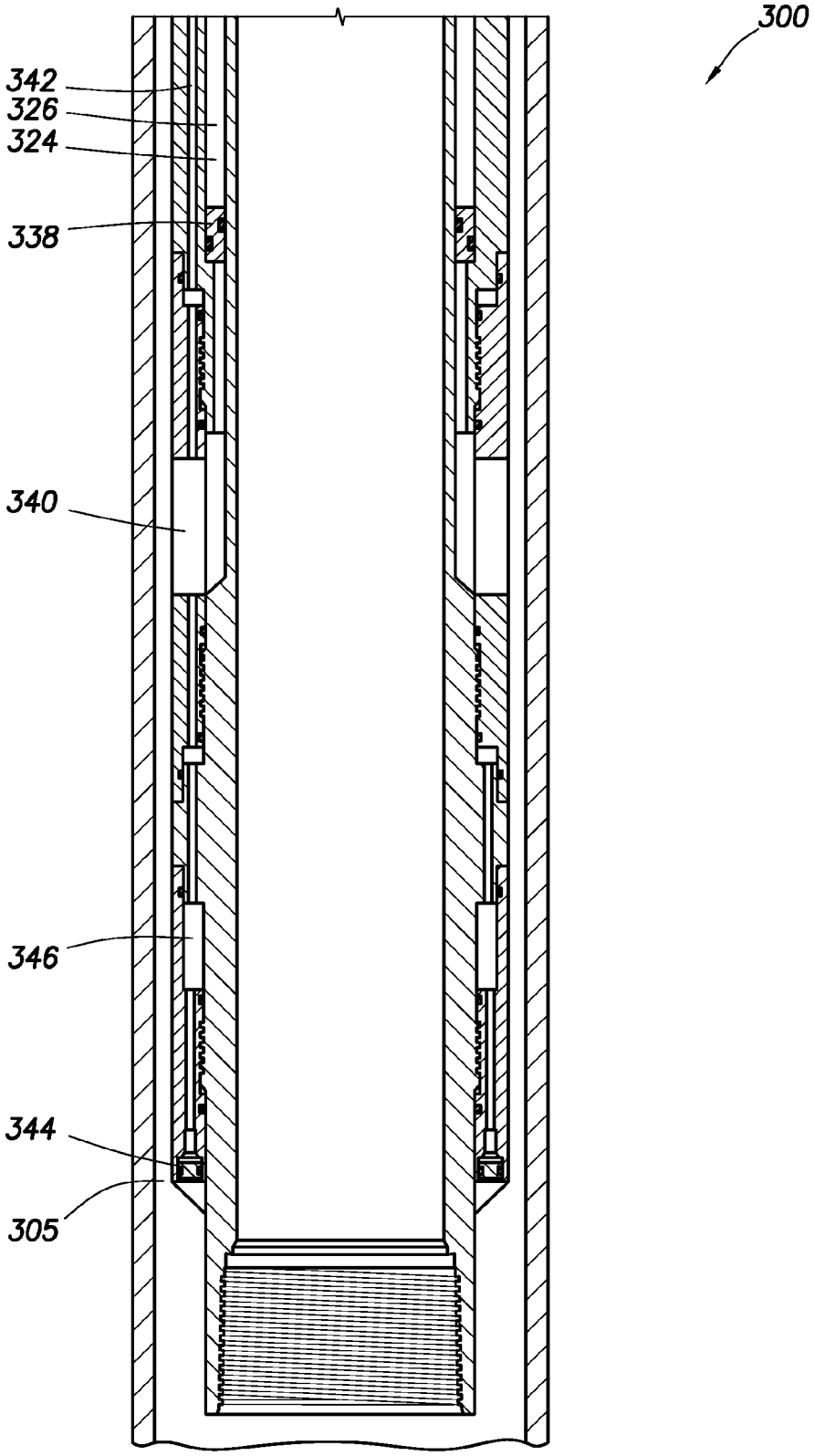

Operation of the IHSS 100 in accordance with an illustrative embodiment will now be discussed in conjunction with FIG. 2. FIG. 2 depicts illustrative method steps associated with a setting cycle using the IHSS 100. Although a number of steps are depicted in FIG. 2, as would be appreciated by those of ordinary skill in the art, having the benefit of the present disclosure, one or more of the recited steps may be eliminated or modified without departing from the scope of the present disclosure. Multiple setting cycles may be implemented as desired using the methods and systems disclosed herein.

First, at step 202, annular pressure may be applied to the system. A rig pump (not shown) or other suitable devices or methods known to those of ordinary skill in the art, having the benefit of the present disclosure, may be used to deliver a fluid through the annulus 105 between the hydraulic tubing 102 and a casing or the wellbore wall if the wellbore is not cased. Although the illustrative embodiments of FIGS. 1 and 3 are generally described in conjunction with applying annular pressure, the methods and systems disclosed herein may also be implemented by applying pressure through the hydraulic tubing 103 instead of applying an annular pressure.

The fluid delivered may be any suitable fluid, including, but not limited to, any completion fluid such as, for example, completion mud or slurry, cement, gas, or completion brine. As fluid is directed into the annulus 105 it generates hydraulic pressure in the system. Specifically, a portion of the fluid may be directed into the charge port 106 of the IHSS 100, applying pressure onto the floating piston 110. As pressure is applied to the floating piston 110, the floating piston 110 moves into its contracted position and pressurizes the compensating volume 112 of the IHSS 100 at step 204.

As the compensating volume 112 is pressurized, it will pressurize the working volume 115 at step 206. Specifically, the compressible fluid 114 flows from the compensating volume 112 into the working volume 115 through one or more hydraulic control devices 116 in response to the increased pressure applied to the floating piston 110. The flow of the compressible fluid 114 into the working volume 115 increases the pressure of the working volume 115. At this point, the pressure of the IHSS 100, the annulus 105 and the hydraulic tubing 103 are balanced.

Next, at step 208, the pressure previously applied to the working volume 115 is captured therein as the pressure in the rest of the system dissipates. Specifically, as the pressure from the rig pump is reduced, the floating piston 110 moves from its contracted position to a relaxed position. In the relaxed position, the compensating volume is substantially pressure balanced with the annular pressure, which may in turn be directly related to the rig pressure. As the pressure of the compensating volume 112 is reduced in response to the reduction in the annular pressure, a pressure differential develops between the compensating volume 112 and the working volume 115. In certain implementations the hydraulic control devices 116 may include one or more check valves. In this implementation, the pressure differential causes the check valves to move onto their corresponding seats and substantially instantaneously seals the working volume 115 from the compensating volume 112. Once the check valves have sealed the working volume 115 from the compensating volume 112, the captured pressure is stored in the working volume 115.

At step 210, the captured pressure in the working volume 115 may be applied to downhole equipment, such as, for example, a hold down body 126. As the rig pump pressure is bled, a pressure differential develops between the pressure in the annulus 105 (or the hydraulic tubing 103) and the working volume 115 pressure. As a result of this pressure differential across the hydraulic piston 120, a working load is developed onto the hold down body 126.

The rate at which pressure differential is developed at the hydraulic piston 120 depends on the rate of dissipation of rig pump pressure. For instance, if the rig pump pressure is dissipated in a manner analogous to a step function, a hammer load is applied to the hydraulic piston 120 to set the hold down body 126. In contrast, if the rig pump pressure is dissipated slowly over time, the load is delivered to the hydraulic piston 120 more smoothly. Such smooth delivery of the load may be appropriate, for example, for use in setting downhole equipment including, but not limited to, elastomeric and metal-to-metal packers.

In certain implementations, the hydraulic control devices 116 may include one or more hydraulic restrictors. The hydraulic restrictor may slowly bleed the pressure from the working volume 115 back to the compensating volume 112 over a certain time duration. The hydraulic restrictors may be adjusted as desired to achieve a predetermined time duration for the pressure transfer. The hydraulic restrictors may be used to ensure that the stored energy does not remain in the system long term. Alternatively, the hydraulic restrictors may be eliminated or the hydraulic control devices 116 may include a selective check valve (e.g., thermal relief valve) when it is desirable to retain the hydraulic pressure in the system. When a hydraulic restrictor is utilized, the IHSS 100 may be used several times to set downhole equipment so long as the compensating volume 112 has a sufficiently preplanned reservoir to allow for multiple actuations. After the initially captured pressure in the working volume 115 is applied to downhole equipment, the rig pump may once again apply annular pressure (or pressure through the tubing) and repeat the setting operation in the same manner.

As the hydraulic piston 120 coupled to the working volume 115 is displaced to manipulate downhole equipment, the pressure in the working volume 115 reduces. Once the initial displacement of the hydraulic piston 120 has been accommodated, additional cycling of the system may be used to deliver more pressure, and thus, more force, as the hydraulic piston 120 displacement has now been minimized. Accordingly, a first setting cycle of the IHSS 100 may displace the hydraulic piston 120 with some residual pressure in the working volume 115. As previously stated, a subsequent, second setting cycle may deliver a maximum amount of pressure and force with minimal displacement, ensuring a complete setting of downhole equipment.

FIGS. 3A-3D depict an IHSS 300 in accordance with another illustrative embodiment of the present disclosure. As discussed in more detail below, in this embodiment, the IHSS 300 may provide a delayed delivery of pressure by bleeding the working volume pressure to move a shifting sleeve that selectively opens and closes a port that leads to the stored pressure.

In this illustrative embodiment, the IHSS 300 includes a bottom sub 302 coupled to a hydraulic tubing 303. A communication port housing 304 is coupled to and extends along an external surface of the bottom sub 302 and the hydraulic tubing 303. The communication port housing 304 forms an annular space 308 around the bottom sub 302 and the hydraulic tubing 303 and includes a first charge port 306 that provides a path for fluid flow into that annular space 308. A first floating piston 310 is provided in the annular space 308 and separates the first charge port 306 from a first compensating volume 312.

The first compensating volume 312 may be filled with a compressible fluid 314. The first compensating volume 312 may in turn be separated from a first working volume 316 in the annular space extending along the outer circumference of the bottom assembly 302 and the hydraulic tubing 303. One or more hydraulic control devices 315 may be provided between the first compensating volume 312 and the first working volume 316. The hydraulic devices 315 may operate to regulate fluid flow from the first compensating volume 312 to the first working volume 316 and vice versa. The term "hydraulic control device" as used herein refers to any device that may be used to regulate fluid flow from one volume or chamber to another. For instance, the term "hydraulic control device" includes, but is not limited to, check valves, restrictors or a combination thereof. One or more plugged fill ports 318 may be provided to facilitate filling the first compensating volume 312 and the first working volume 316 with a compressible fluid 314. The first working volume 316 extends downhole along the outer surface of the bottom sub 302/hydraulic tubing 303 between the bottom sub 302/hydraulic tubing 303 and the hydraulic housing 322 and interfaces with a second working volume 320 across a shifting sleeve 328. The second working volume 320 in turn interfaces with a second compensating volume 324.

Like the first compensating volume 312 and the first working volume 316, the second compensating volume 324 and the second working volume 320 may be filled with a compressible fluid 326. The compressible fluid in the first compensating volume 312, the first working volume 316, the second compensating volume 324 and the second working volume 320 may be the same fluid or different chambers may contain different fluids. The second working volume 320 is designed to be smaller in size than the first working volume 316.

A shifting sleeve 328 is provided at an interface of the first working volume 316 and the second working volume 320. In certain embodiments, the shifting sleeve 328 may be coupled to a spring 330 which loads the shifting sleeve 328. The shifting sleeve 328 may be moved between a first position in which the shifting sleeve 328 covers and closes a pressure delivery port 334 and a second position in which the shifting sleeve 328 opens the pressure delivery port 334.

One or more hydraulic restrictors 336 may provide an interface between the second working volume 320 and a first side of a second compensating volume 324. The hydraulic restrictors 336 can be used to regulate fluid flow between the second working volume 320 and the second compensating volume 324. A second floating piston 338 is provided at a second side of the second compensating volume 324 such that movement of the second floating piston 338 between a relaxed position and a contracted position can be used to apply pressure to the second compensating volume 324. A second charge port 340 may be provided proximate the second end of the second compensating volume 324 to facilitate delivery of pressure to the second floating piston 338.

The fluid exiting the pressure delivery port 334 passes through a cavity 342 and may be directed through a setting port 344 out of the IHSS 300 and be used to set downhole equipment in a manner similar to that discussed in conjunction with FIG. 1. For instance, the pressure directed through the setting port 344 may be used to drive a hydraulic piston (not shown in FIG. 3) in the same manner discussed in conjunction with FIG. 1 and the hydraulic piston may set downhole equipment. In certain implementations, a fluid reservoir 346 may be provided between the pressure delivery port 334 and the setting port 344 and be used to collect fluids and push fluids through the setting port 344.

Accordingly, the IHSS 300 includes a first working volume 316 and a second working volume 320 positioned on opposing ends thereof and separated by a shifting sleeve 328 that covers a pressure delivery port 334. The first working volume 316 may be filled and pressurized by a first compensating volume 312. Fluid flow between the first compensating volume 312 and the first working volume 316 may be regulated by hydraulic control devices 315. The first compensating volume 312 may operate in the same manner as the compensating volume 112 discussed in conjunction with FIG. 1 above. Specifically, the first compensating volume 312 may be selectively pressurized by moving the first floating piston 310 from a first position to a contracted position in response to annular pressure (or pressure through the tubing) applied by a rig pump or other suitable means (e.g., circulation of fluids having differing weights).

Similarly, the second working volume 320 may be filled and pressurized by a second compensating volume 324. Fluid flow between the second compensating volume 324 and the second working volume 320 may be regulated by hydraulic control devices 336. The second compensating volume 324 may operate in the same manner as the compensating volume 112 discussed in conjunction with FIG. 1 above. Specifically, the second compensating volume 324 may be selectively pressurized by moving the second floating piston 338 from a first position to a contracted position in response to annular pressure (or pressure through the tubing) applied by a rig pump or other suitable means (e.g., fluid having differing weights). The hydraulic control devices 336 associated with the second compensating volume 324 may be adjusted so that the second compensating volume 324 has a different bleed rate than the first compensating volume 312.

The first working volume 316 and the second working volume 320 may be different in size. In the illustrative embodiment of FIG. 3, the first working volume 316 is larger in size than the second working volume 320.

In operation, as pressure is applied (annular pressure or through the tubing or other suitable means), the first compensating volume 312 and the second compensating volume 324 are pressurized by their respective floating pistons 310, 338. Compressible fluid flows from the first compensating volume 312 and the second compensating volume 324 to the first working volume 316 and the second working volume 320, respectively, through the corresponding hydraulic control devices 315, 336 (e.g., check valves and/or hydraulic restrictors). As a result, the first working volume 316 and the second working volume 320 are pressurized.

In the same manner discussed with respect to FIG. 1 above, as the wellbore pressure is reduced, floating pistons 310, 338 associated with the first compensating volume 312 and the second compensating volume 324 move from their contracted position to a relaxed position. Accordingly, the pressure of the first compensating volume 312 and the second compensating volume 324 will be reduced. Consequently, the hydraulic control devices 315 controlling fluid flow between the first compensating volume 312 and the first working volume 316 as well as the hydraulic control devices 336 controlling fluid flow between the second compensating volume 324 and the second working volume 320 seat and seal in the respective pressures of the first working volume 316 and the second working volume 320.

In certain implementations, the hydraulic restrictors 315, 336 may include one or more restrictors. The restrictors associated with the second working volume 320 and the restrictors associated with the first working volume 316 bleed pressure. In certain embodiments in accordance with the present disclosure, the second working volume 320 is smaller than the first working volume 316. Due to the difference in size of the first working volume 316 and the second working volume 320, the pressure bleed has a larger impact on the second working volume 320 than the first working volume 316. In certain other embodiments, the first working volume 316 and the second working volume 320 may be equal, but the pressure bleed rate of the hydraulic restrictors 315, 336 associated with the second working volume 320 is faster than the bleed rate associated with the first working volume 316. In this case, the pressure bleed also has a larger impact on the second working volume 320 than the first working volume 316. The differences in size of working volumes or bleed rate of the hydraulic control devices 315 create a pressure differential across the shifting sleeve 328. Once the pressure differential across the shifting sleeve 328 is large enough, the shifting sleeve 328 shifts towards the second working volume 320 and opens the pressure delivery port 334 from the first working volume 316 to the downhole equipment to be manipulated. This stored pressure may then be ported by any suitable means known to those of ordinary skill in the art, having the benefit of the present disclosure, to a hydraulic piston that can be used to manipulate downhole equipment.

Figure 4:
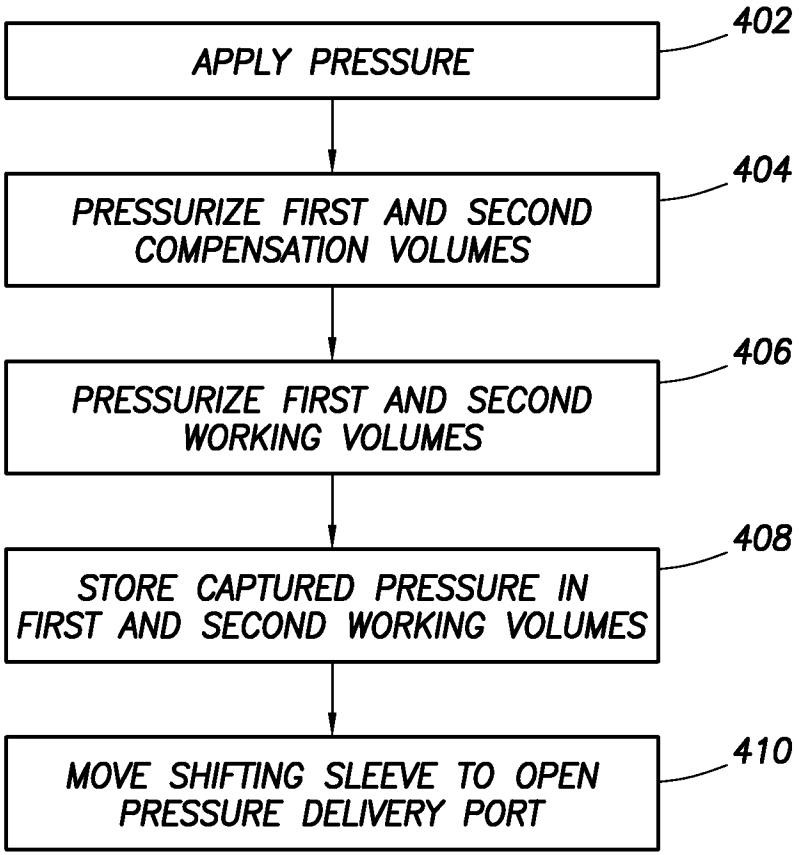
FIG. 4 depicts illustrative method steps associated with a setting cycle using the IHSS of FIG. 3.

FIG. 4 depicts illustrative method steps that may be used to manipulate downhole equipment using the IHSS 300. Although a number of steps are depicted in FIG. 4, as would be appreciated by those of ordinary skill in the art, having the benefit of the present disclosure, one or more of the recited steps may be eliminated or modified without departing from the scope of the present disclosure.

First at step 402, pressure is applied to a closed volume in a wellbore. The pressure may be applied through the hydraulic tubing 303 or through the annulus 305 between the hydraulic tubing 303 and a casing or the wellbore if the wellbore is not cased. The applied pressure acts on the floating pistons 310, 338 of the first compensating volume 312 and the second compensating volume 324 increasing the pressure in the compensating volumes.

Next, at step 406, the working volumes 316, 320 are pressurized. Specifically, the first compensating volume 312 and the second compensating volume 324 are fluidically coupled to the first working volume 316 and the second working volume 320 through hydraulic control devices 315, 336, respectively. As a result, with the increase in the pressure of the first compensating volume 312 and the second compensating volume 324 compressible fluid may flow through the hydraulic control devices 315, 336, to the first working volume 316 and the second working volume 320, respectively. At this point, the system (including the tubing/annular pressure, the compensating volumes 312, 324, and the working volumes 316, 320) is pressure balanced.

At step 408, captured pressure is stored in the first working volume 316 and the second working volume 320. Specifically, as the rig pump pressure is reduced, the floating pistons 310, 338 respond to the pressure difference acting across them and return from their contracted positions to their relaxed positions. As a result, the first compensating volume 312 and the second compensating volume 324 return to a relaxed state. This results in the induction of a pressure difference between the working volumes 316, 320 and their corresponding compensating volumes 312, 324, respectively. Specifically, the induced differential pressure across the compensating volumes 312, 324 and their corresponding working volumes 316, 320, respectively, causes the hydraulic control devices 315, 336 to go on seat and substantially instantaneously seal the first working volume 316 and the second working volume 320 from the first compensating volume 312 and the second compensating volume 324, respectively. As a result, the working volumes 316, 320 remain pressurized and store the captured pressure. By this point, no pressure has been applied to hydraulic piston or any downhole equipment. Accordingly, the IHSS 300 provides a true pressure delay feature where the application of pressure to downhole equipment is not necessarily simultaneous with changes of annular pressure (or pressure through the tubing).

As shown in FIG. 3, the second working volume 320 may be smaller than the first working volume 316. In other embodiments, the second working volume 320 and the first working volume 316 may be equal, but the pressure bleed rate of the hydraulic restrictors 315, 336 associated with the second working volume 320 may be faster than the bleed rate associated with the first working volume 316. The difference in rate at which the first working volume 316 and the second working volume 320 bleed pressure may be used to control the time delay of the pressure delivered to the downhole equipment. Specifically, this difference in rates controls the time it takes to create a pressure differential that is large enough to move the shifting sleeve 328 and port the pressure of the first working volume 316. Accordingly, once the pressure differential between the two ends of the shifting sleeve 328 is large enough, the shifting sleeve 328 moves and exposes the pressure delivery port 334 which facilitates application of pressure to desired downhole equipment from the first working volume 316.

The IHSS 100 and the IHSS 300 provide different implementations of the methods and systems disclosed herein. Specifically, the IHSS 100 delivers its pressure as the applied pressure (annular pressure or tubing pressure) begins to fall and a differential pressure is created between the applied pressure and IHSS 100. In contrast, the application of pressure by the IHSS 300 to the downhole equipment is not dependent upon the applied pressure (annular pressure or tubing pressure) in real-time. Specifically, the IHSS 300 may apply pressure to downhole equipment as long as the wellbore pressure is at a pressure that is below the stored pressure of the IHSS 300. Stated otherwise, in certain implementations the hydraulic control devices 315, 336 may include one or more hydraulic restrictors. As long as there is sufficient pressure differential to allow the hydraulic restrictors to bleed and create a pressure differential across the shifting sleeve 328, the IHSS 300 may deliver pressure to downhole equipment.

Accordingly, any downhole equipment will develop a working load as the rig pump pressure is bled and the working load may be applied to downhole equipment. For instance, the differential pressure may drive a hydraulic piston that sets downhole equipment. The pressure differential that is applied to the hydraulic piston may be contingent upon the wellbore pressure, the bleed rate of wellbore pressure, and the bleed rate of the working volumes 316, 320. For instance, if the dissipation of rig pump pressure resembles a step function, a hammer load is applied to the hydraulic piston to manipulate downhole equipment once the IHSS 300 is fired open. In contrast, if the rig pump pressure is dissipated slowly, the load is delivered more smoothly and may be appropriate for use in setting downhole equipment including, but not limited to, elastomeric and metal-to-metal packers in the same manner discussed in conjunction with the embodiment of FIG. 1.

Accordingly, the IHSS 300 may be used several times to set or apply force to a device, provided that the first compensating volume 312 and the second compensating volume 324 have a sufficient pre-planned reservoir to allow for multiple actuations. Moreover, the IHSS 300 may reset itself Specifically, the shifting sleeve 328 may be pushed back into a sealing position over the delivery port by virtue of the spring 330. Properties of the spring 330 may be selected such that the spring 330 can move the shifting sleeve 328 to close the pressure delivery port 334 if the pressure differential between the first working volume 316 and the second working volume 320 falls below a threshold value. Once the pressures of the first working volume 316 and the second working volume 320 are equalized or if the differential pressure is not large enough to move the shifting sleeve 328, the cycle may be repeated to provide setting pressure to further energize downhole equipment. Multiple cycling of the setting spring is further enabled by the fact that there are the hydraulic control devices 315, 336, which may include restrictors that slowly bleed the pressure of the first working volume 316 to the first compensating volume 312 over a duration of time. The restrictors ensure that the energy stored in the working volumes 316, 320 does not remain in the system long term. Consequently, the rig pump may pressure up the hydraulic tubing 303 or the annulus 305 of the well and repeat the setting operation.

As pressure is delivered through the setting port 344, the retained pressure in the first working volume 316 reduces. Once the displacement has been accommodated, additional cycling of the system delivers more pressure and thus, more force, to the hydraulic piston as the displacement of the hydraulic piston in the downhole equipment has been minimized. As a result, a first setting cycle of the IHSS 300 may displace the hydraulic piston with some residual pressure/force in the first working volume 316. A subsequent, second setting cycle may deliver a maximum amount of pressure and force with minimal displacement, ensuring a complete setting of downhole equipment.

The IHSS 100 and the IHSS 300 may be used to set any number of downhole components. In certain embodiments, the present disclosure is directed to a method and system to tie a well back to the surface using a Hybrid-Tieback Seal Assembly (HTSA), where the HTSA is set and sealed into a previously installed downhole system. The HTSA system in accordance with the present disclosure may incorporate the slips and sealing technologies found for example in U.S. Pat. Nos. 6,761,221 and 6,666,276, the entireties of which are hereby incorporated by reference. The HTSA system in accordance with the present disclosure may use IHSS 100 and the IHSS 300 to deliver a pressure charge to a setting system on an immediate or delayed basis to set downhole equipment in the system.

In certain embodiments, the IHSS 100 and IHSS 300 allow the downhole components to be set in a pressure balanced condition. Setting in this neutral condition eliminates the pressure induced elastic deformation of the downhole components. This reduces and/or eliminates the associated loss of downhole component setting loads encountered in current hydraulically set systems.

Figure 5A:
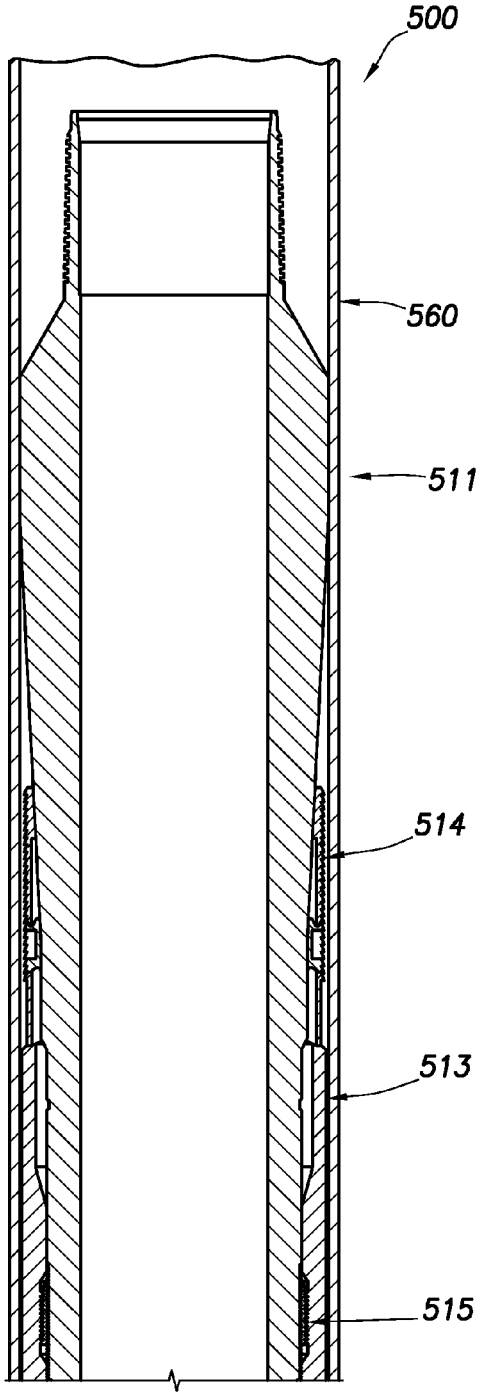
FIGS. 5A-5P depicts a liner hanger system and a Hybrid-Tieback Seal Assembly (HTSA) in accordance with a first illustrative embodiment of the present disclosure.
Figure 5B:
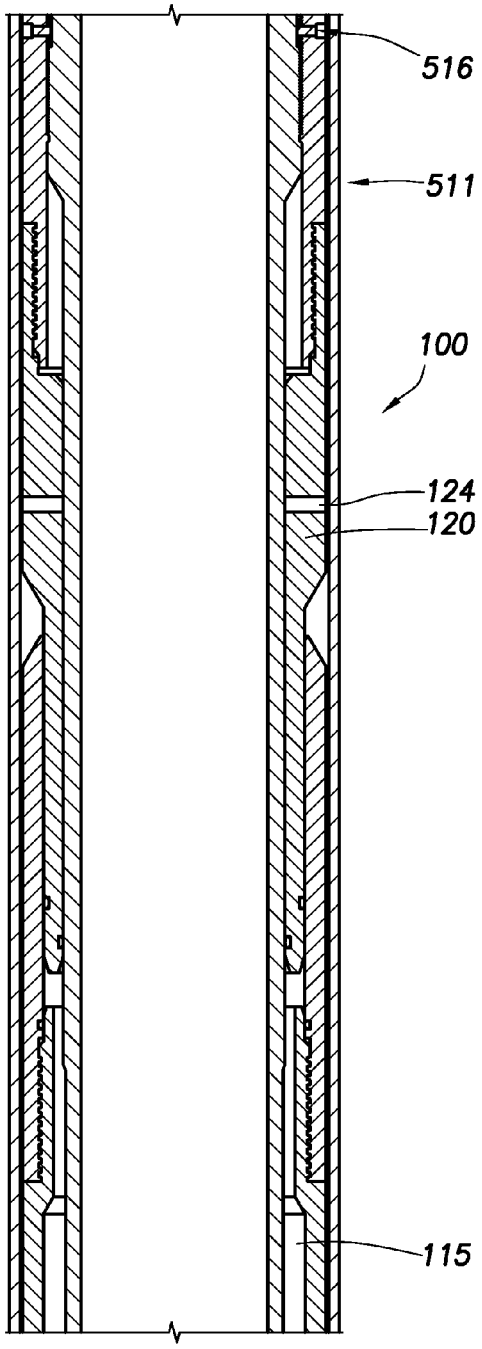
Figure 5C:
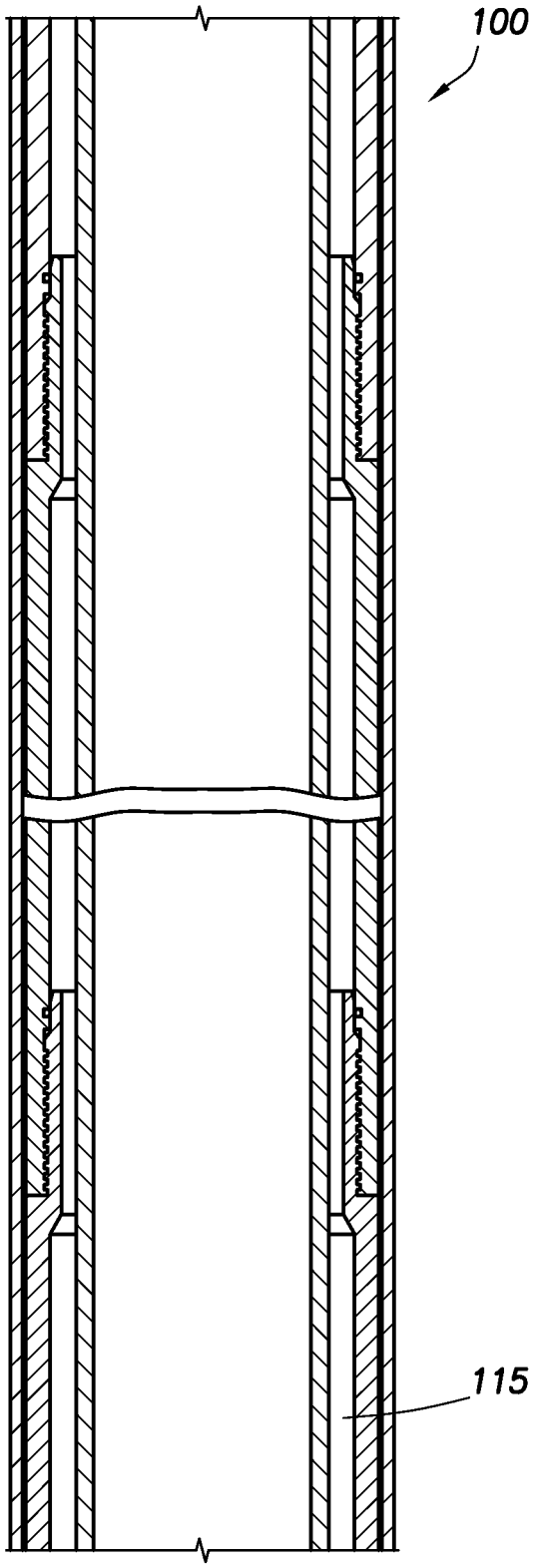
Figure 5D:
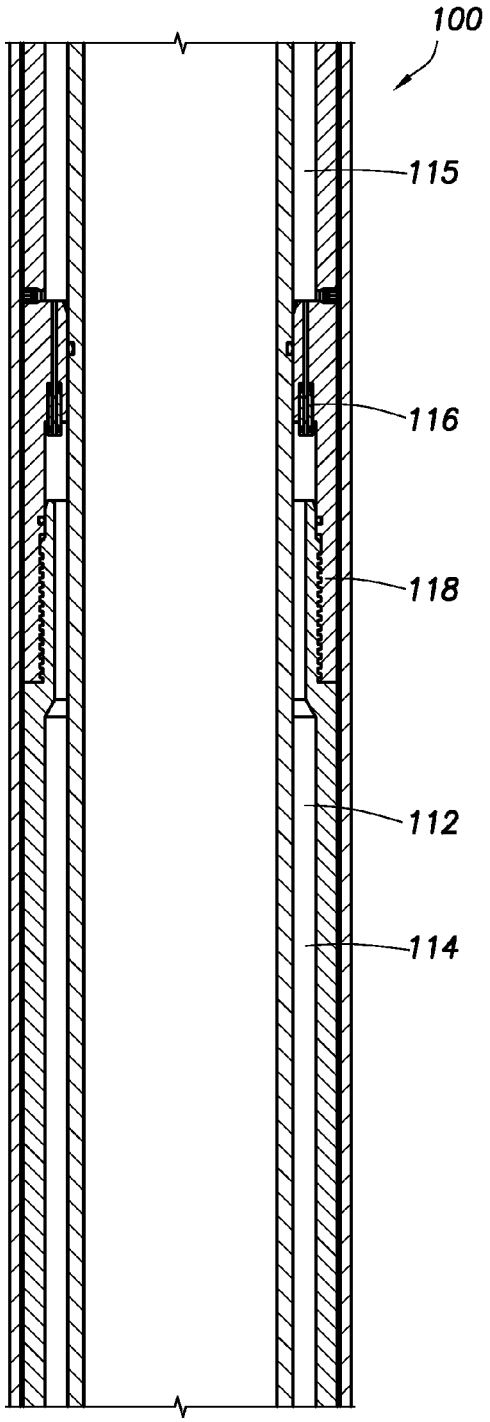
Figure 5E:
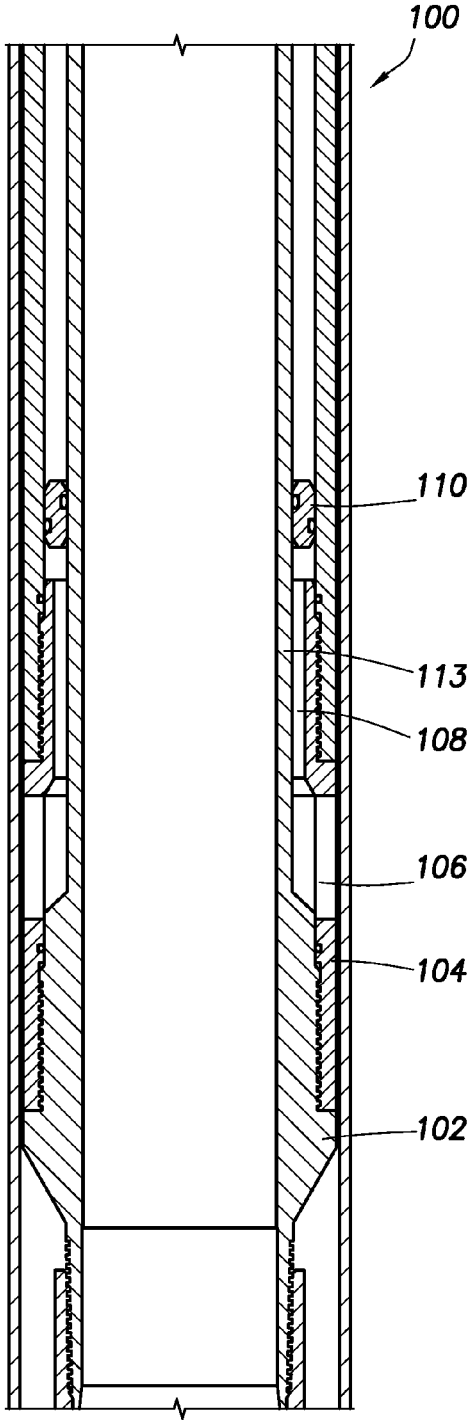
Figure 5F:
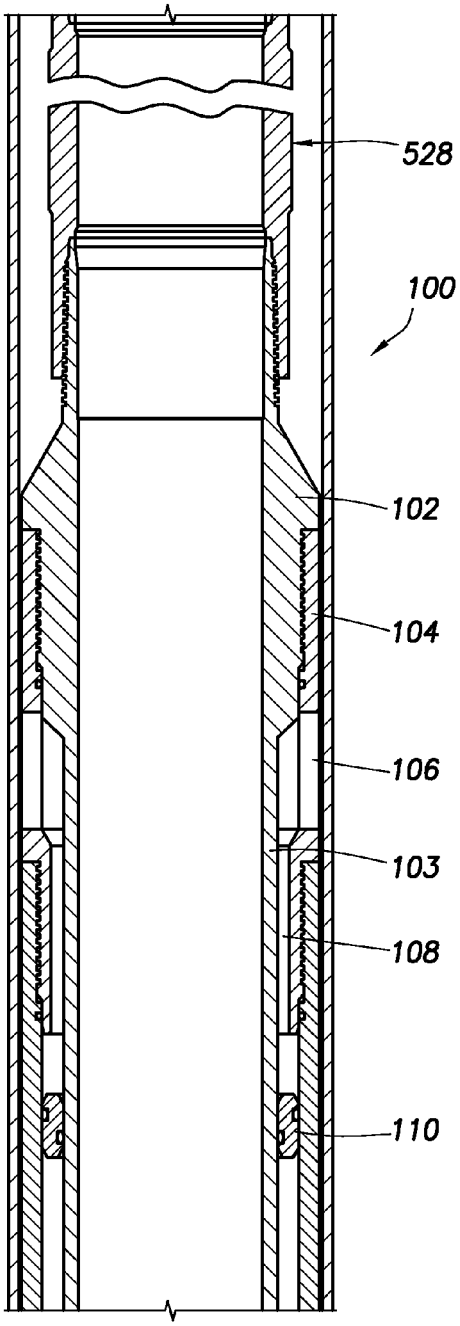
Figure 5G:
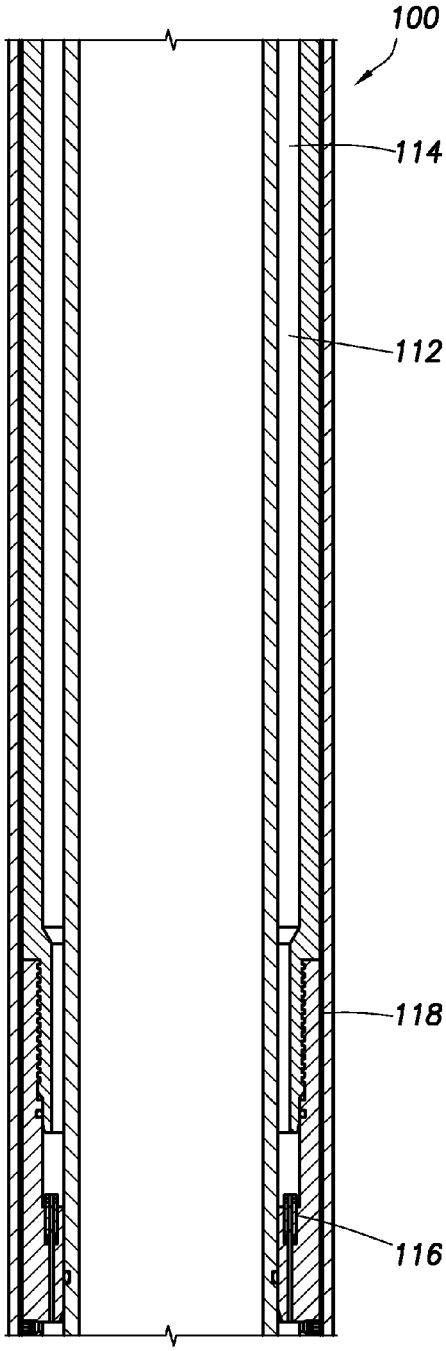
Figure 5H:
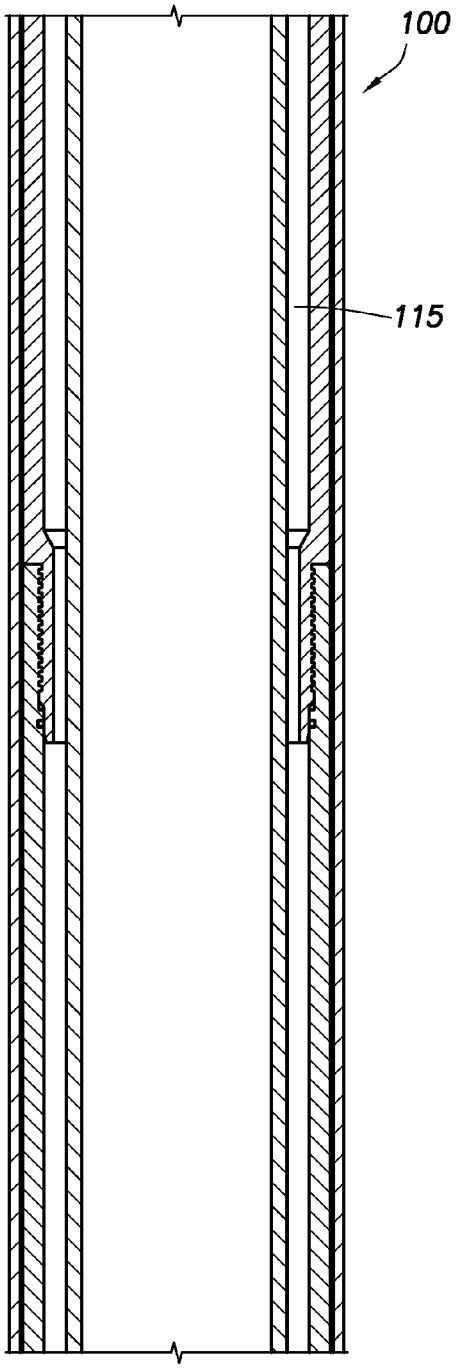
Figure 5I:
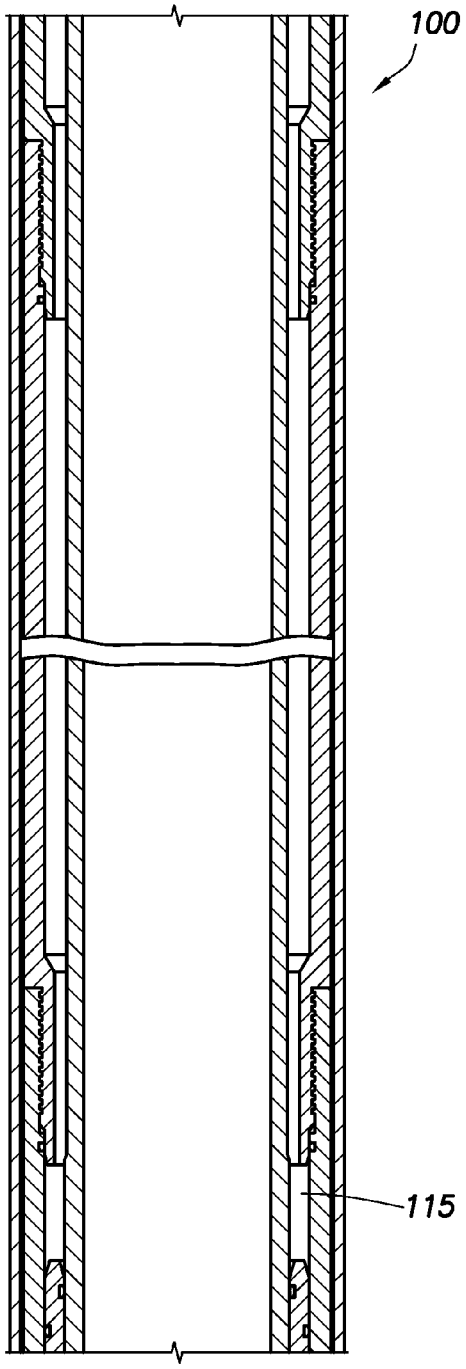
Figure 5J:
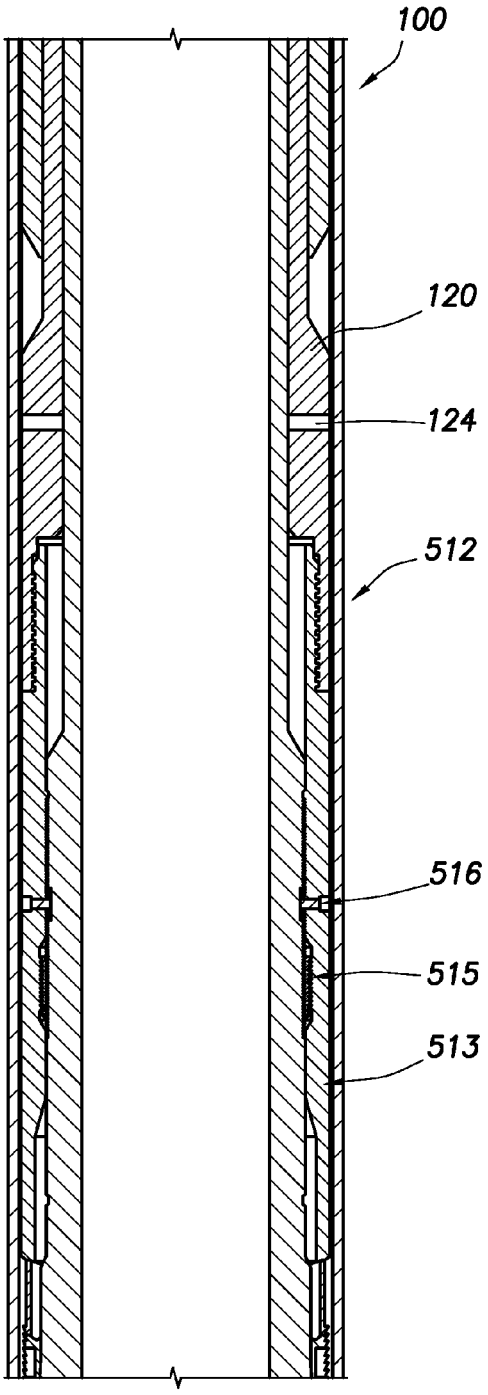
Figure 5K:
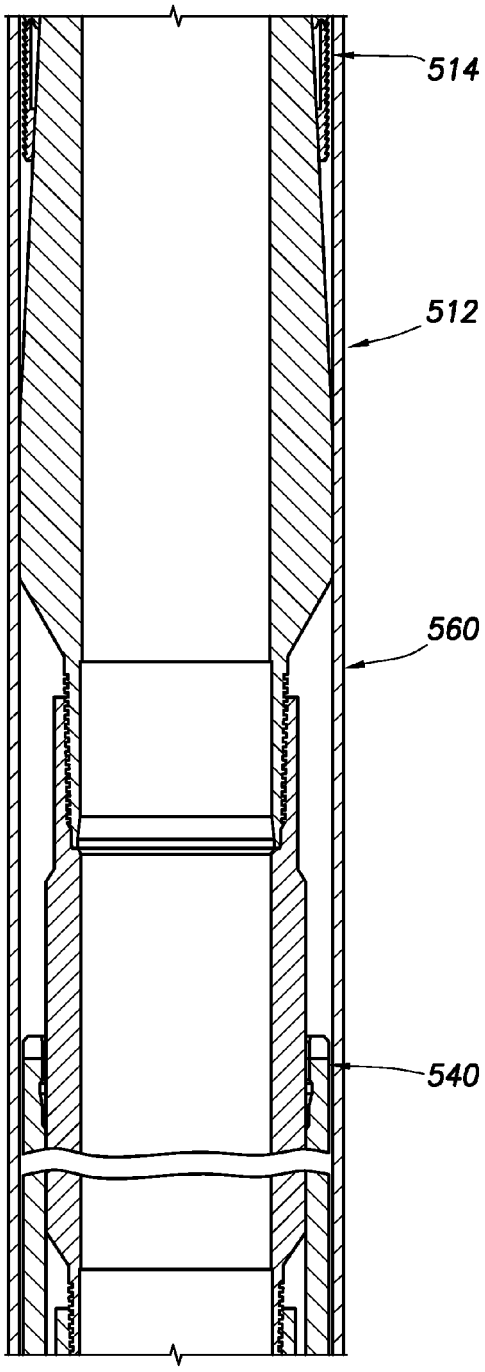
Figure 5L:
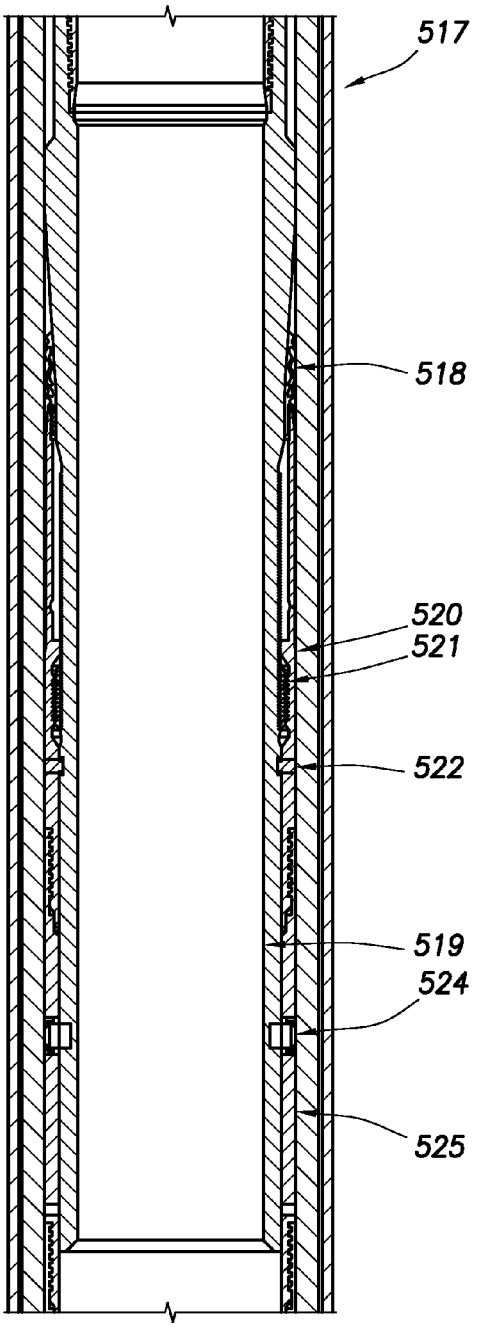
Figure 5M:
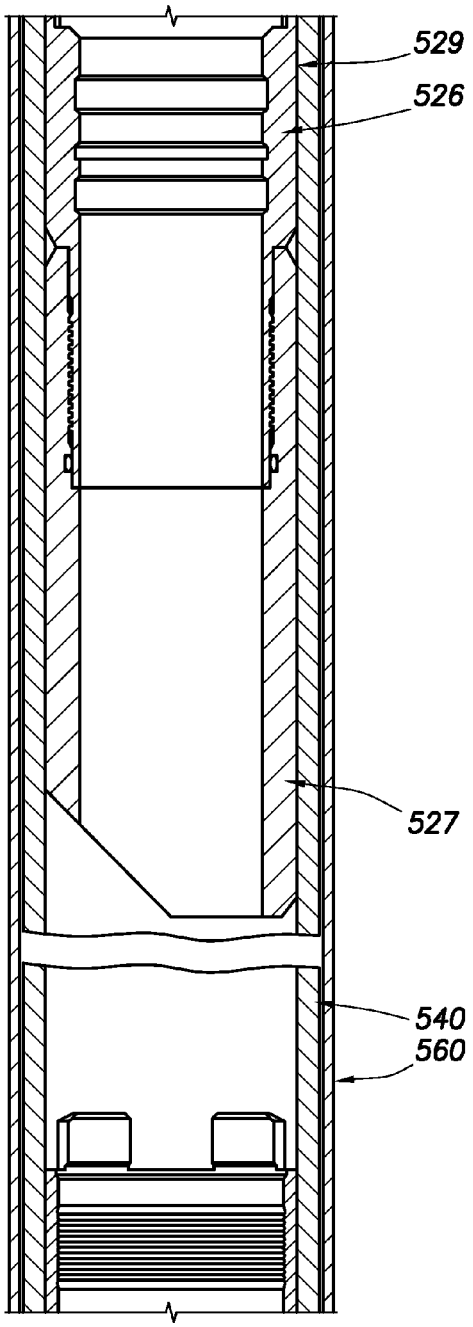
Figure 5N:
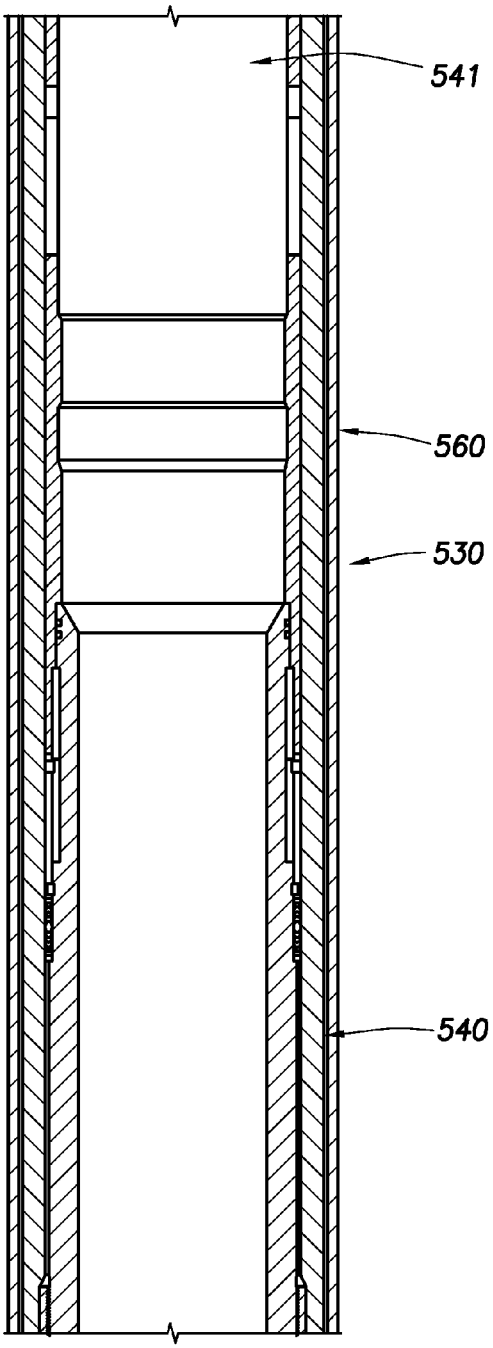
Figure 5O:
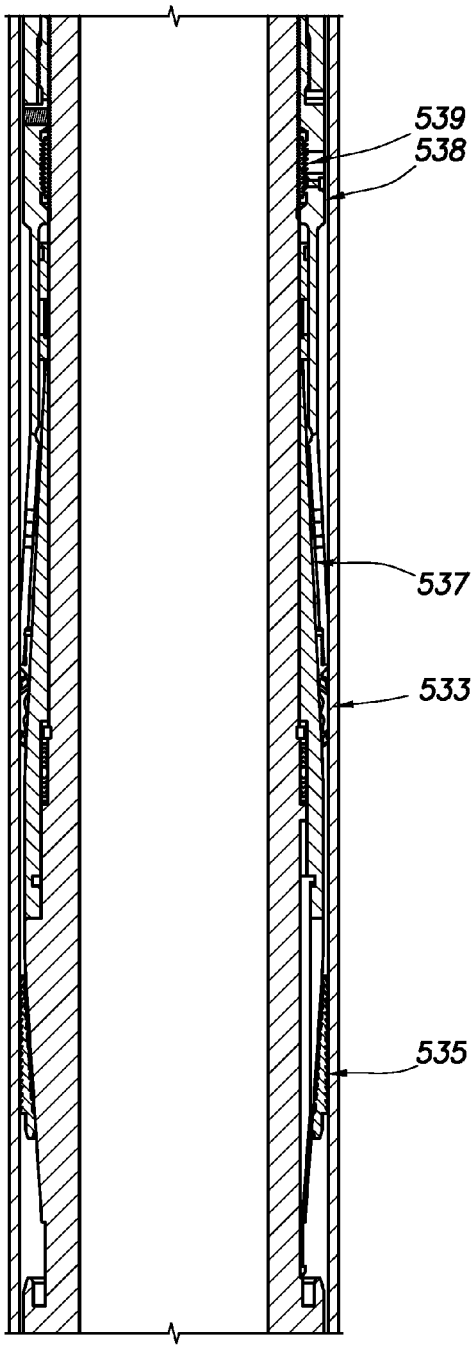
Figure 7A:
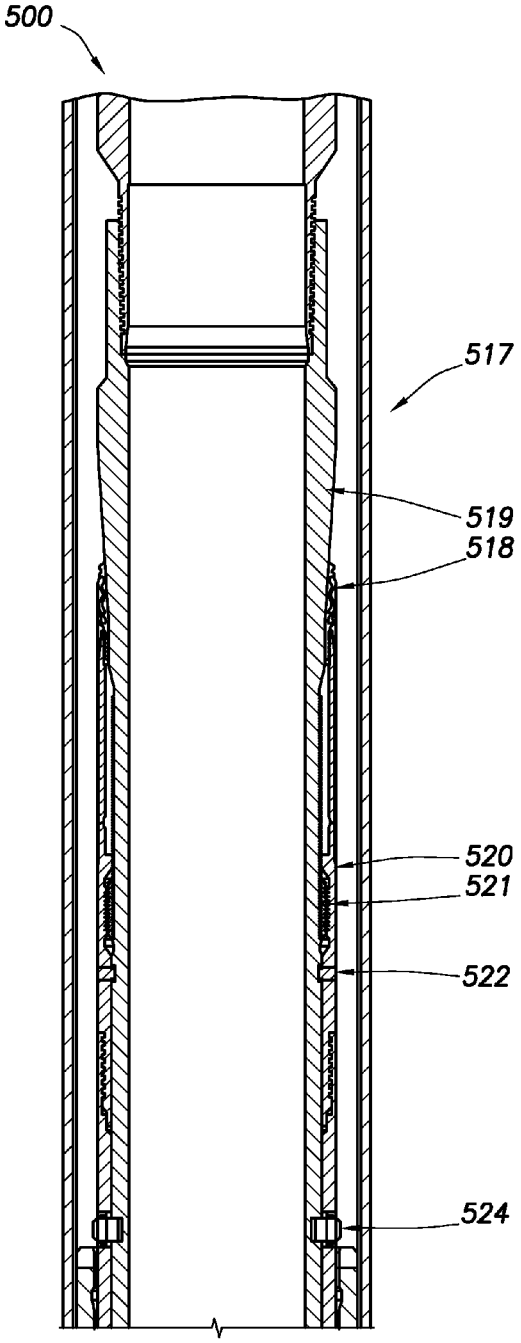
FIGS. 7A-10M depict a sequence of method steps associated with tying a well back to the surface using a Hybrid-Tieback Seal Assembly (HTSA), in accordance with certain embodiments of the present disclosure
Figure 7B:
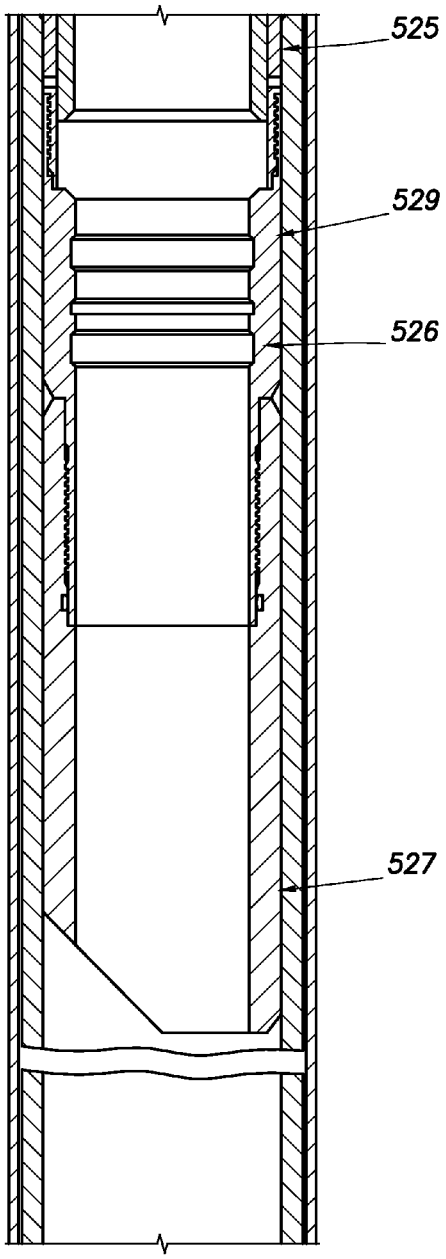
Figure 7C:
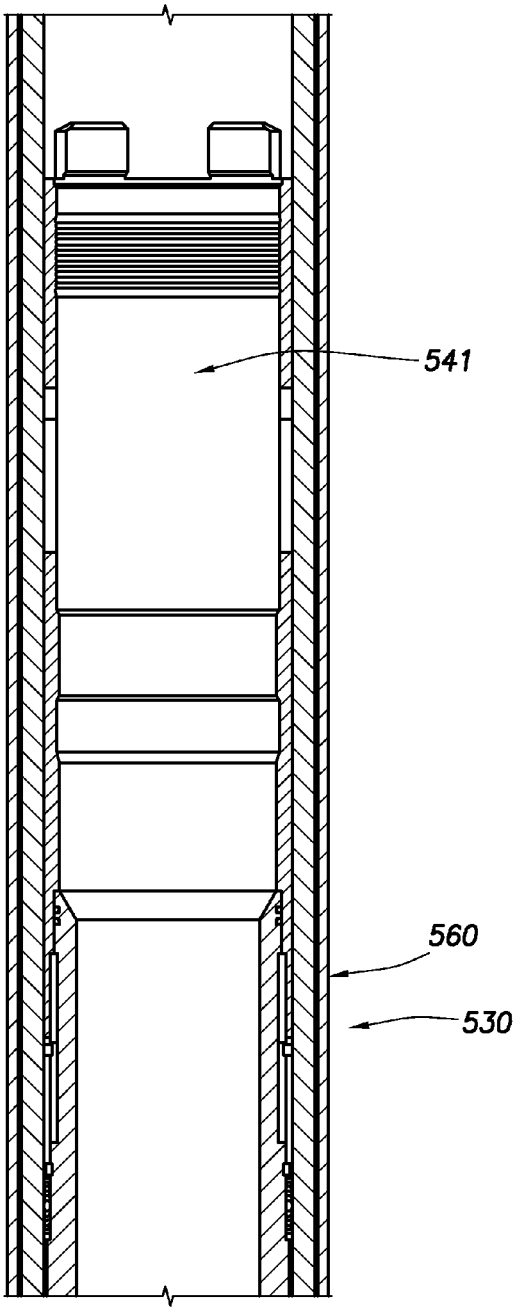
Figure 7D:
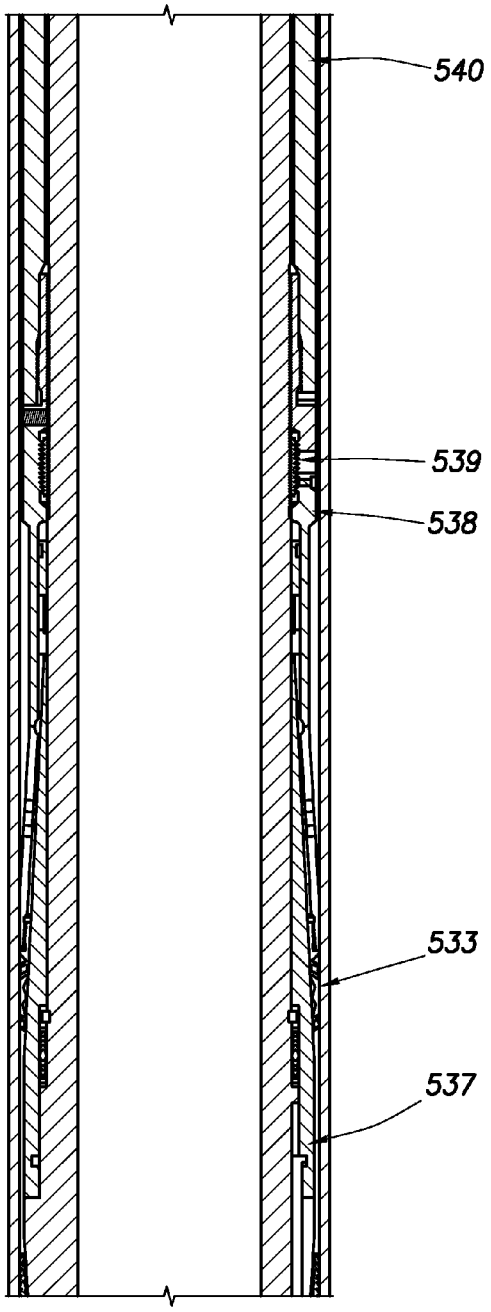
Figure 7E:
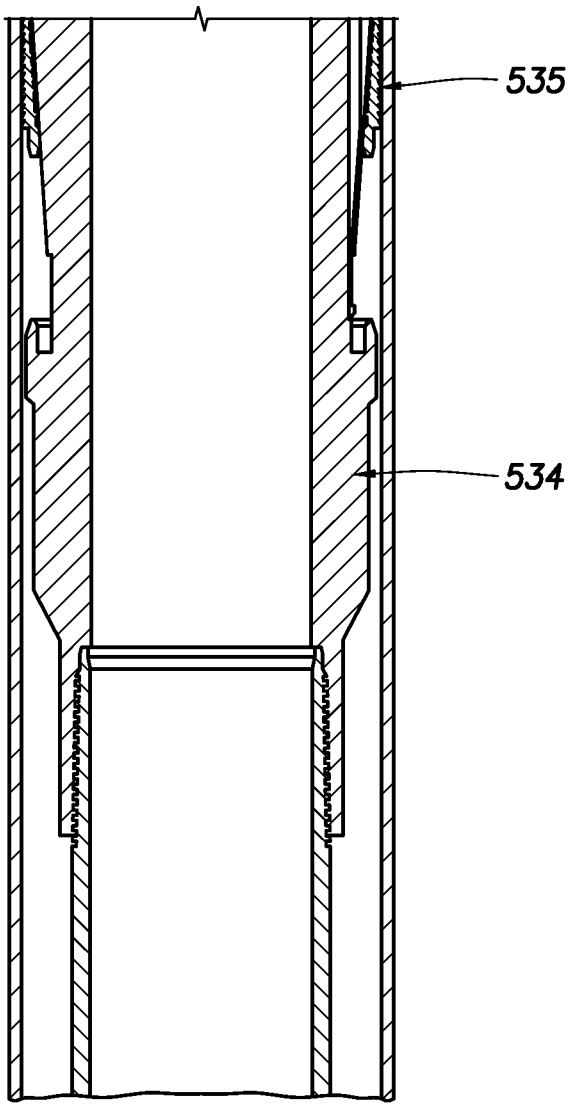

FIGS. 5A-5P depict a Hybrid-Tieback Seal Assembly (HTSA), denoted generally with reference numeral 500, located within a downhole liner hanger system, denoted generally with reference numeral 530, in accordance with an illustrative embodiment of the present disclosure. FIGS. 5A through 5P show the HTSA as it extends from one distal end to another.

In this illustrative embodiment, the liner hanger system 530 may be run and set in a wellbore (not shown). The liner hanger system 530 may be disposed within a host casing 560. The liner hanger system 530 may comprise, but is not limited to, a packer seal 533, a running adapter 541, a hanger body 534, a slip 535, a packer cone 537, a pusher sleeve 538, a lock ring 539, and a receptacle 540. In certain implementations, the receptacle 540 may include, but is not limited to, a tie back receptacle (TBR) or polished bore receptacle (PBR).

In this illustrative embodiment, the HTSA 500 may be set in the liner hanger system 530. The HTSA 500 may comprise one or more anchoring bodies, which may be hydraulically or mechanically set. In certain embodiments in accordance with the present disclosure the one or more anchoring bodies may include a hold up body 511 and a hold down body 512, which may be hydraulically or mechanically set. The hold up and hold down bodies 511, 512 may include a pusher sleeve 513 having an anti-back lash system to prevent movement and one or more single direction or bi-directional slips 514, which may be independently set. The hold up and hold down bodies 511, 512 also may include a locking device 515, such as a lock ring, snap ring, collet, wedge or segmented slip system, and a shear pin 516. The slips 514 may be one piece or multiple pieces. The HTSA 500 may incorporate any suitable slip mechanisms including, but not limited to, slip mechanisms disclosed in U.S. Pat. No. 6,761,221, the entirety of which has been incorporated by reference into the present disclosure.

The HTSA 500 may also comprise one or more metal to metal packer seal assemblies 517 which may be hydraulically or mechanically set. The packer seal assembly 517 may include, but is not limited to, a packer seal 518, packer body 519, pusher sleeve 520, a lock ring 521, a shear pin 522, a locking assembly 524, a lock body 525, and a mule shoe or wireline entry guide 527. Although certain components of the packer seal assembly 517 are discussed for illustrative purposes, it would be appreciated by those of ordinary skill in the art, having the benefit of the present disclosure, that one or more components may be removed or modified without departing from the scope of the present disclosure. The HTSA 500 may incorporate sealing technology disclosed in U.S. Pat. No. 6,666,276, the entirety of which has been incorporated by reference into the present disclosure.

In certain illustrative embodiments, the HTSA 500 may also utilize one or more IHSS 100 to set the hold up body 511 and hold down body 512 and/or packer seal assemblies 517. As shown in FIG. 5, an IHSS 100 may be coupled to the hold up and hold down bodies 511, 512, and used to set the components downhole. In certain embodiments, the HTSA 500 may utilize one or more IHSS 300 to set the hold up body 511, hold down body 512 and/or packer seal assemblies 517. The manner of operation of the IHSS 100 and the IHSS 300 are discussed above in conjunction with FIGS. 1-4 and will therefore not be discussed in detail. Specifically, in the same manner discussed in conjunction with FIGS. 1-4, the IHSS 100 or the IHSS 300 may be used to apply pressure to set the hold up body 511, the hold down body 512 and/or packer seal assemblies 517. In other embodiments, the HTSA 500 may utilize any mechanical, hydraulic, or other type of setting mechanism known to those of ordinary skill in the art to set the downhole components.

In certain embodiments, the HTSA 500 may include any suitable tubing to couple the various downhole components. In certain implementations, the tubing used to couple the downhole components may include, but is not limited to, a pup joint or handling sub. For example, as shown in FIG. 5, a pup joint 528 may be used to couple the packer seal assembly 517 to the hold down body 512. Similarly, a pup joint 528 may be used to couple the IHSS 100 or IHSS 300 used to set the hold up body 511 to the IHSS 100 or IHSS 300 used to set the hold down body 512. In this manner, the system provides a means of creating an integral production liner to the surface or wellhead.

In certain embodiments in accordance with the present disclosure, the HTSA 500 may be run into the wellbore (not shown) and landed into the receptacle 540 of the liner hanger system 530. The HTSA 500 may protect the host casing 560 above the liner hanger system 530 and may provide zonal isolation up to the surface or subsea wellhead.

Operation of the HTSA 500 in accordance with the illustrative embodiment of FIGS. 5A-5P will now be discussed in conjunction with FIG. 6. FIG. 6 is a flowchart depicting illustrative method steps associated with a method to tie a well back to the surface using the HTSA 500 of FIG. 5, in accordance with an illustrative embodiment of the present disclosure. Although a number of steps are depicted in FIG. 6, as would be appreciated by those of ordinary skill in the art, having the benefit of the present disclosure, one or more of the recited steps may be eliminated or modified without departing from the scope of the present disclosure.

First, at step 602, the HTSA 500 is run into a wellbore (not shown). At step 604, the wellhead hanger (not shown) is landed in the wellhead (not shown). As a result of landing the wellhead hanger (not shown) in the wellhead (not shown), the HTSA 500 is located within the receptacle 540 of the liner hanger system 530. At step 606, the hold up and hold down bodies 511, 512 may be set within the host casing 560. Specifically, the hold up and hold down body assemblies 511, 512 may be set using an IHSS 100 or IHSS 300. This may set the hold up and hold down body assemblies 511, 512 and may anchor the HTSA 500 within the host casing 560. The slips 514 of the hold up and hold down bodies 511, 512 may be used to isolate the HTSA 500 from movement. The locking device 515 may retain the mechanical load applied to the slips 514 of the hold up and hold down bodies 511, 512. At step 608, the packer seal 518 may be mechanically or hydraulically set in the receptacle 540 of the liner hanger system 530. The packer seal 518 also may be set using an IHSS 100 or IHSS 300. In certain embodiments, the packer seal assembly 517 may be set last because once the packer seal 518 is set, zonal isolation will be created and there may be substantially no further hydraulic communication between the tubing and annulus.

FIGS. 7A-10M depict a sequence of method steps associated with tying a well back to the surface using the HTSA 500 of FIG. 5, in accordance with certain embodiments of the present disclosure.

Referring to FIGS. 7A-7E, a portion of the HTSA 500 is depicted in a run-in-hole configuration. In this illustrative embodiment, the packer seal assembly 517 of the HTSA 500 is shown being run into the wellbore (not shown) and stabbed into the receptacle of the previously installed liner hanger system 530.

Figure 8A:
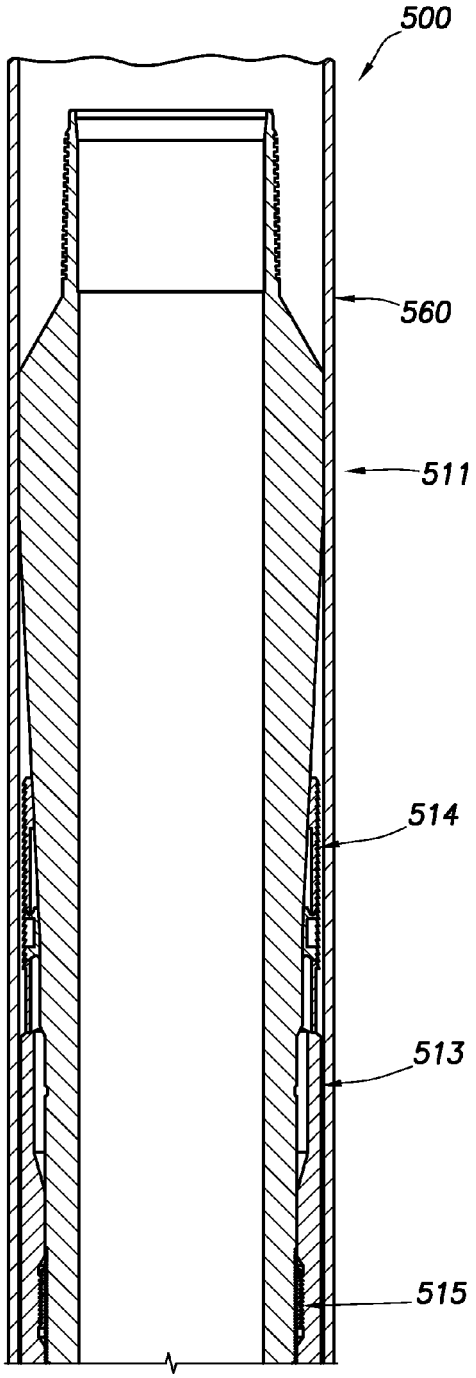
Figure 8B:
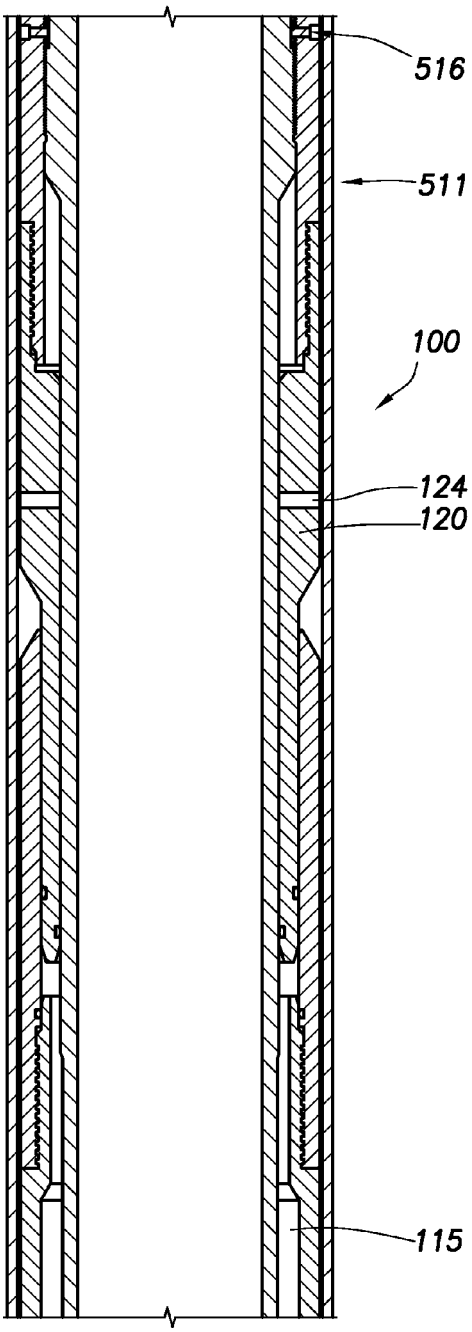
Figure 8C:
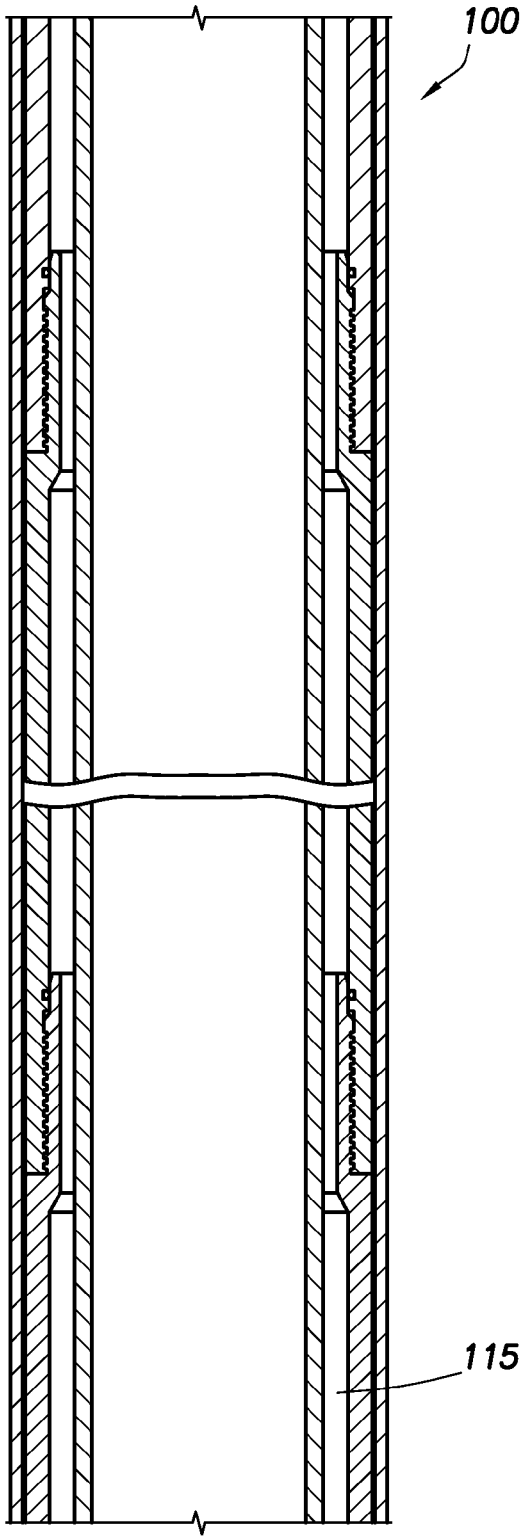
Figure 8D:
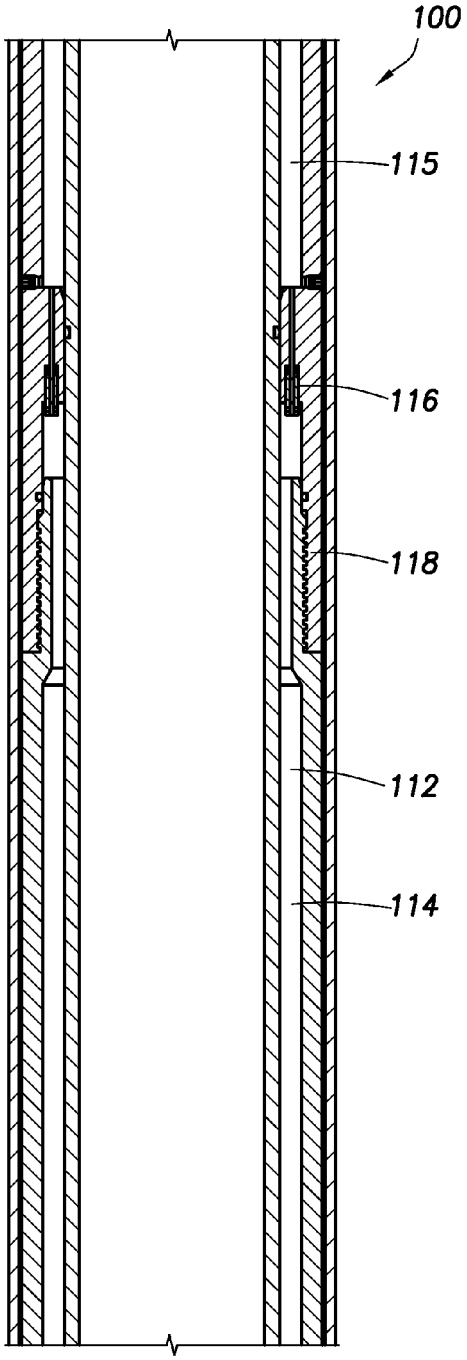
Figure 8E:
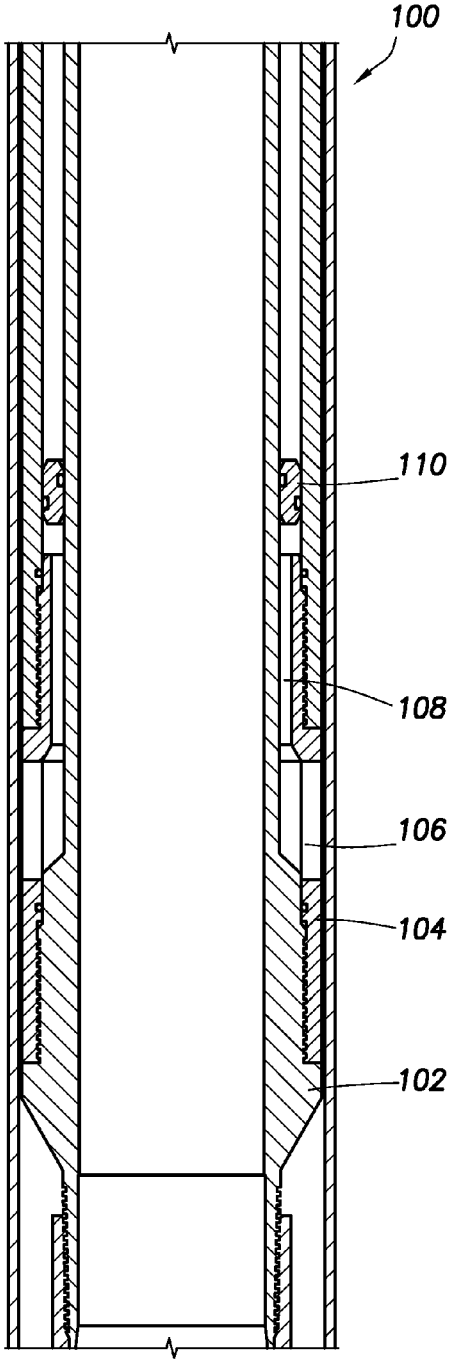
Figure 8F:
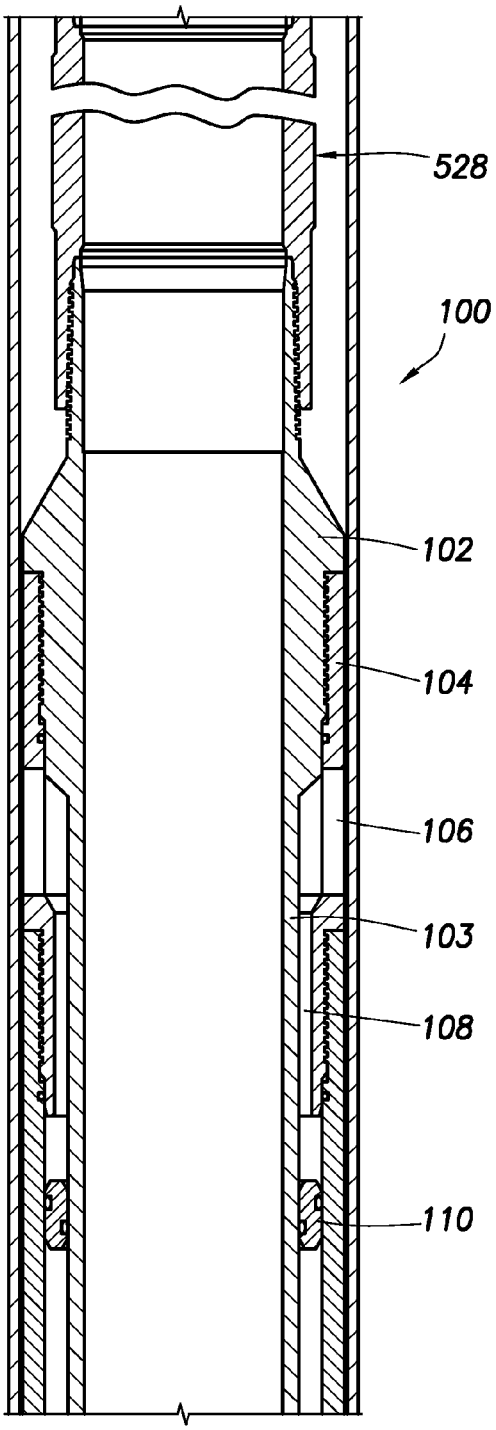
Figure 8G:
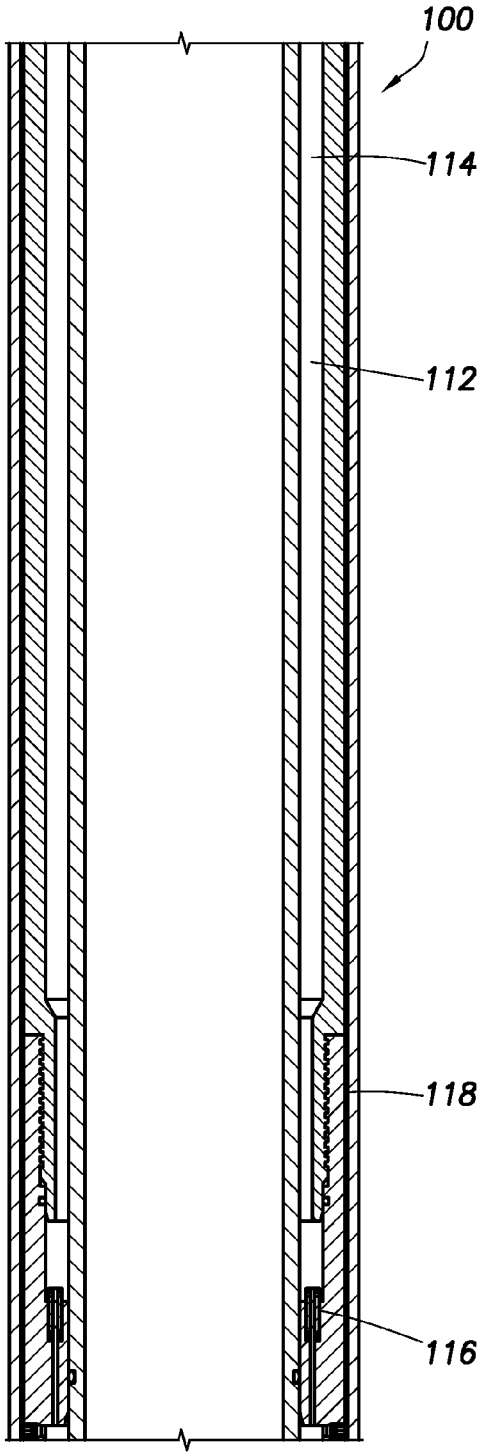
Figure 8H:
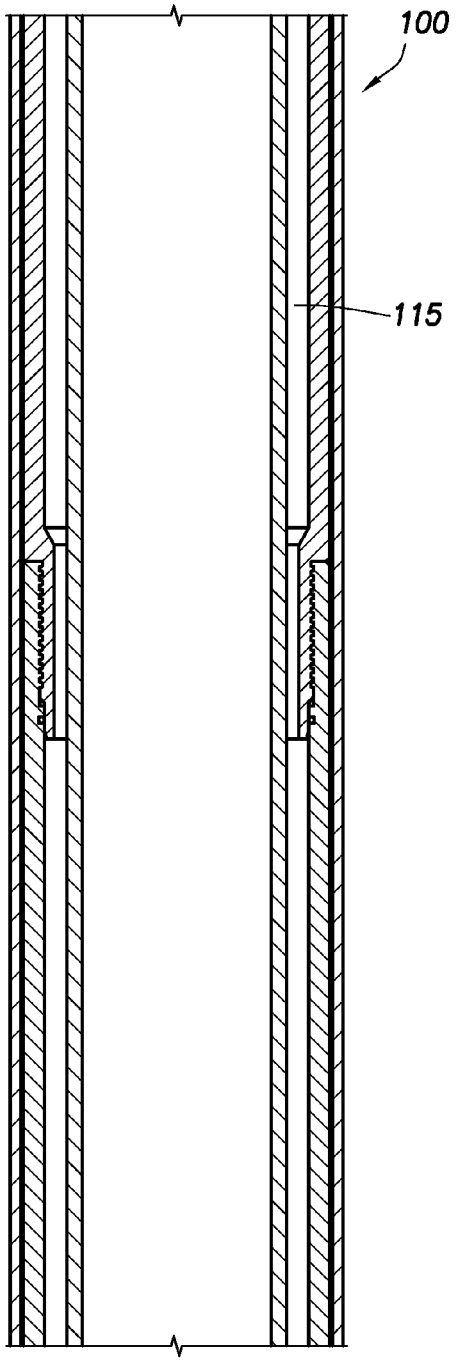
Figure 8I:
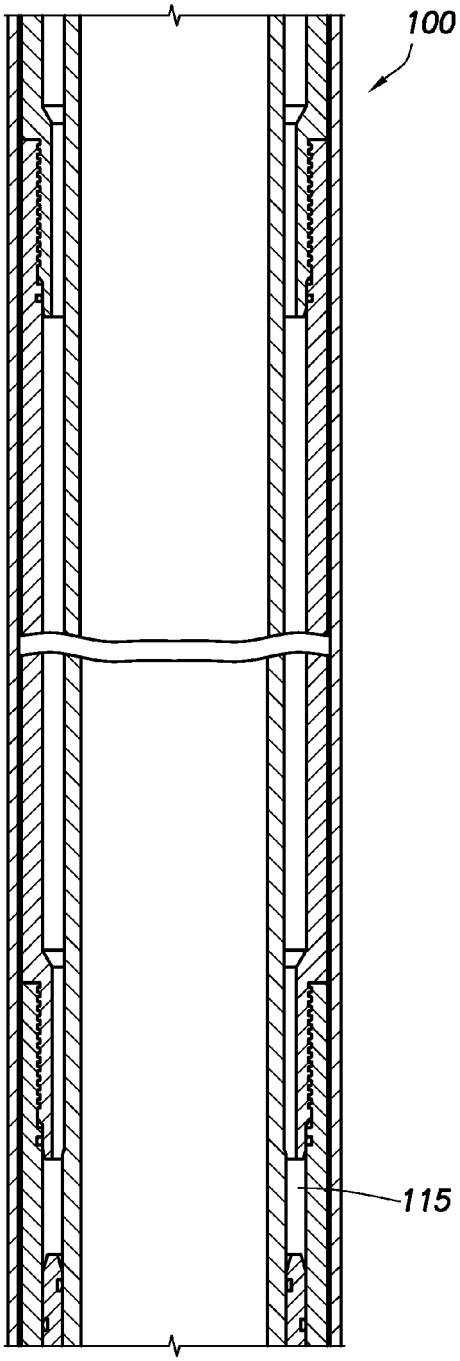
Figure 8J:
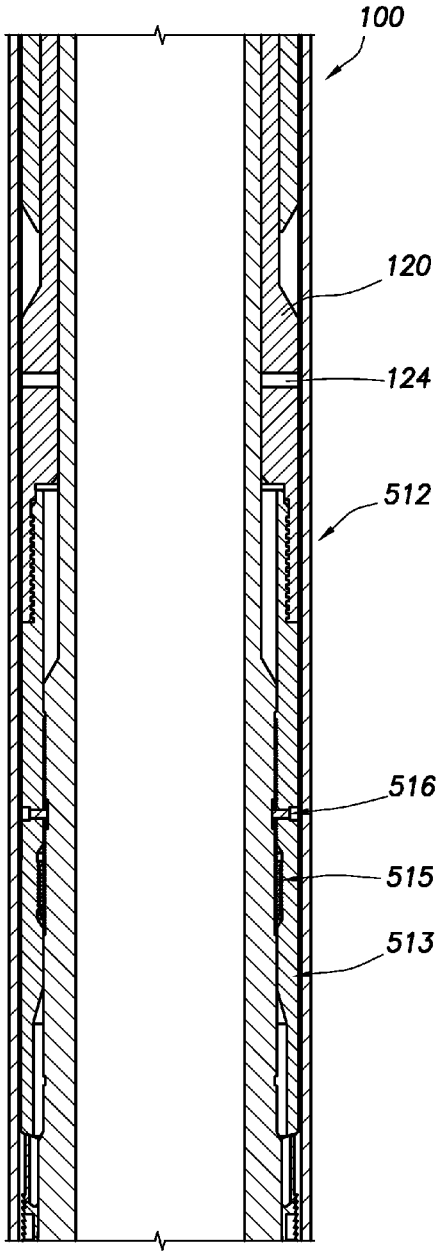
Figure 8K:
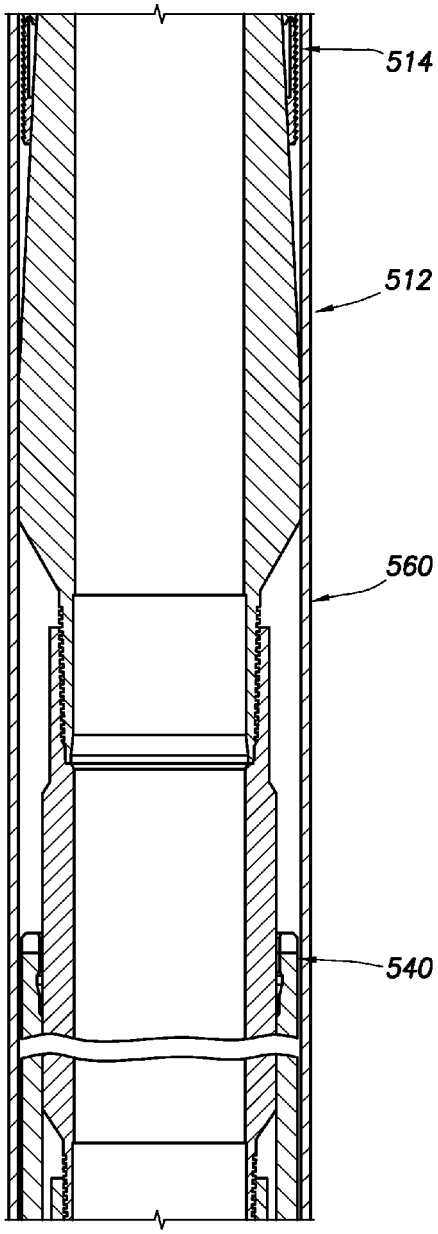
Figure 8L:
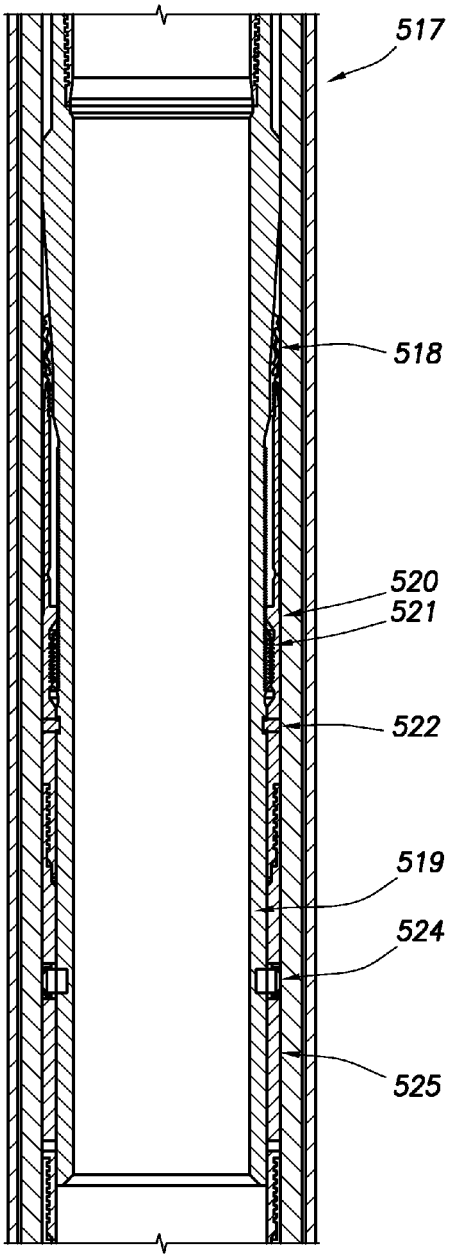
Figure 8M:
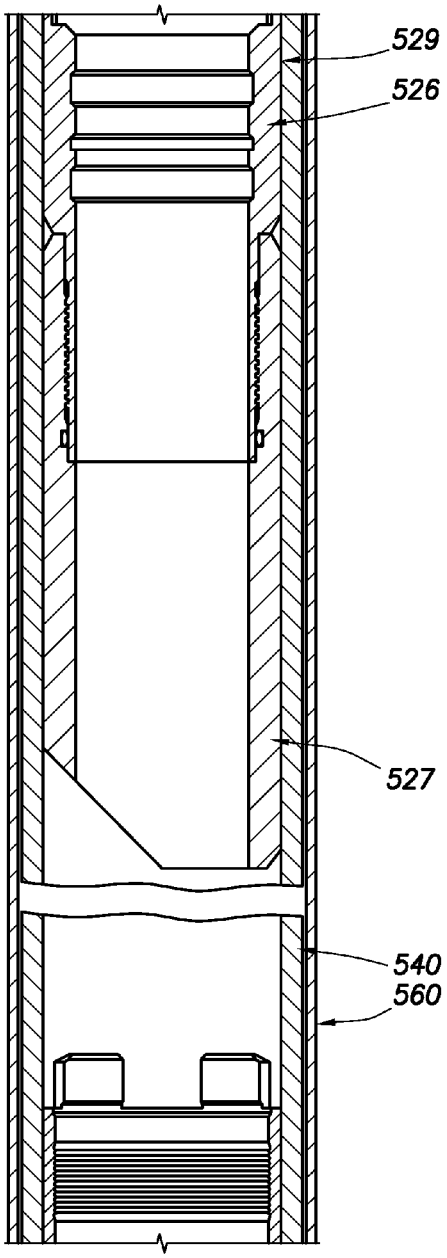
Figure 8N:
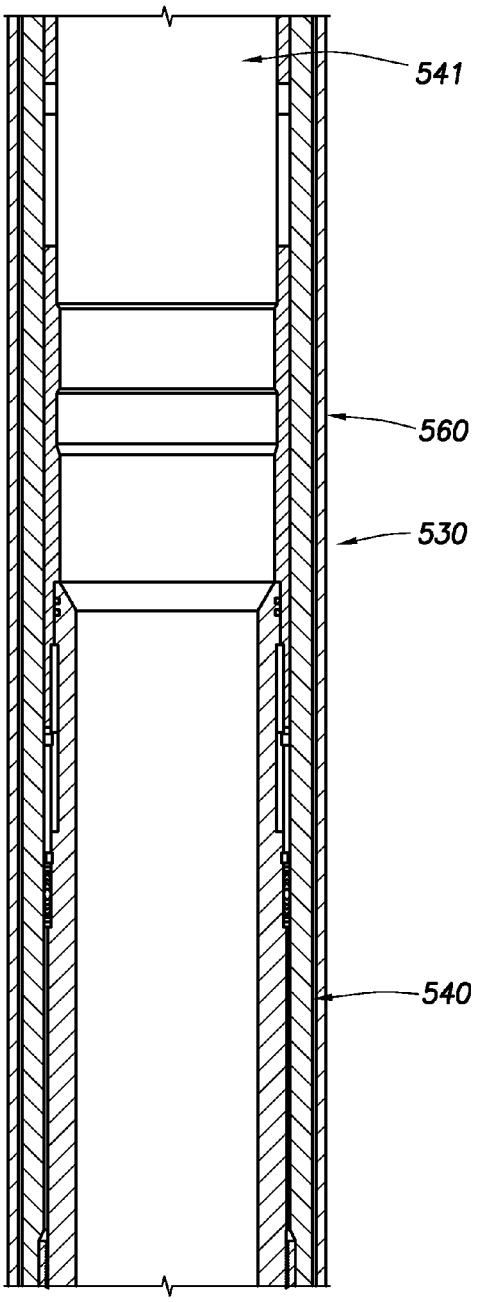
Figure 8O:
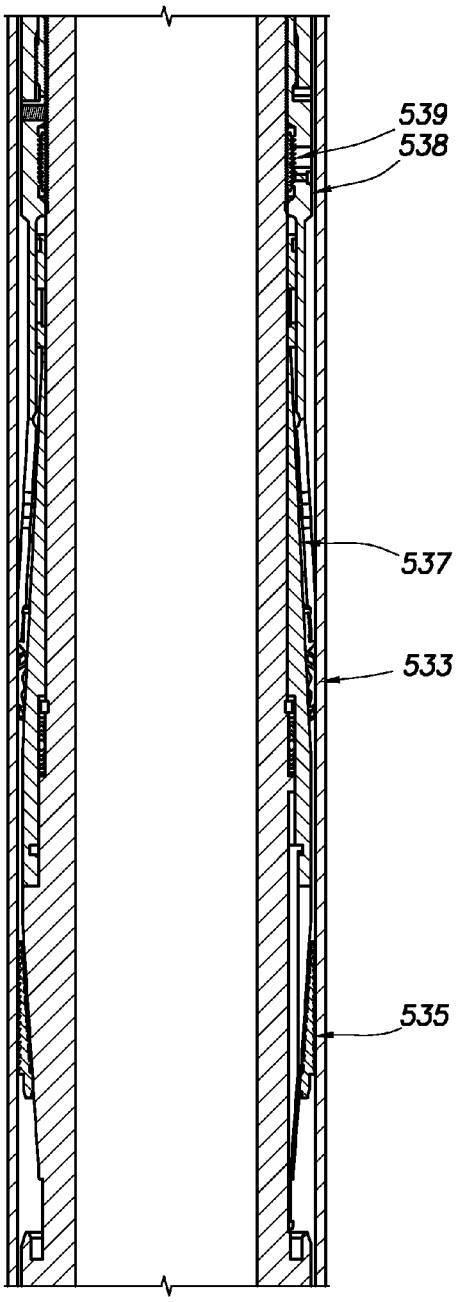
Figure 8P:
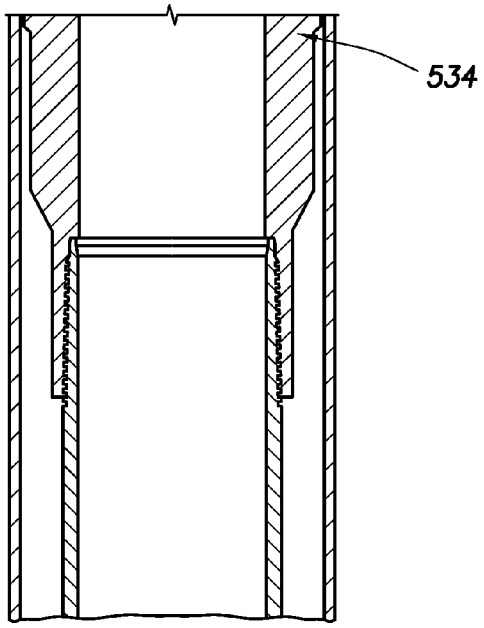

Referring to FIGS. 8A-8P, the HTSA 500 is depicted in its located configuration. After the HTSA 500 has been run into the wellbore (not shown) and stabbed into the receptacle 540 of the liner hanger system 530, the HTSA 500 is located within the receptacle 540 of the liner hanger system 530. This is accomplished by landing the wellhead hanger (not shown) in the wellhead (not shown). The wellhead hanger (not shown) may be landed without any special considerations or allowances for the position of the HTSA 500 within the receptacle 540 of the liner hanger system 530. Specifically, the wellhead hanger (not shown) may be landed regardless of the position of the HTSA 500 within the liner hanger system 530.

Figure 9A:
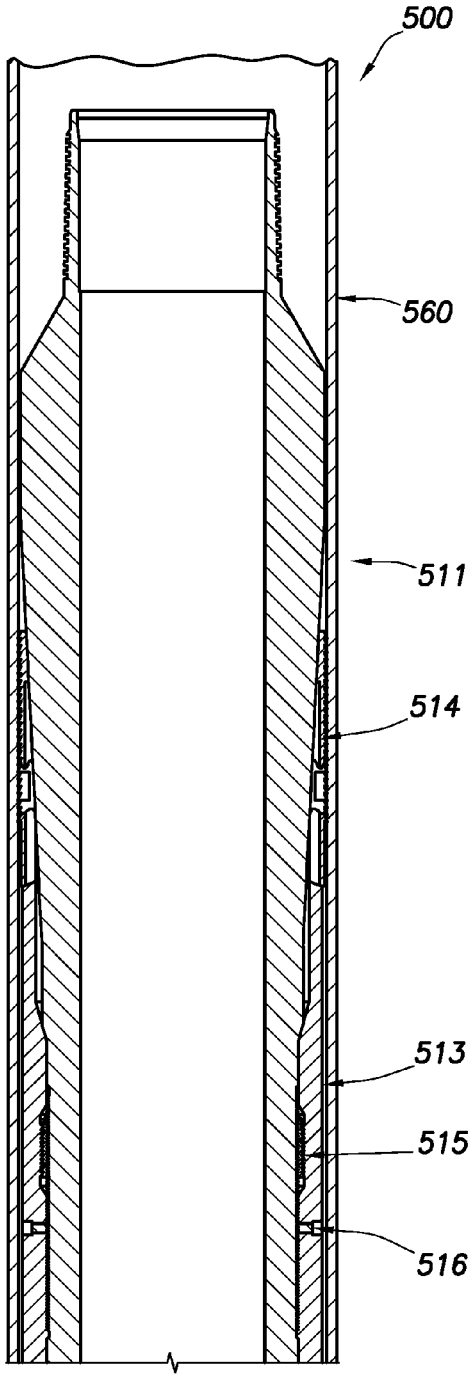
Figure 9B:
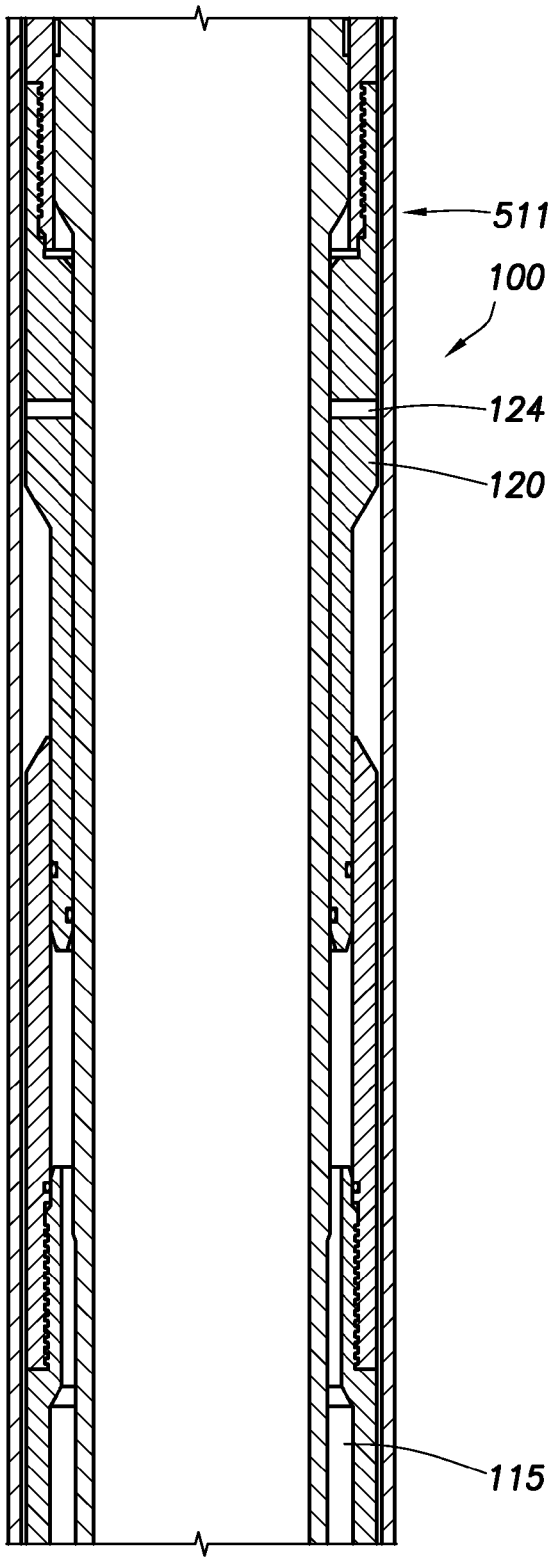
Figure 9C:
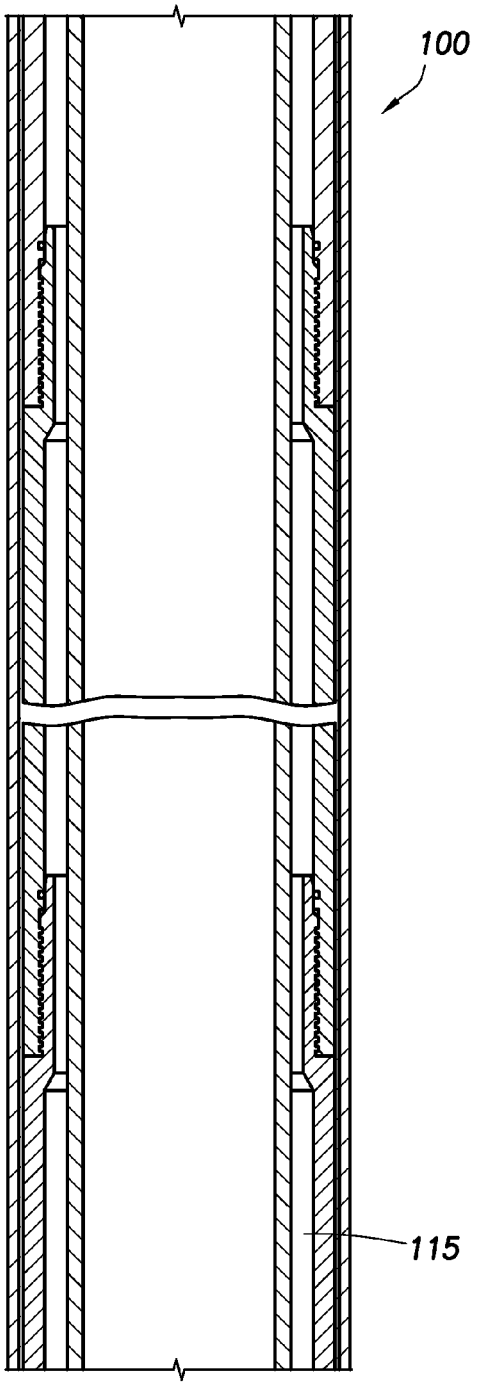
Figure 9D:
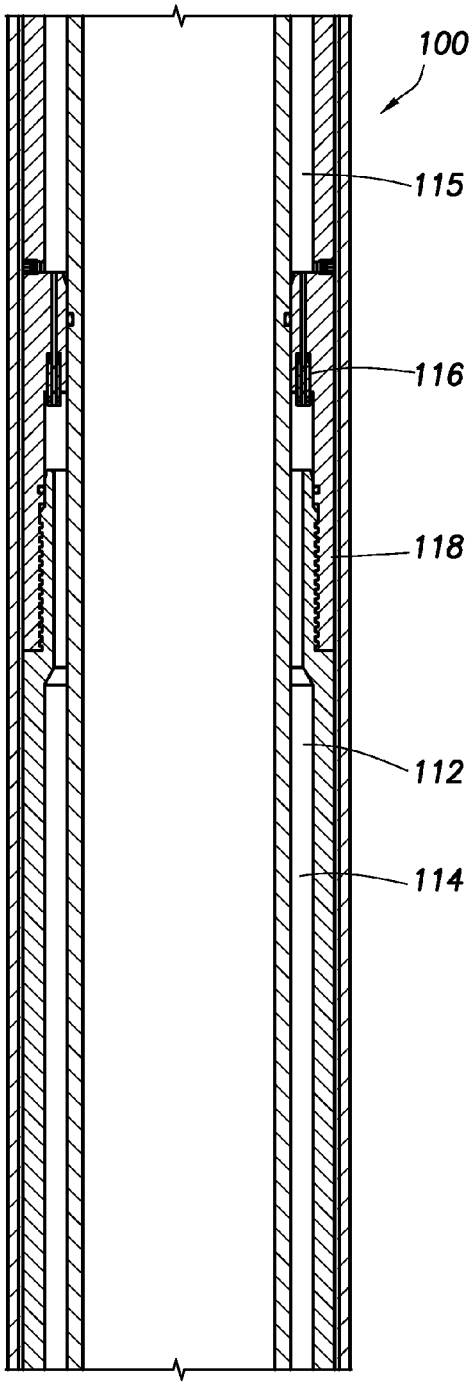
Figure 9E:
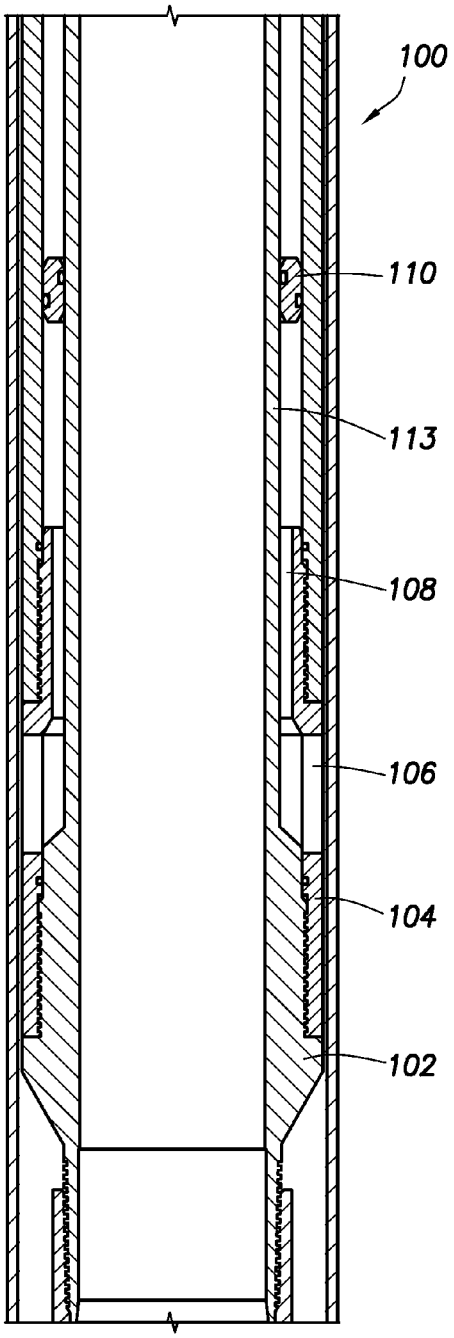
Figure 9F:
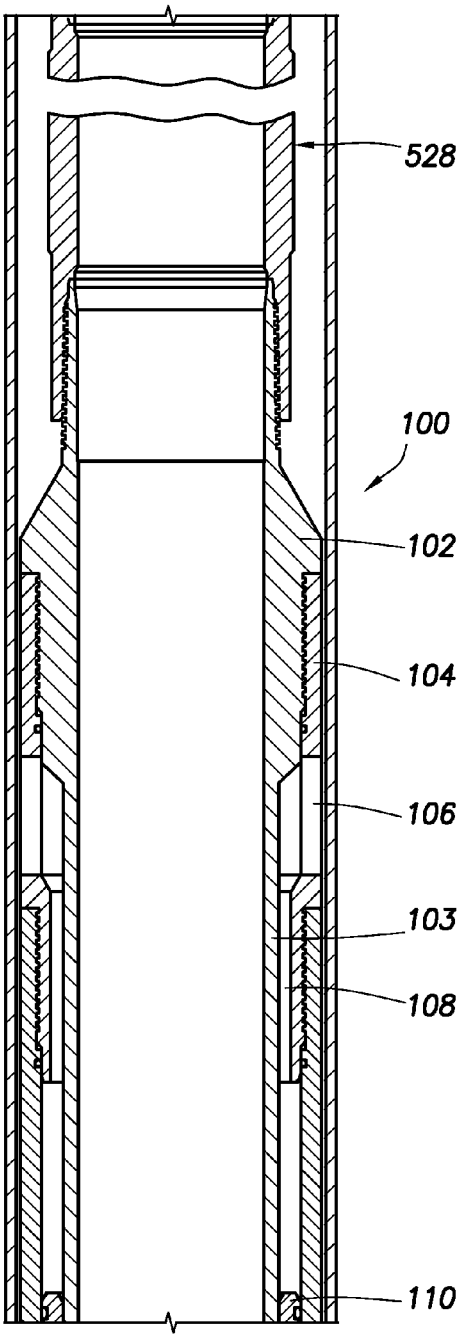
Figure 9G:
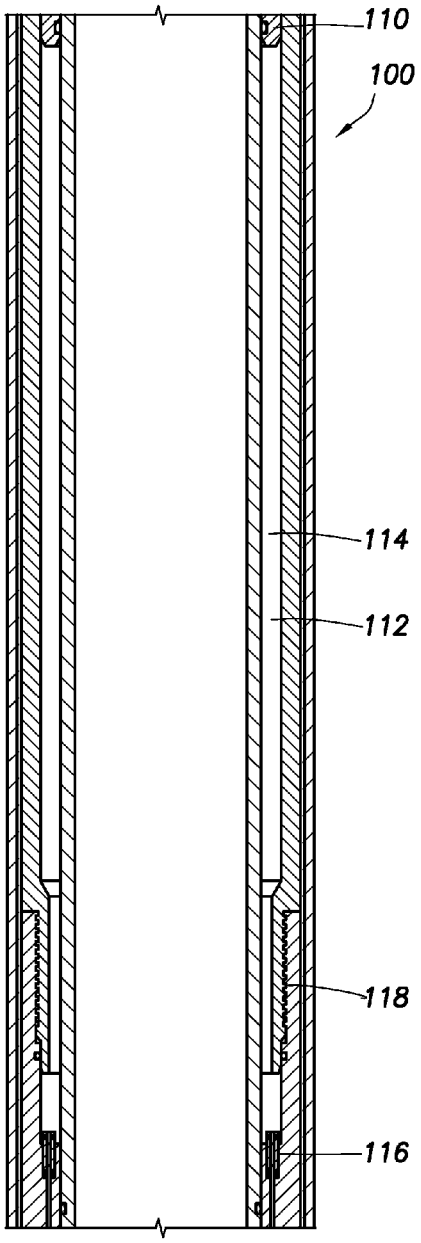
Figure 9H:
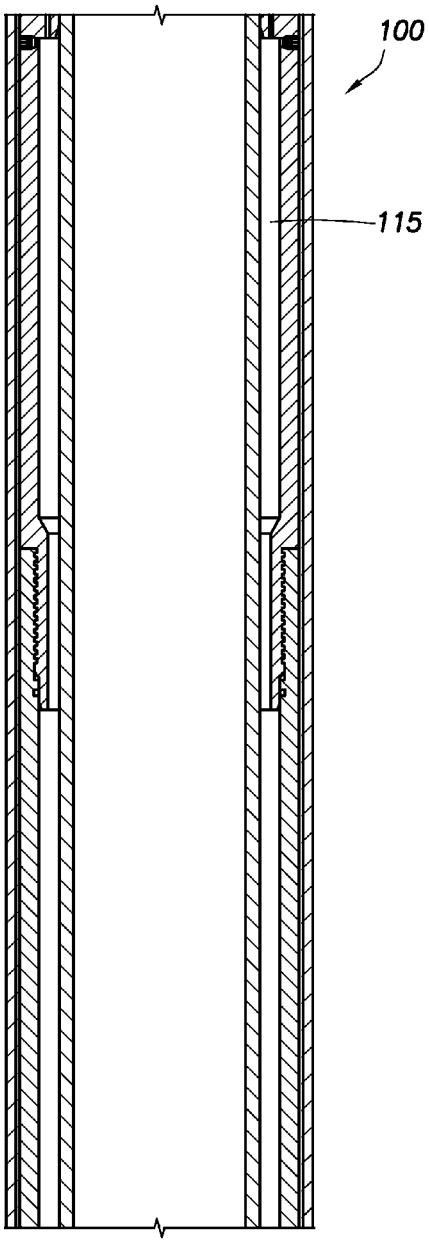
Figure 9I:
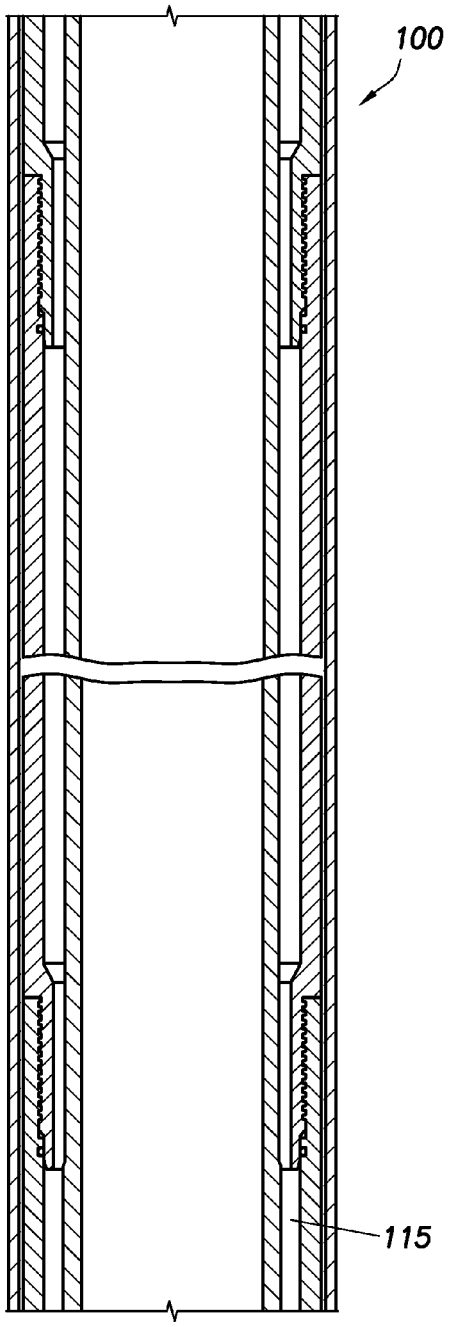
Figure 9J:
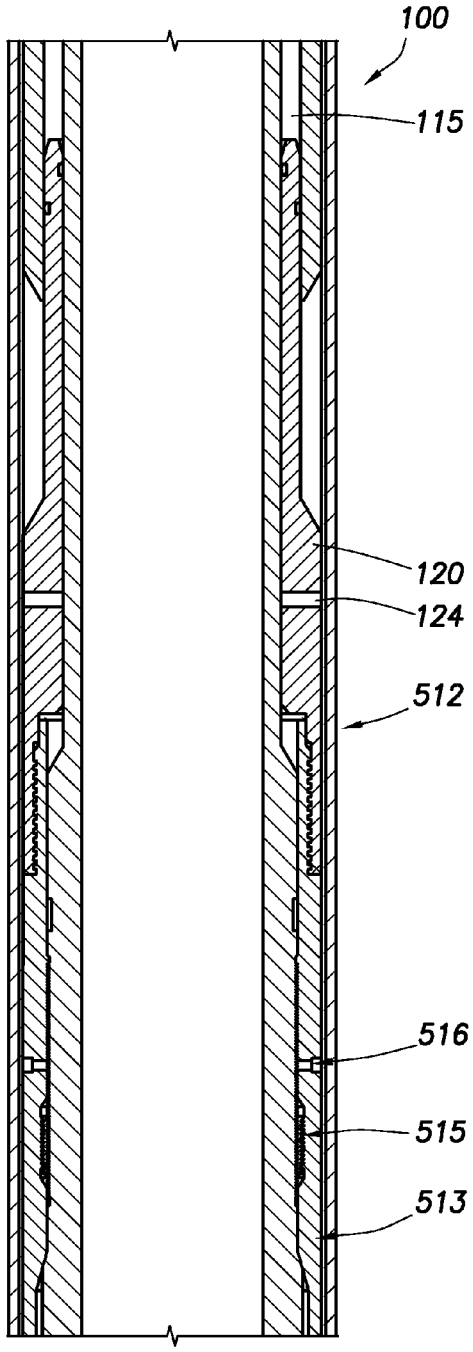
Figure 9K:
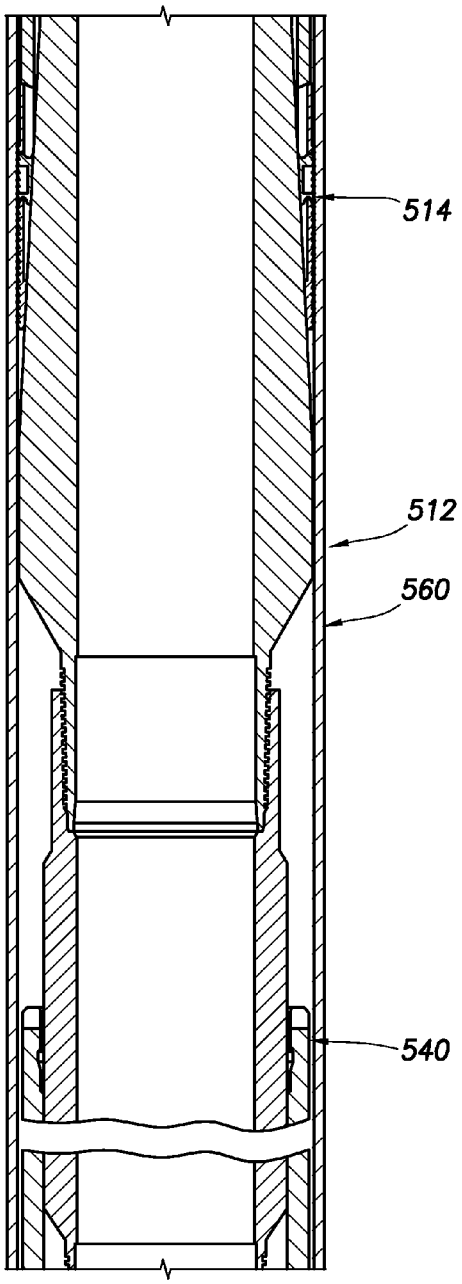
Figure 9L:
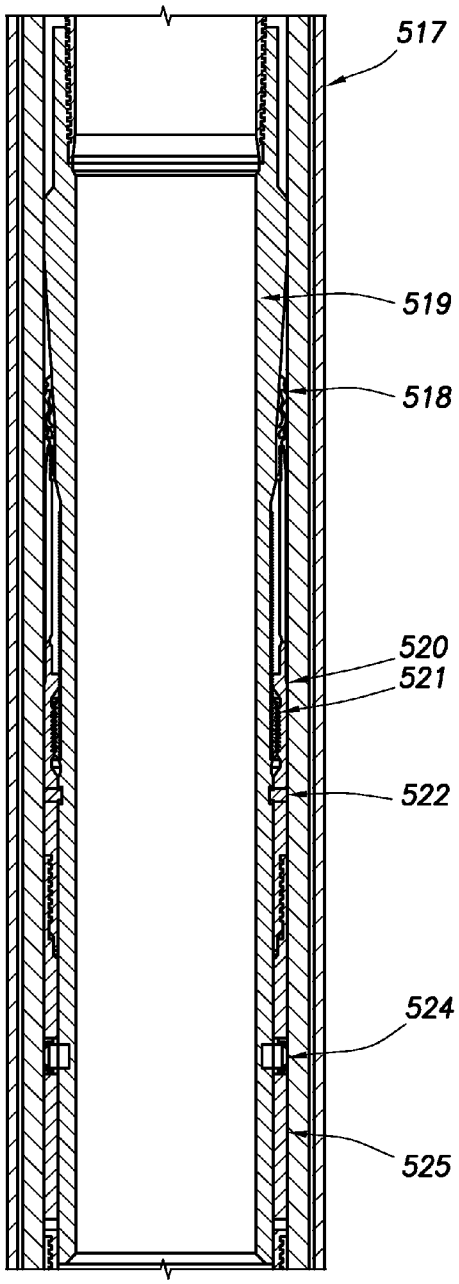
Figure 9M:
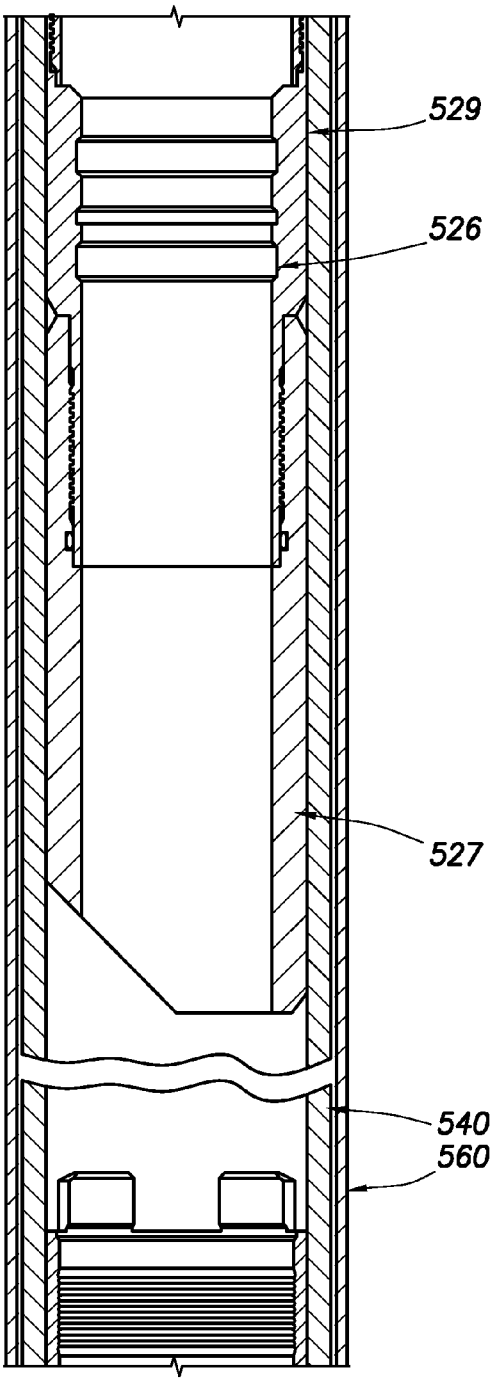
Figure 9N:
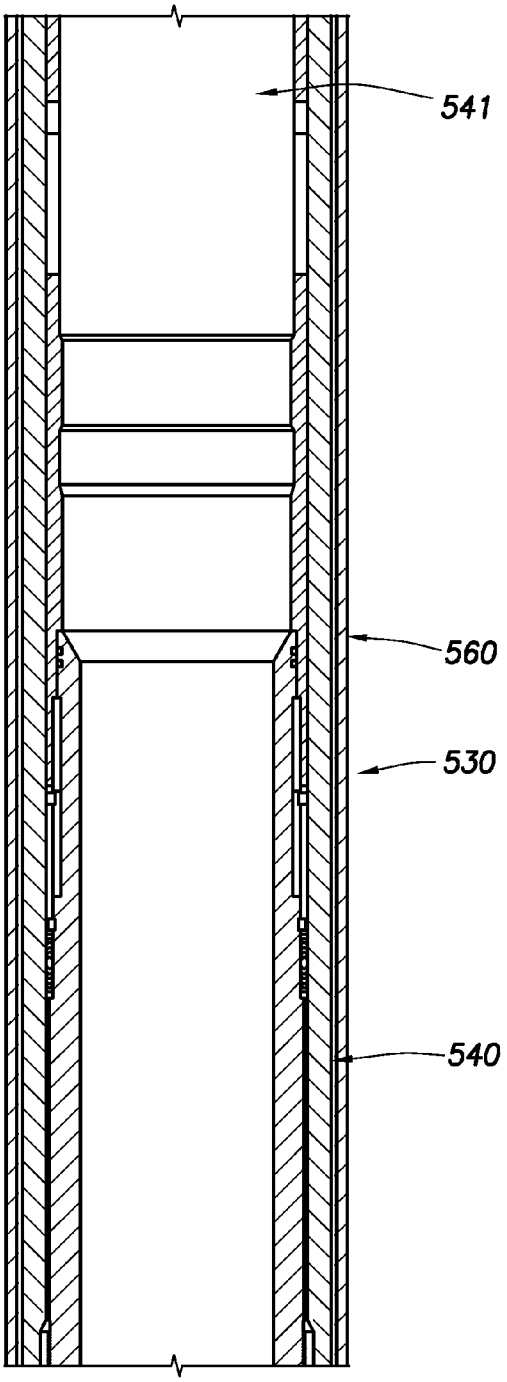
Figure 9O:
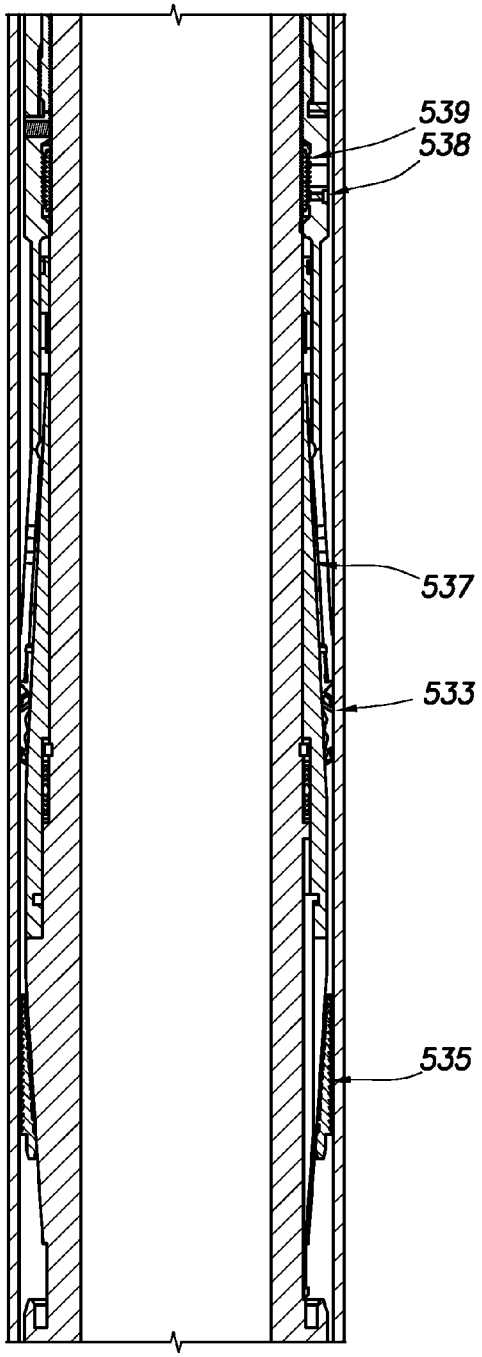
Figure 9P:
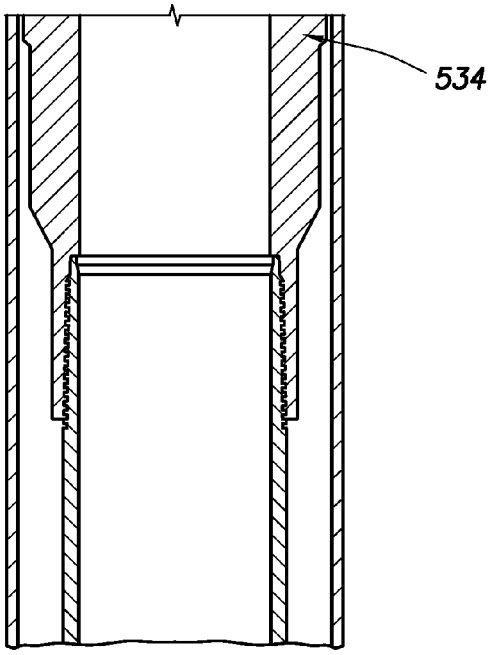
Figure 10A:
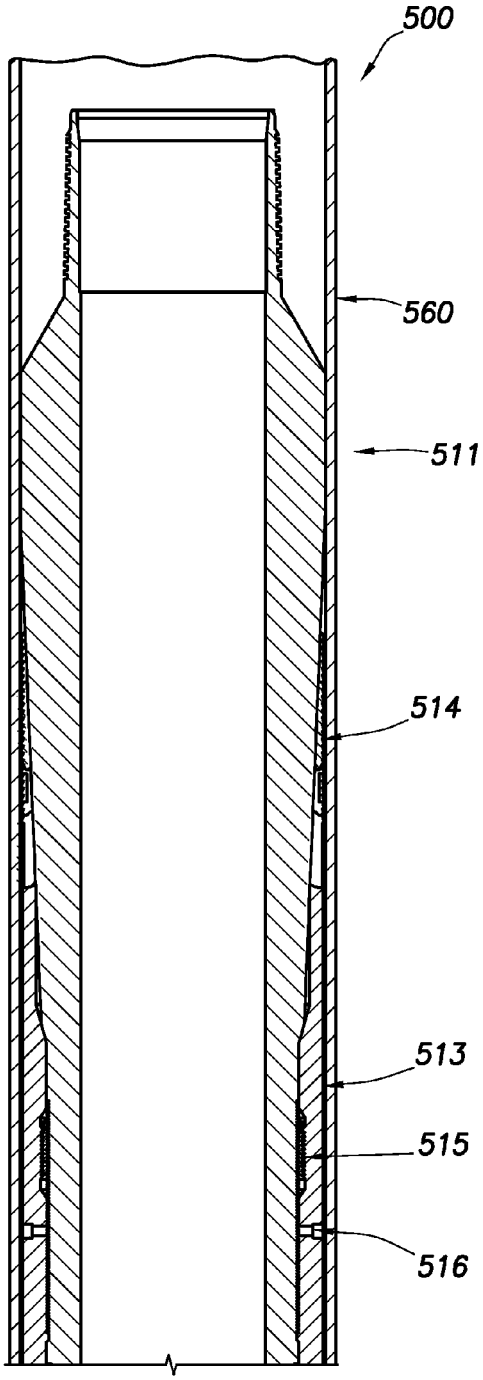
Figure 10B:
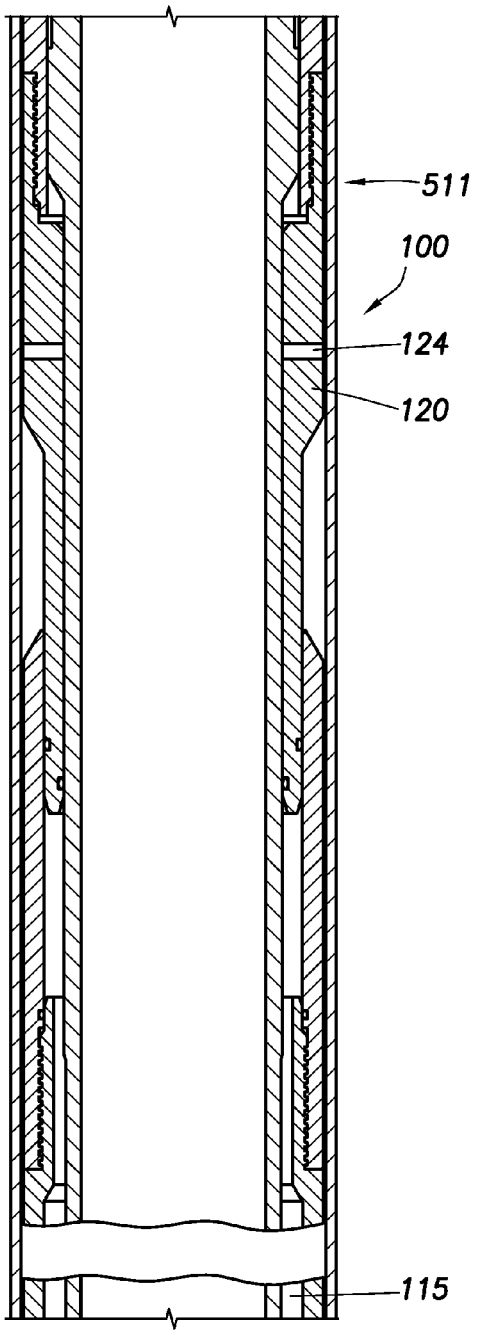
Figure 10C:
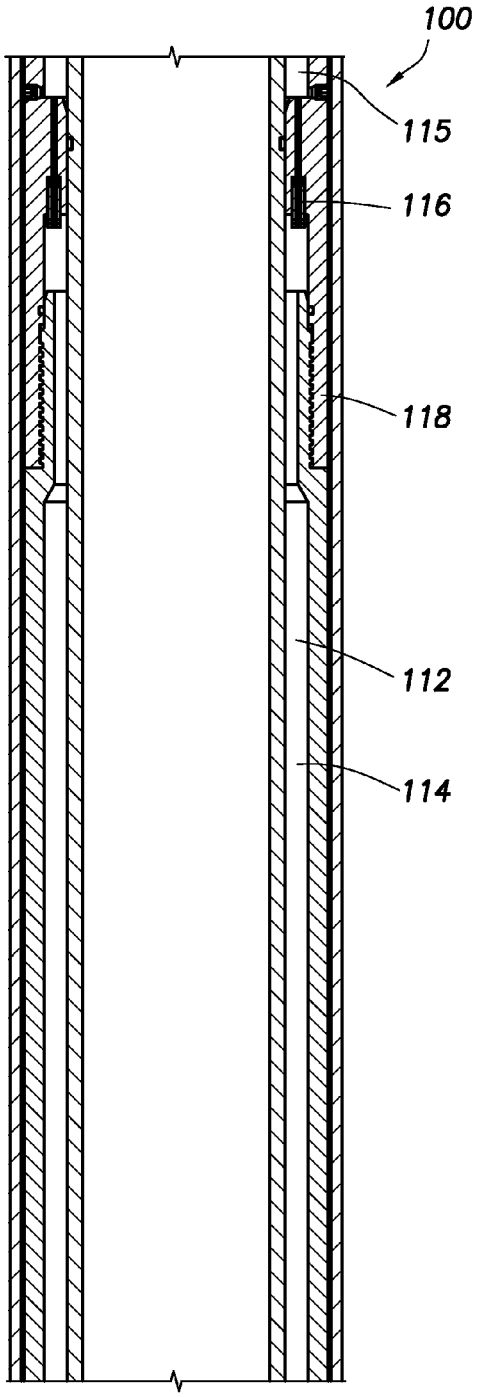
Figure 10D:
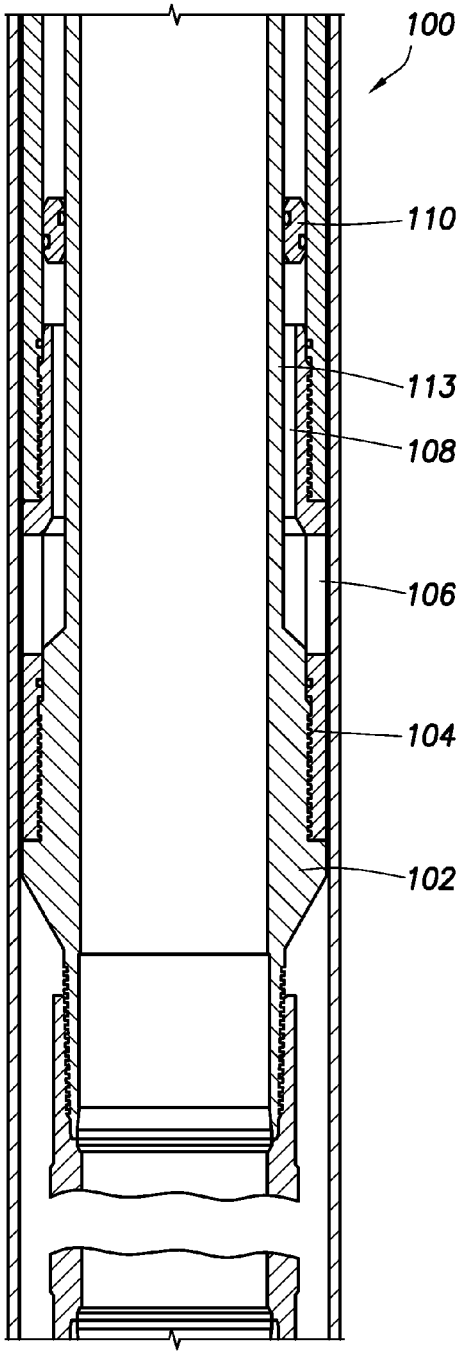
Figure 10E:
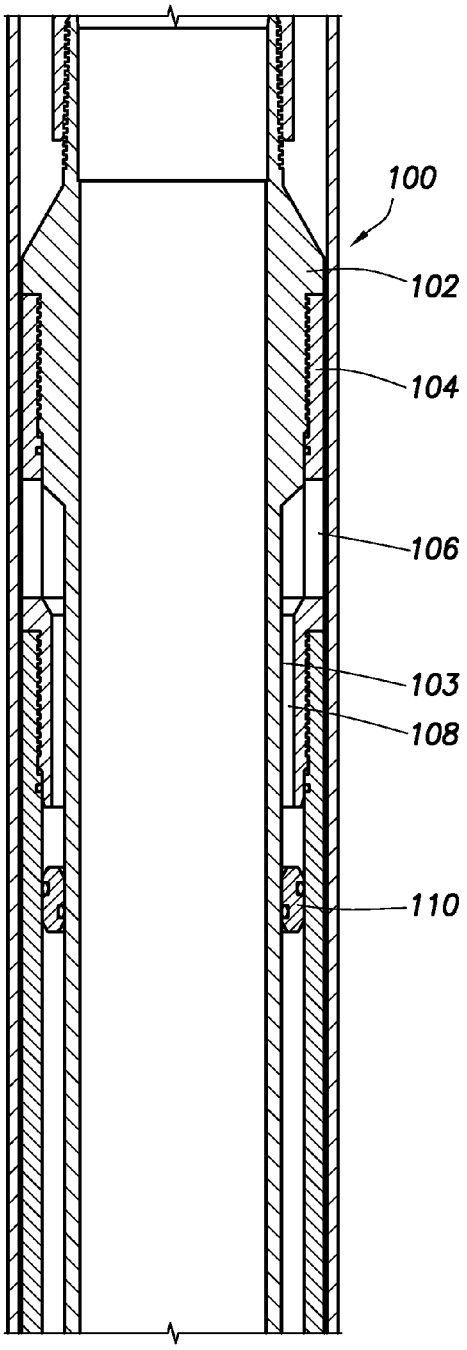
Figure 10F:
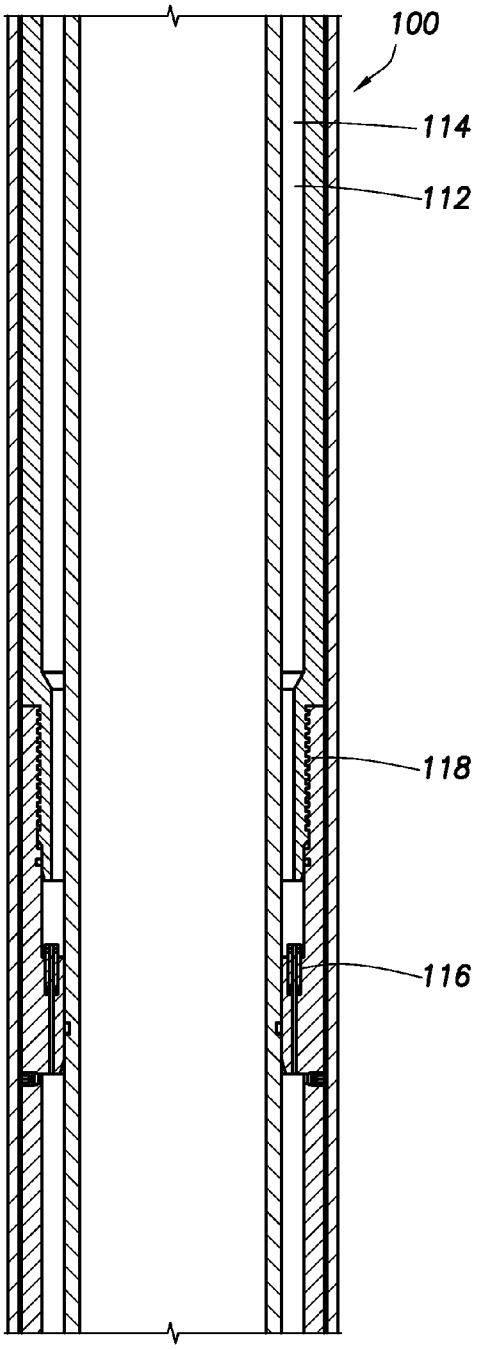
Figure 10G:
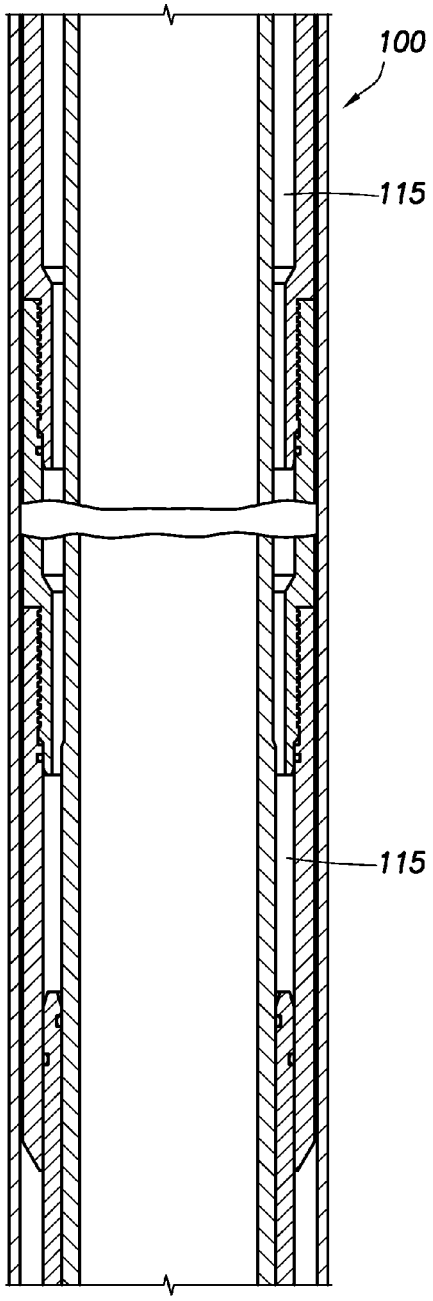
Figure 10H:
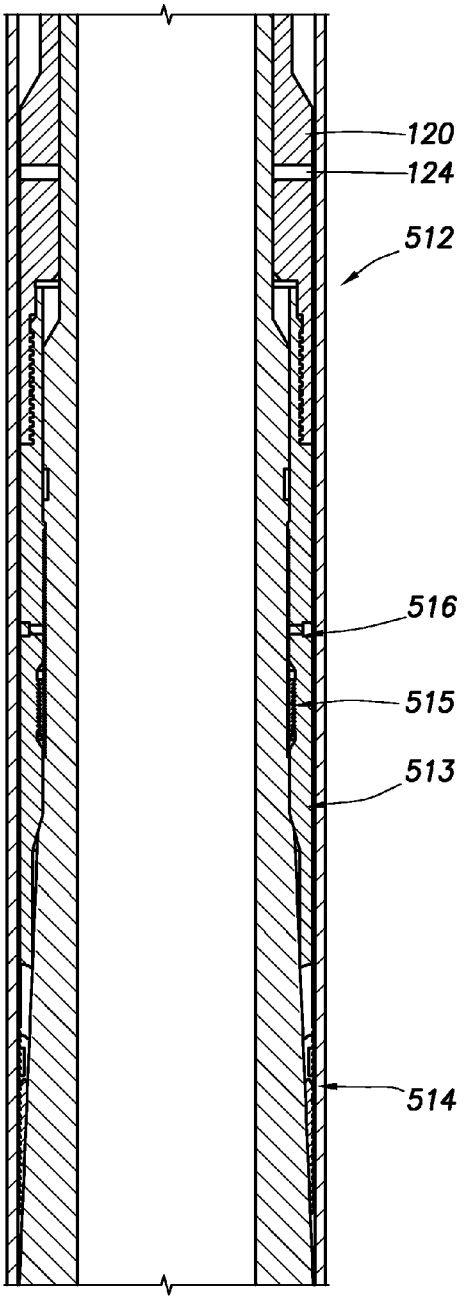
Figure 10I:
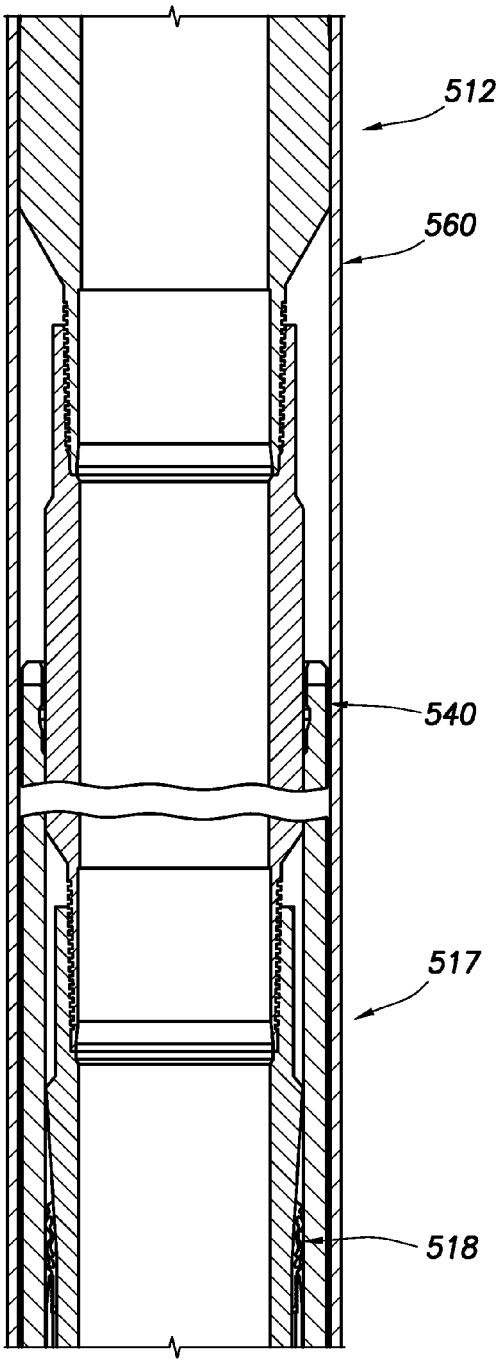
Figure 10J:
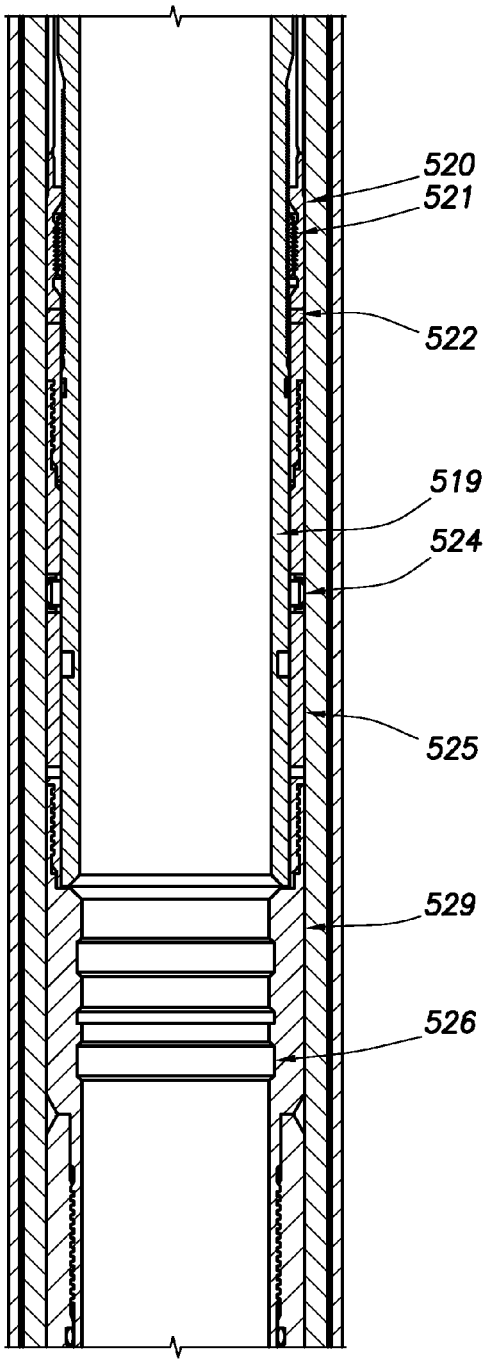
Figure 10K:
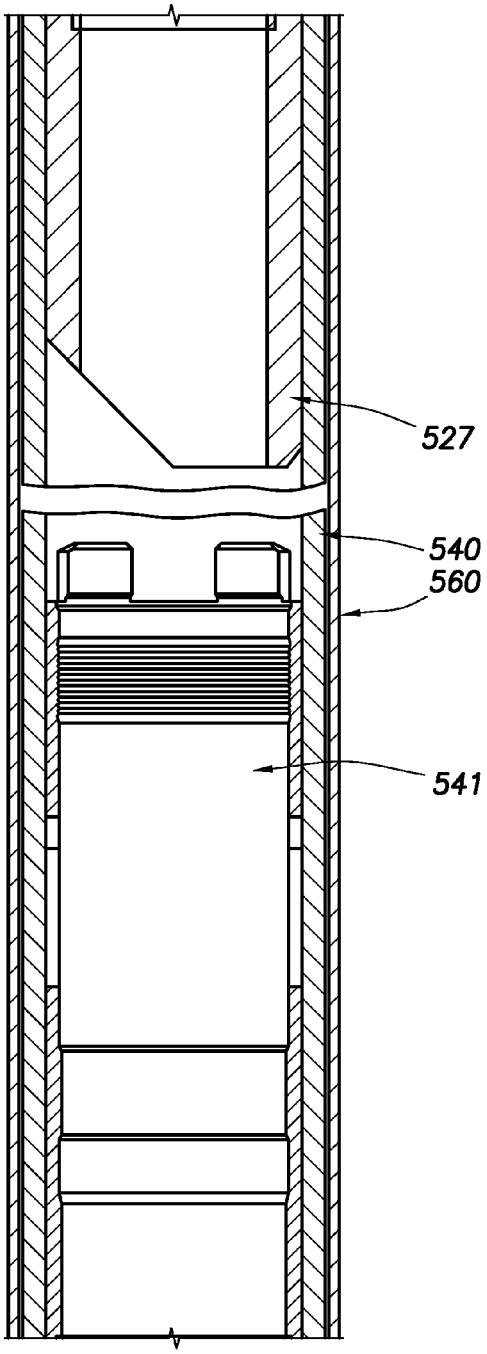
Figure 10L:
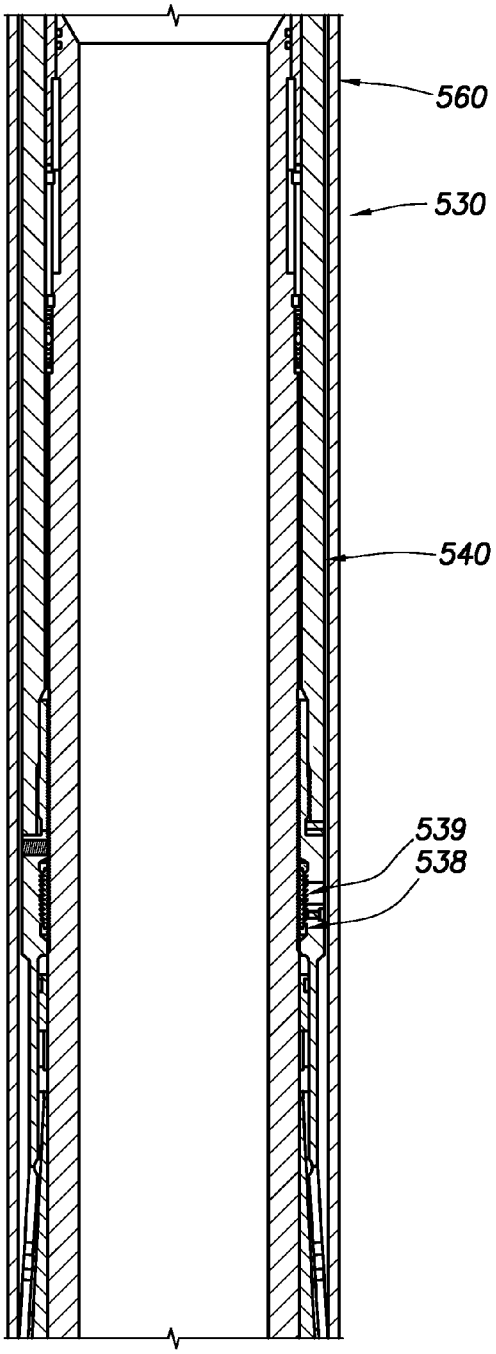
Figure 10M:
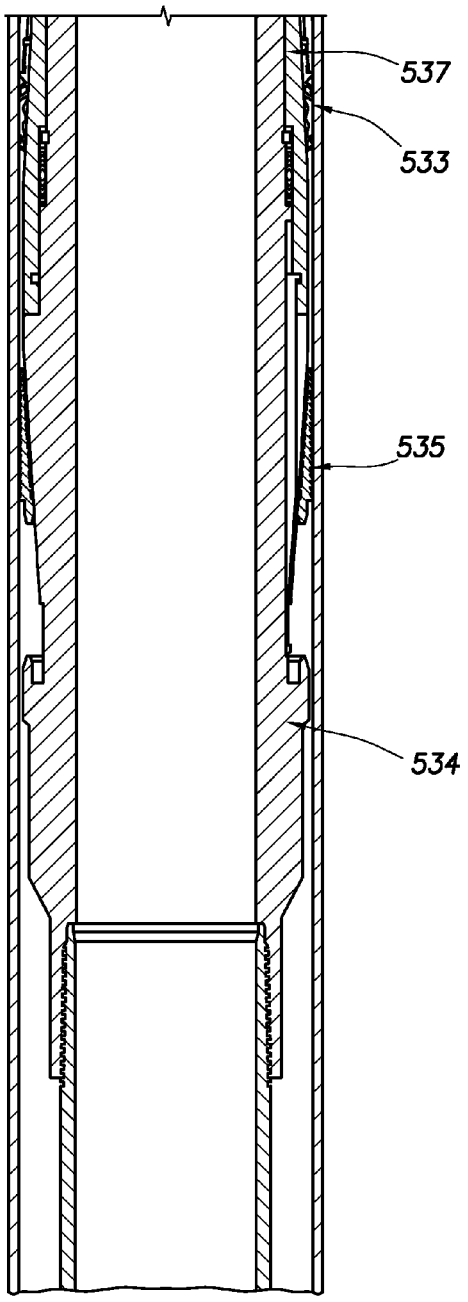

Referring to FIGS. 9A-9P, the HTSA 500 is depicted in its anchored configuration, where the hold up and hold down bodies 511, 512 have been set. In this illustrative embodiment, the hold up and hold down bodies 511, 512 have been set by each coupled IHSS 100. Although the illustrative embodiment depicts the hold up and hold down bodies 511, 512 being set using an IHSS 100, it would be appreciated that either one or both of the bodies 511, 512 may be set using an IHSS 300. In other embodiments, the hold up and hold down bodies, 511, 512 may be hydraulically or mechanically set by any other means known to those of skill in the art without departing from the scope of the present disclosure. As shown in FIG. 9A-9B, the hold up body 511 may be used to keep the HTSA 500 from moving uphole upon any induced mechanical load. Similarly, as shown in FIG. 9J-9K, the hold down body 512 may be used to keep the HTSA 500 from moving downhole upon any induced mechanical load. In certain embodiments, setting the hold up and hold down bodies 511, 512 first (i.e., before the packer seal assembly 517 is set) may isolate the system from movement and ensure that the HTSA 500 maintains hydraulic communication between the host casing 560, the annular area of the HTSA 500 (i.e., the area between the HTSA 500 and the host casing 560), and the wellbore (not shown).

Referring to FIGS. 10A-10M, the HTSA 500 is depicted in its fully set configuration, with the packer seal assembly 517 now set in the receptacle 540 of the liner hanger system 530. Although the illustrative embodiment depicts a mechanical packer seal assembly 517 set with a setting tool (not shown), it would be appreciated that the packer seal assembly 517 may be hydraulically or mechanically set by any means known to those of skill in the art without departing from the scope of the present disclosure, including by means of an IHSS 100 or 300. In certain embodiments, the packer seal 518 of the packer seal assembly 517 only requires setting to the point where the elastomers begin to seal. For example, in one illustrative embodiment, a setting tool (not shown) may be located within a setting profile 526 of a shifting sleeve 529 and may initiate elastomeric sealing of the packer seal 518. Once the elastomeric sealing has been initiated pressure may then be applied to the HTSA 500 to fully set the packer seal 518 to complete the packer setting process.

Figure 11A:
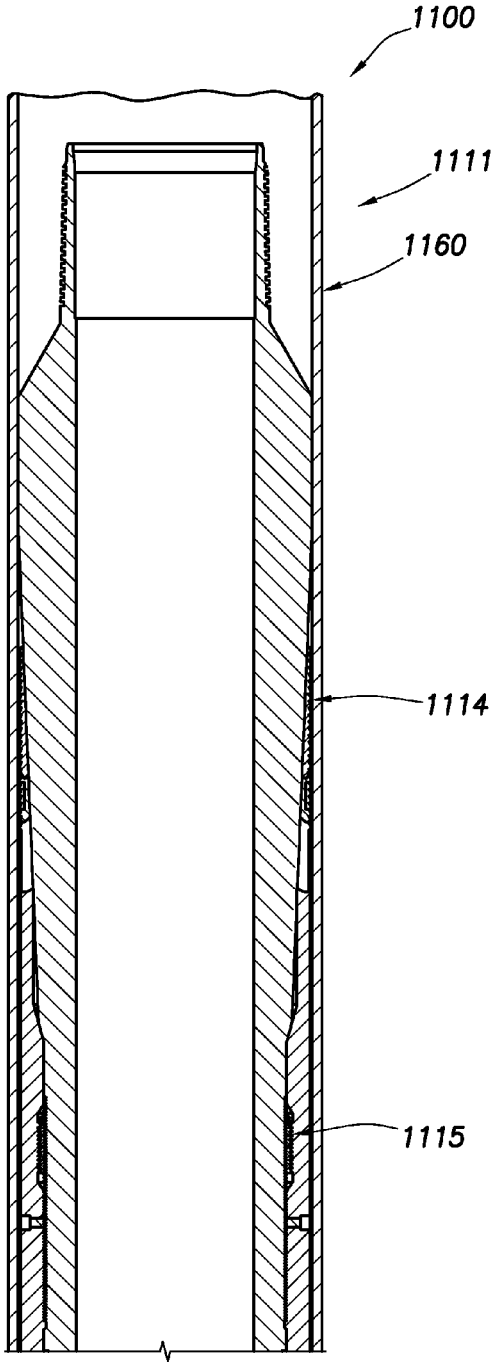
FIGS. 11A-11O depicts a liner hanger system and a HTSA in accordance with a second illustrative embodiment of the present disclosure.
Figure 11B:
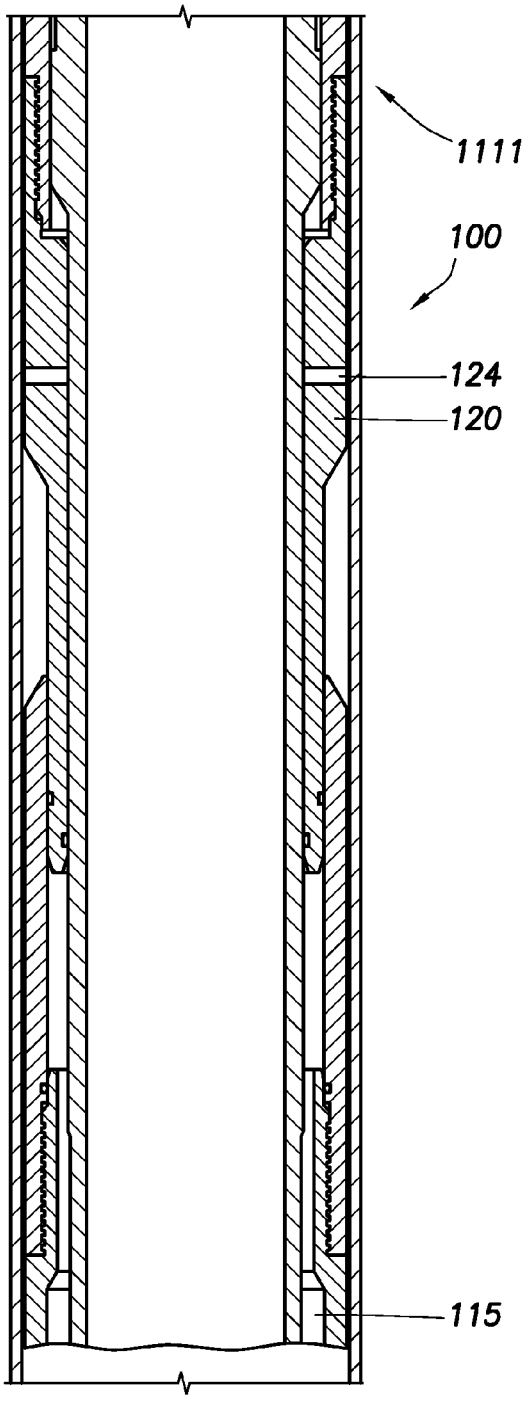
Figure 11C:
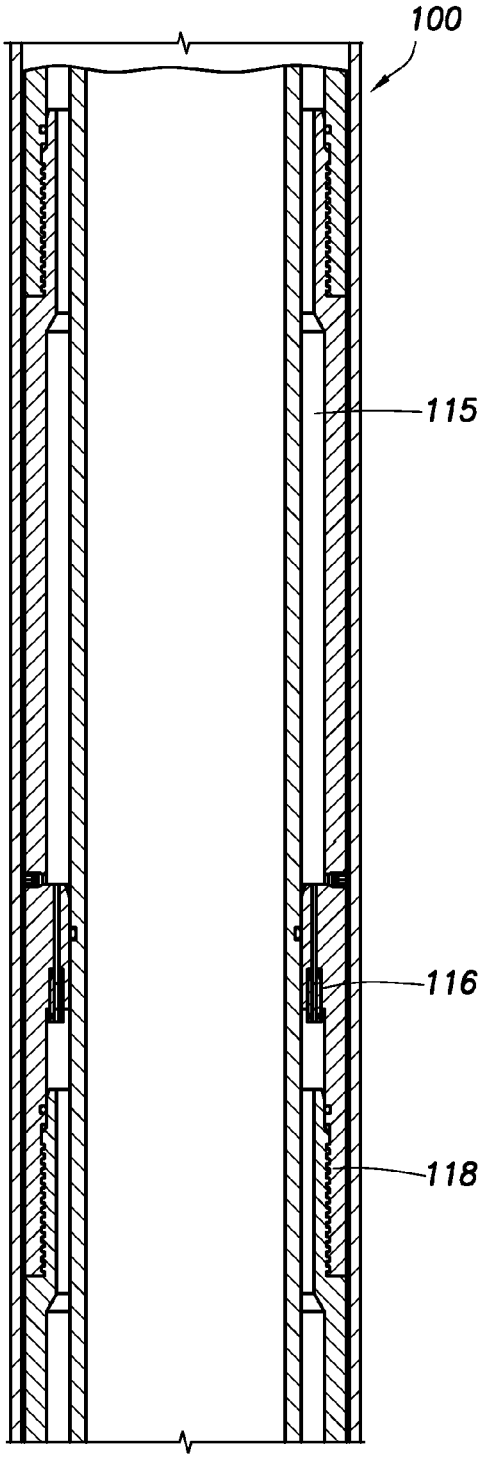
Figure 11D:
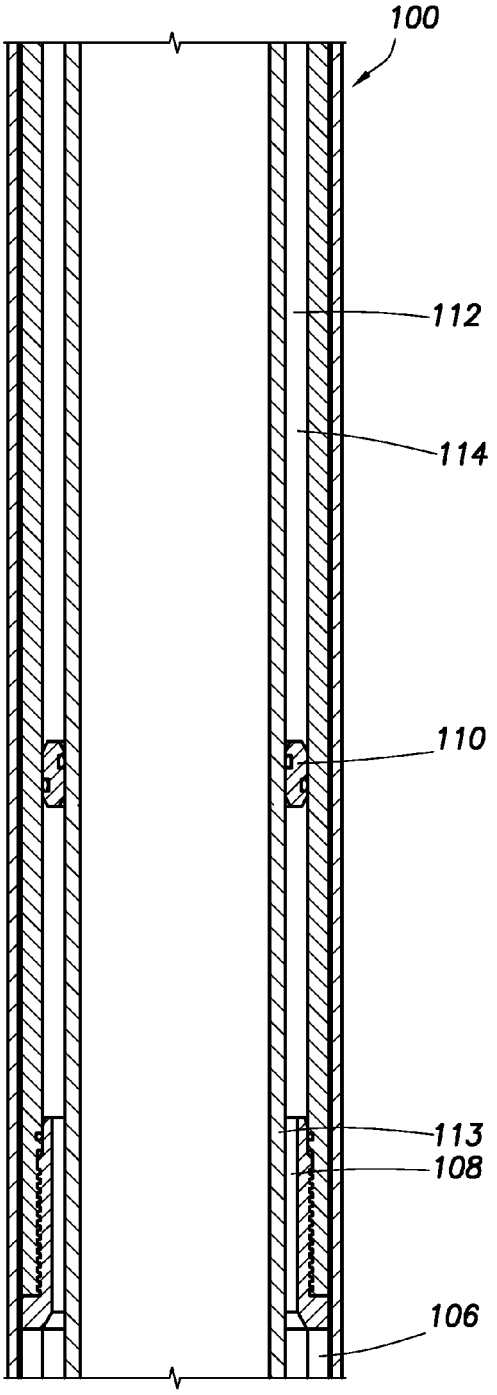
Figure 11E:
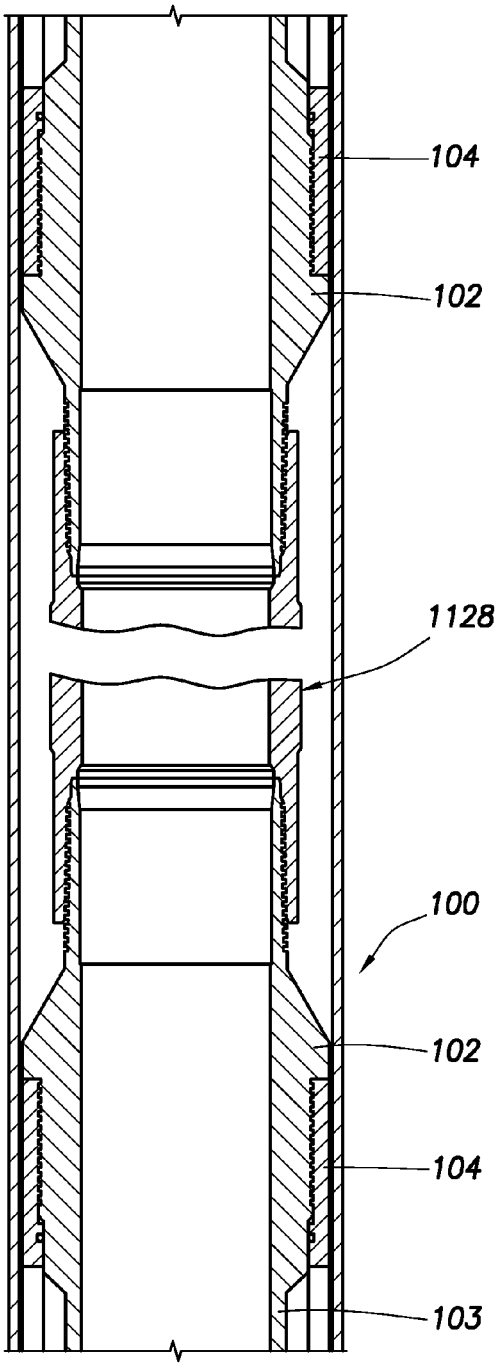
Figure 11F:
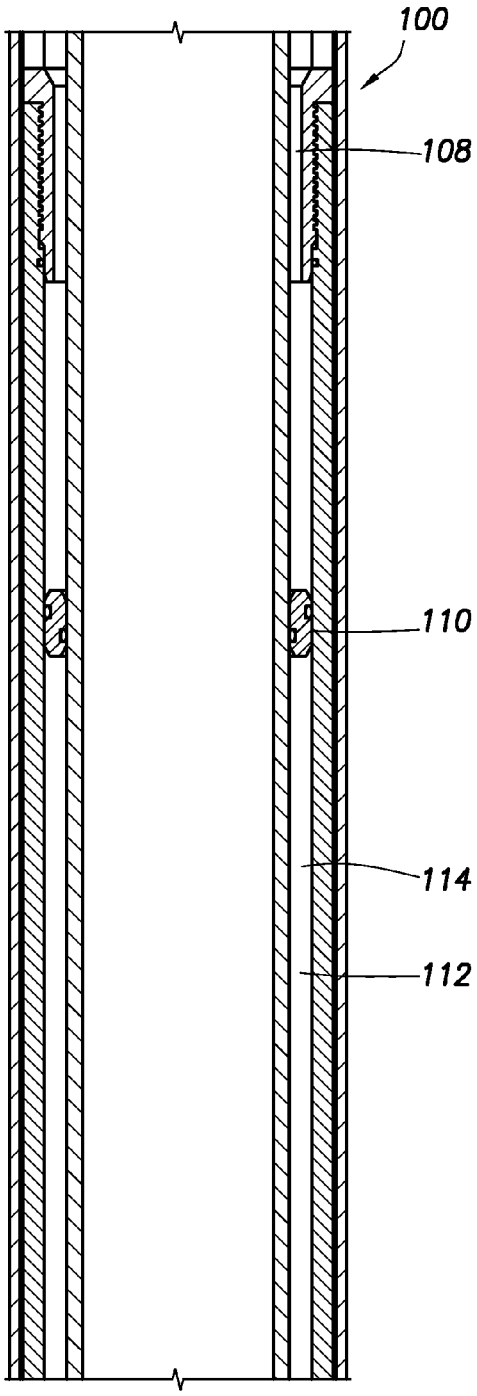
Figure 11G:
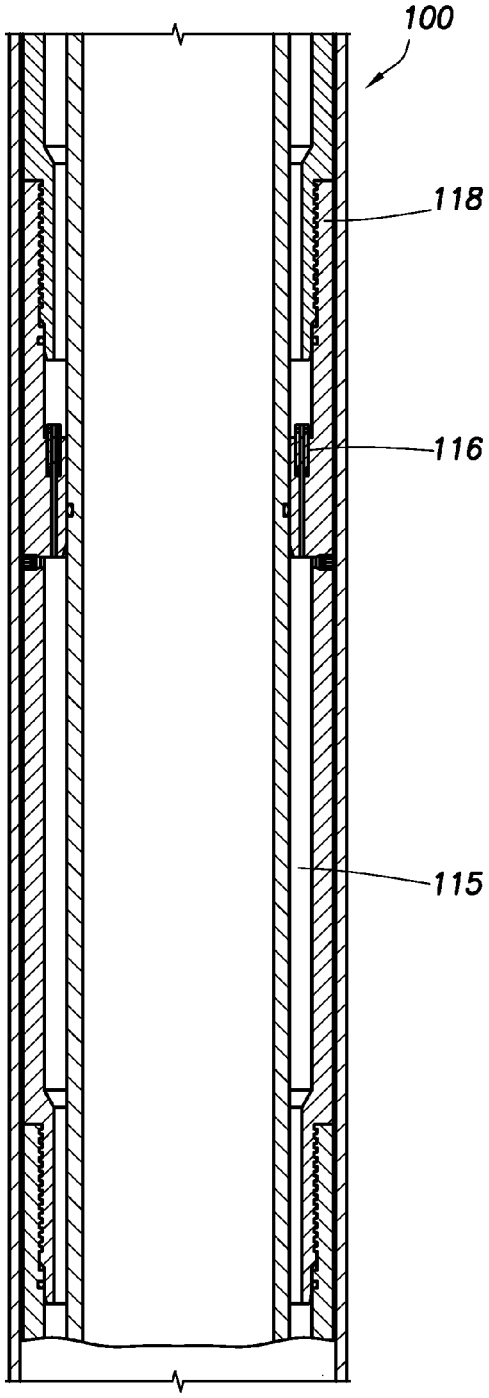
Figure 11H:
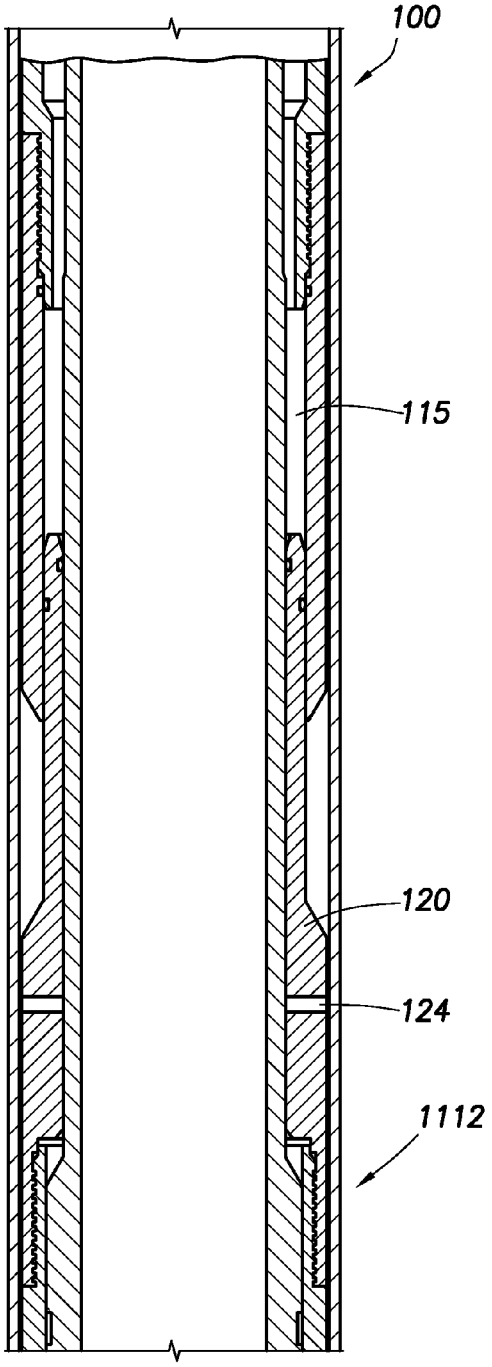
Figure 11I:
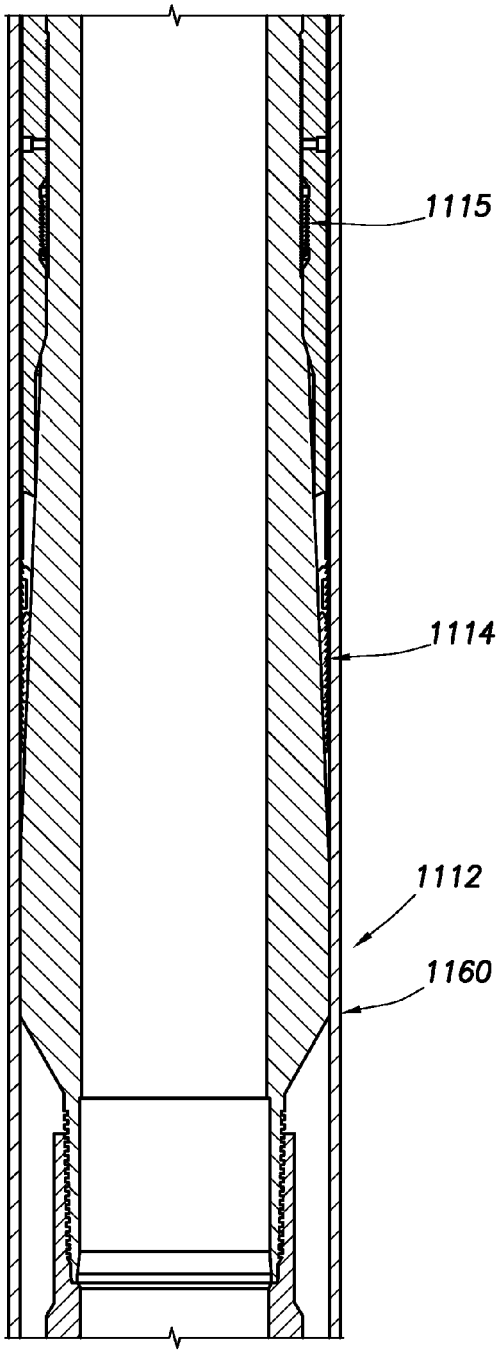
Figure 11J:
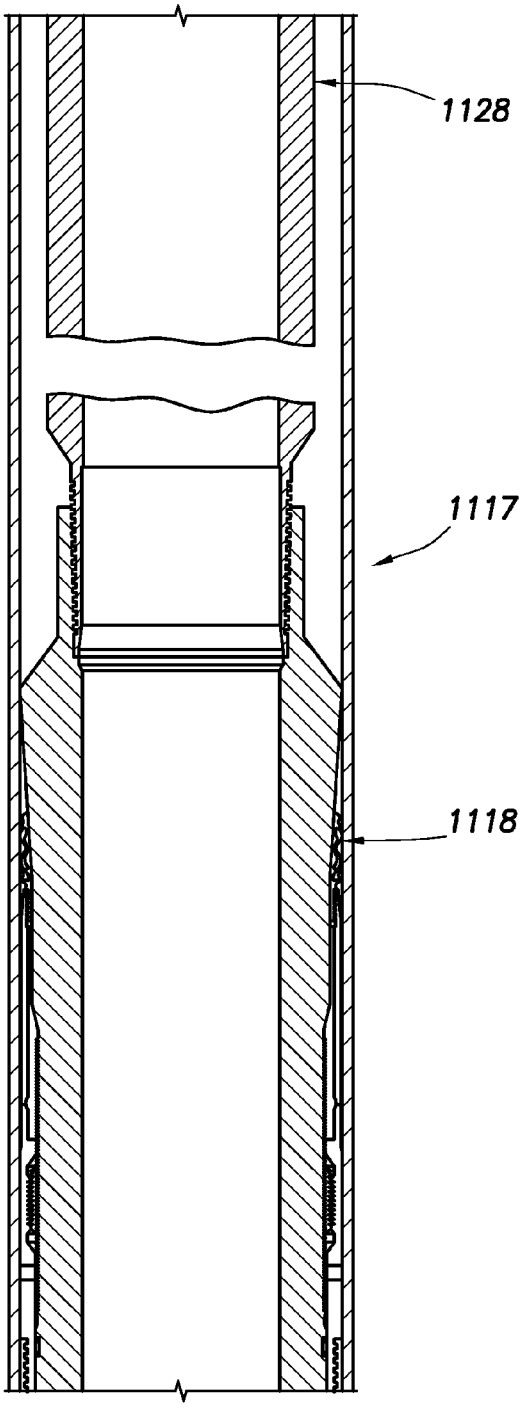
Figure 11K:
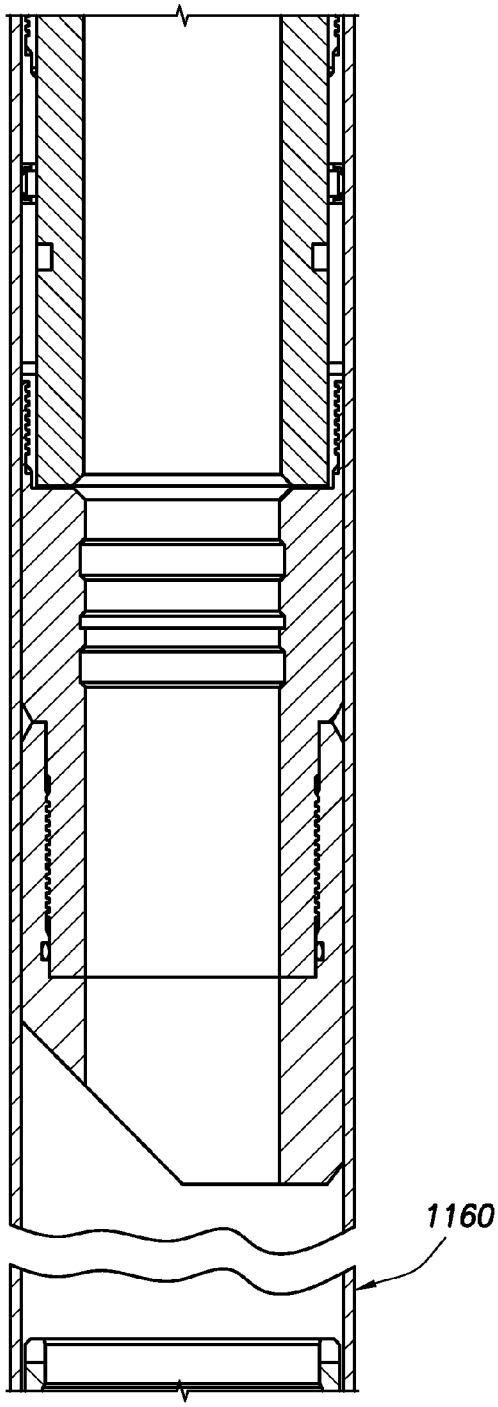
Figure 11L:
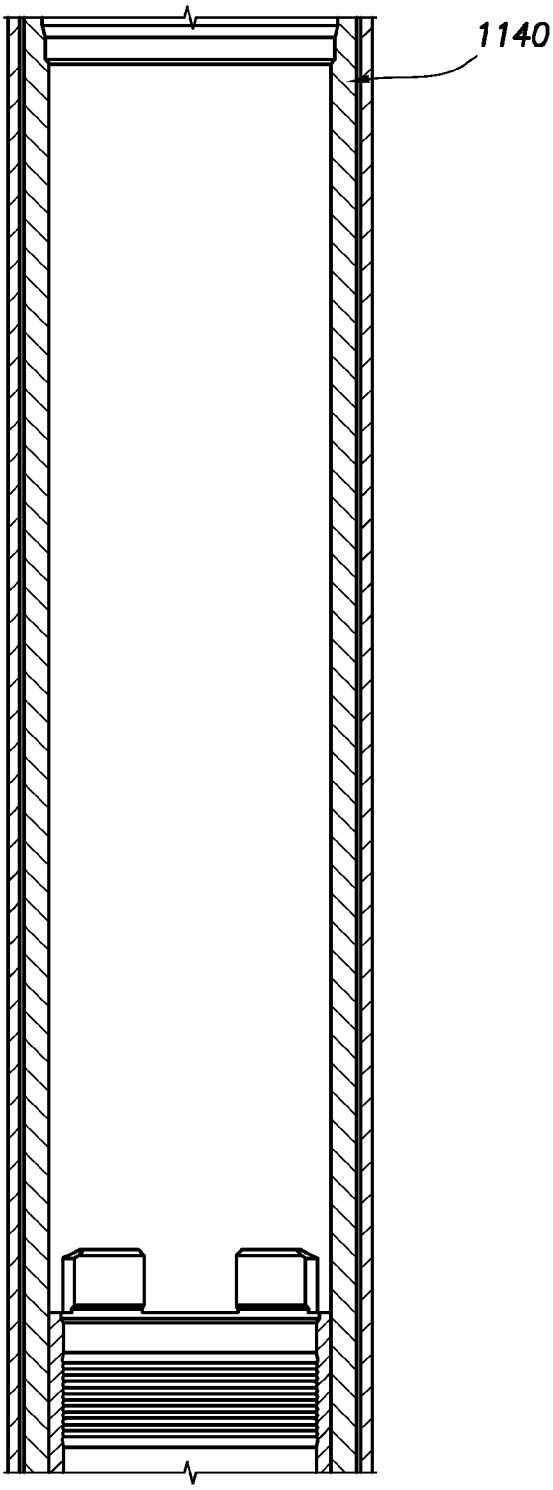
Figure 11M:
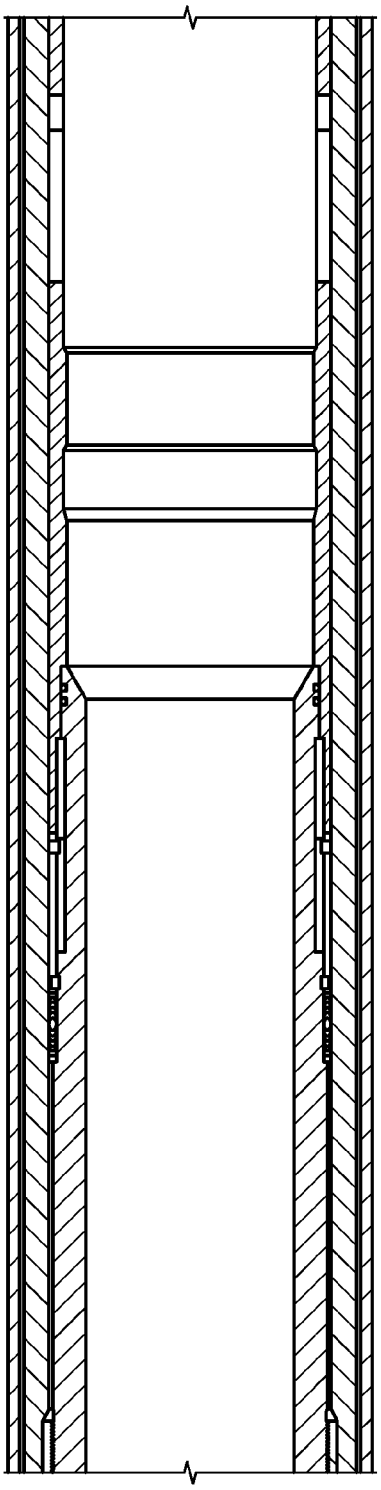
Figure 11N:
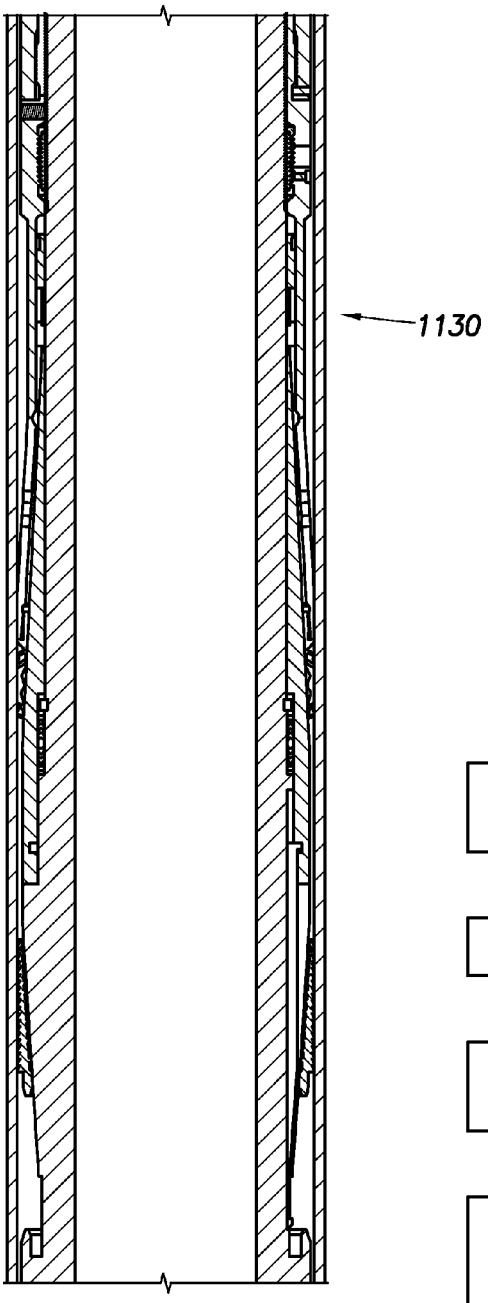
Figure 11O:
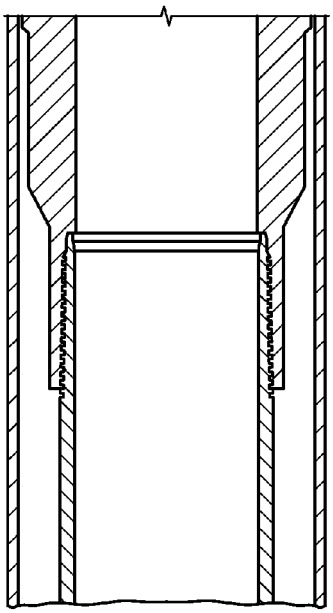

Referring to FIGS. 11A-11O, a second illustrative embodiment of a HTSA is denoted generally with reference numeral 1100. As with the first illustrative embodiment of the HTSA 500 shown in FIG. 5, a liner hanger system 1130 may be run and set in a wellbore (not shown). The liner hanger system 1130 may be disposed within a host casing 1160. The liner hanger system 1130 may comprise the same or similar components discussed with respect the first illustrative embodiment of the HTSA 500 depicted in FIG. 5.

In this illustrative embodiment, the HTSA 1100 may be set and sealed directly in the host casing 1160, above the liner hanger system 1130. As with the first illustrative embodiment of the HTSA 500 shown in FIG. 5, the HTSA 1100 may comprise one or more anchoring bodies, which may be hydraulically or mechanically set. In certain embodiments in accordance with the present disclosure the one or more anchoring bodies may include a hold up body 1111 and a hold down body 1112, which may be hydraulically or mechanically set. The hold up and hold down bodies 1111, 1112 may include the same or similar components discussed with respect to the first illustrative embodiment of the HTSA 500 depicted in FIG. 5. The HTSA 1100 also may incorporate any suitable slip mechanisms such as, for example, slip mechanisms disclosed in U.S. Pat. No. 6,761,221, the entirety of which has been incorporated by reference into the present disclosure.

The HTSA 1100 may also comprise one or more metal to metal packer seal assemblies 1117 which may be hydraulically or mechanically set. The packer seal assembly 1117 may comprise the same or similar components discussed with respect the first illustrative embodiment of the HTSA 500 depicted in FIG. 5. The HTSA 1100 also may incorporate any suitable sealing technology such as, for example, the sealing technology disclosed in U.S. Pat. No. 6,666,276, the entirety of which has been incorporated by reference into the present disclosure.

In certain embodiments, the HTSA 1100 may also utilize one or more IHSS 100 to set the hold up body 1111 and hold down body 1112 and/or packer seal assemblies 1117. As shown in FIG. 11, an IHSS 100 may be coupled to the hold up and hold down bodies 1111, 1112 and used to set the components downhole. In certain embodiments, the HTSA 1100 may utilize one or more IHSS 300 to set the hold up body 1111 and hold down body 1112 and/or packer seal assemblies 1117. In other embodiments, the HTSA 1100 may utilize any mechanical, hydraulic, or other type of setting mechanism known to those of ordinary skill in the art to set the downhole components.

In certain embodiments, the HTSA 1100 may include any suitable tubing to couple the various downhole components. In certain implementations, the tubing used to couple the downhole components may include, but is not limited to, a pup joint or handling sub. For example, as shown in FIG. 11, a pup joint 1128 may be used to couple the packer seal assembly 1111 to the hold down body 1112. As with the first illustrative embodiment of the HTSA 500 shown in FIG. 5, a pup joint 1128 may be used to couple the IHSS 100 or IHSS 300 used to set the hold up body 1111 to the IHSS 100 or IHSS 300 used to set the hold down body 1112. In this manner, the system provides a means of creating an integral production liner to the surface or wellhead.

In certain embodiments in accordance with the present disclosure, the HTSA 1100 may be run into the wellbore (not shown) and landed above the receptacle 1140 of the liner hanger system 1130. In this manner, the HTSA 1100 may protect the host casing 1160 above the liner hanger system 1130 and may provide zonal isolation up to the surface or subsea wellhead.

Figure 12:
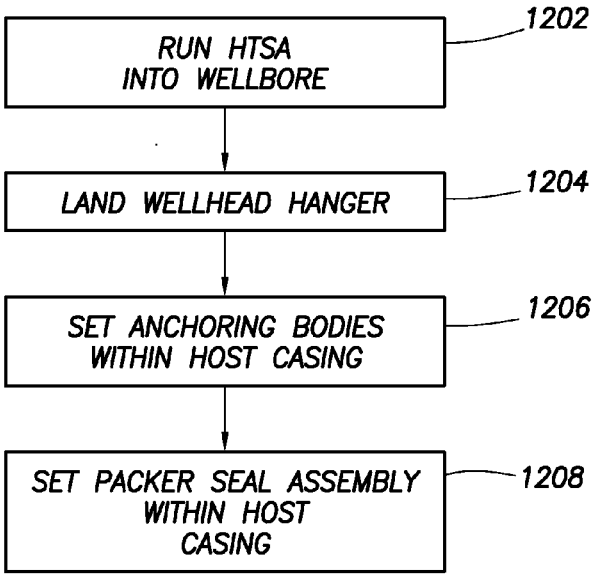
FIG. 12 is a flowchart depicting a method of tying a well back to the surface using the HTSA of FIG. 11, in accordance with an illustrative embodiment of the present disclosure.

Operation of the HTSA 1100 in accordance with illustrative embodiments will now be discussed in conjunction with FIG. 12. FIG. 12 is a flowchart depicting illustrative method steps associated with a method to tie a well back to the surface using the HTSA 1100 of FIG. 11, in accordance with an illustrative embodiment of the present disclosure. Although a number of steps are depicted in FIG. 12, as would be appreciated by those of ordinary skill in the art, having the benefit of the present disclosure, one or more of the recited steps may be eliminated or modified without departing from the scope of the present disclosure.

First, at step 1202, the HTSA 1100 is run into a wellbore (not shown). At step 1204, the wellhead hanger (not shown) is landed. As a result of landing in the wellhead hanger (not shown), the HTSA 1100 is located in the host casing 1160, above the receptacle 1140 of the liner hanger system 1130. At step 1206, the hold up and hold down body assemblies 1111, 1112 may be set using an IHSS 100 or IHSS 300. This may set the hold up and hold down body assemblies 1111, 1112 and may anchor the HTSA 1100 within the host casing 1160. Slips 1114 of the hold up and hold down bodies 1111, 1112 may be used to isolate the HTSA 1100 from movement. As with the first illustrative embodiment of the HTSA 500 shown in FIG. 5, locking device 1115 may retain the mechanical load applied to the slips 1114 of the hold up and hold down bodies 1111, 1112. At step 1208, the packer seal 1118 may be mechanically or hydraulically set within the host casing 1160, above the liner hanger system 1130. The packer seal 1118 also may be set using an IHSS 100 or IHSS 300. In certain embodiments, the packer seal assembly 1117 may be set last because once the packer seal 1118 is set, zonal isolation will be created and no further hydraulic communication between the tubing and annulus will occur.

As would be appreciated by one of ordinary skill in the art with the benefit of the present disclosure, the IHSS 100 or the IHSS 300 may be used several times to set or further energize downhole components provided that the volumes have a sufficient pre-planned reservoir to allow for multiple actuations. Accordingly, several actuation cycles may be applied to ensure the downhole components are fully set.

Figure 13:
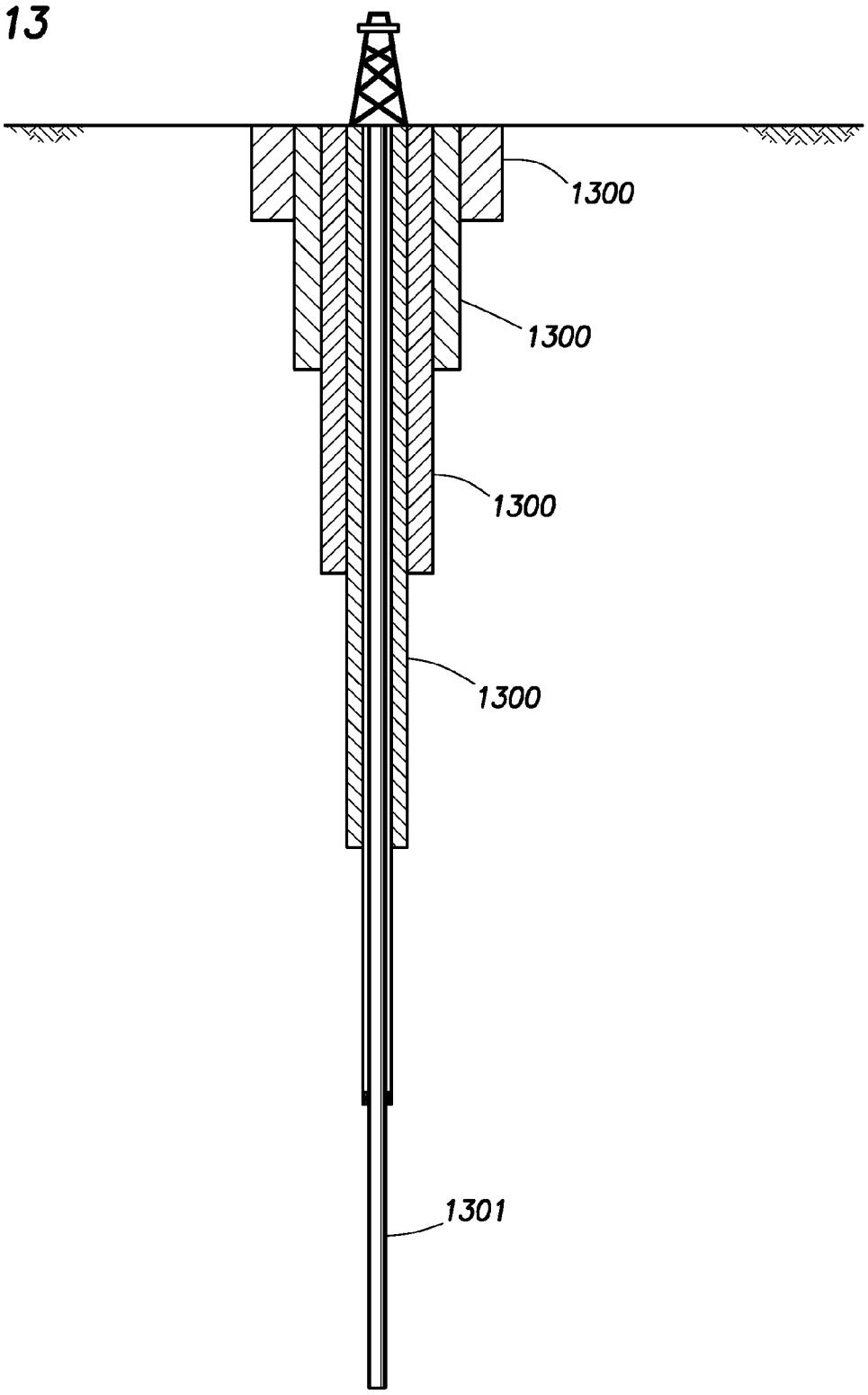
FIG. 13 depicts a typical well design associated with a method of tying a well back to the surface.
Figure 14:
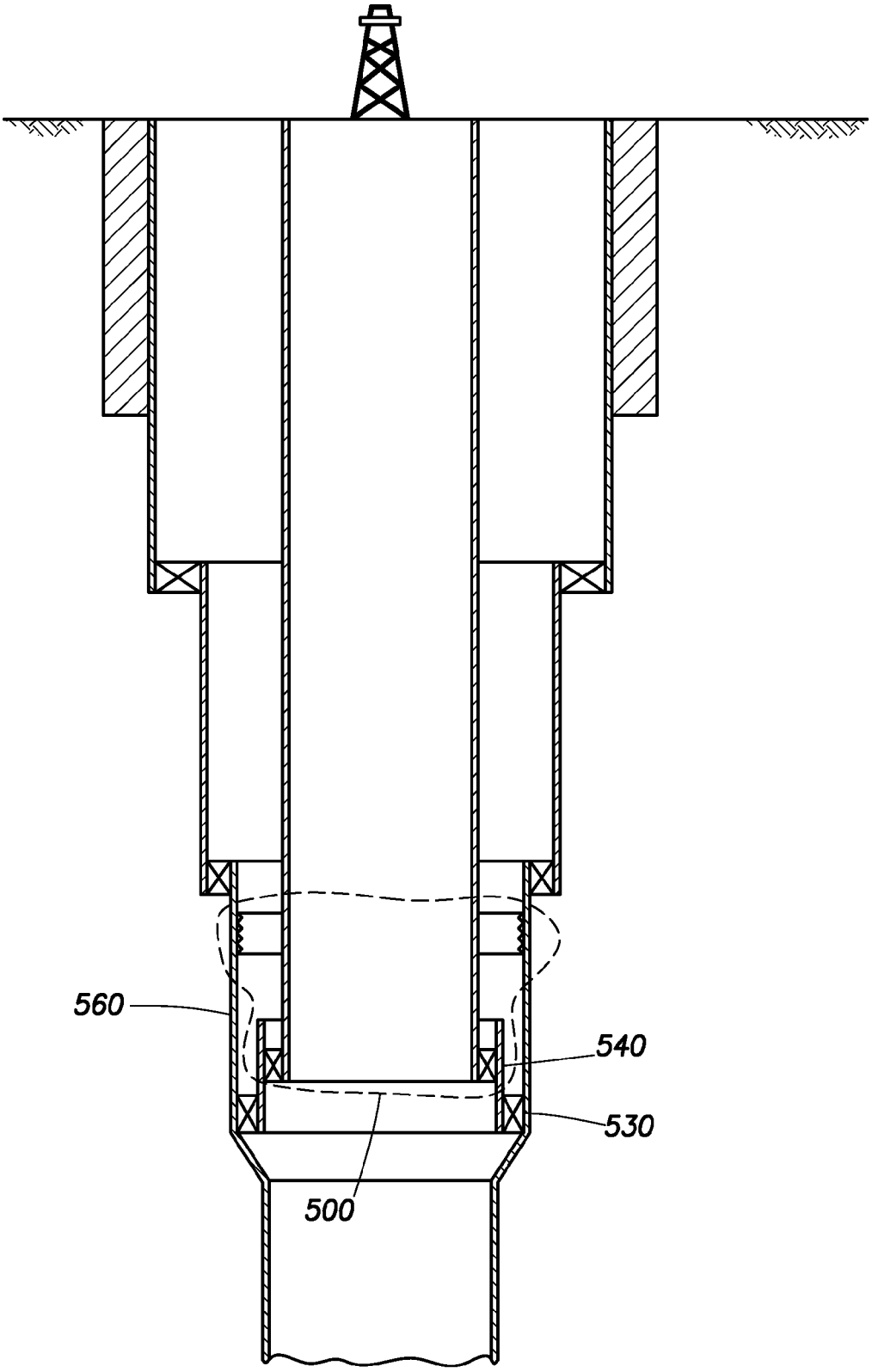
FIG. 14 depicts the HTSA of FIGS. 5A-5P anchored in a host casing and set in a receptacle of a liner hanger system, in accordance with an illustrative embodiment of the present disclosure.
Figure 15:
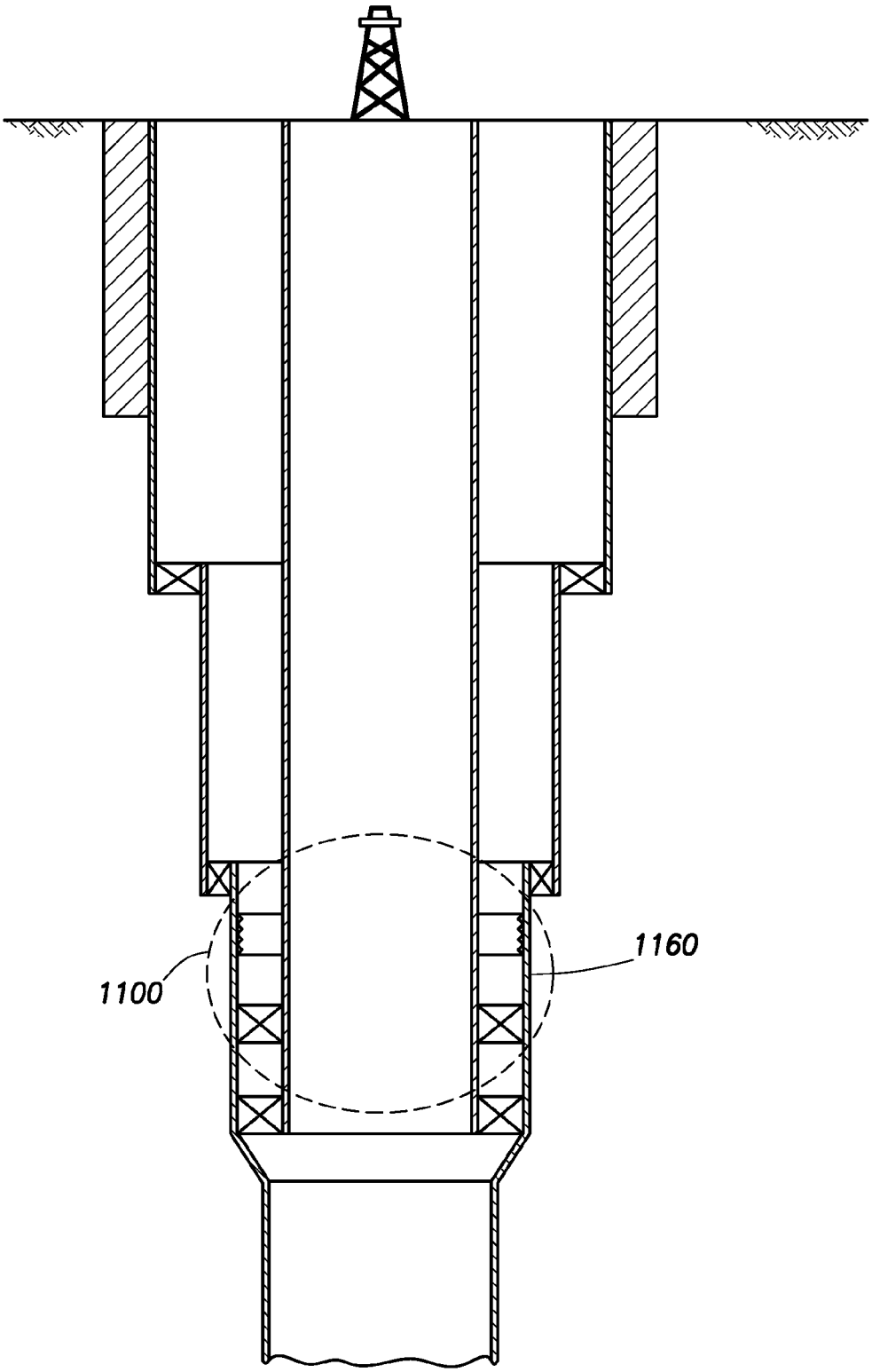
FIG. 15 depicts the HTSA of FIGS. 11A-11O set and sealed within a host casing, in accordance with an illustrative embodiment of the present disclosure.

As would further be appreciated by those of ordinary skill in the art, with the benefit of this disclosure, in certain implementations a HTSA 500, 1100 in accordance with embodiments of the present disclosure utilizing one or more IHSS 100 or IHSS 300 may provide a method of creating a metal to metal sealed production wellbore (not shown) to the surface or wellhead (not shown) and allow for interventionless setting of the downhole components. A comparison of FIG. 13 with FIGS. 14 and 15 demonstrates the advantages associated with a HTSA system in accordance with the present disclosure. FIG. 13 depicts a typical well design including various sizes of casings 1300 and a liner 1301 used to tie the well back to the surface. This particular design is typically necessary to ensure metal-to-metal integrity throughout the wellbore. However, the large quantity of casing typically required for this type of design may result in high cost and operational complexity. FIG. 14 depicts the HTSA 500 anchored in the host casing 560 and sealed in the receptacle 540 of the liner hanger system 530 in accordance with an embodiment of the present disclosure. Similarly, FIG. 15 depicts the HTSA 1100 set and sealed within the host casing 1160 in accordance with another embodiment of the present disclosure. Both illustrative embodiments shown in FIGS. 14 and 15 provide a method of creating a metal to metal sealed production wellbore to the surface or wellhead, requiring less casing and a smaller range of casing sizes than typically utilized, reducing costs, weight on the rig, and operational complexity.

In addition, in certain embodiments, due to the configuration of the HTSA 500 and the liner hanger system 530, the wellhead hanger (not shown) may be landed without any special considerations or allowances for the position of the HTSA 500 within the receptacle 540 of the liner hanger system 530. Similarly, in certain embodiments, due to the configuration of the HTSA 1100, the wellhead hanger (not shown) may be landed without any special considerations or allowances for the position of the HTSA 1100 within the host casing 1160. Specifically, the wellhead hanger (not shown) may be landed regardless of the position of the HTSA 1100 within the host casing 1160.

Further, utilizing an IHSS 100 or IHSS 300 to set the downhole components of the HTSA 500, 1100 in accordance with the present disclosure also eliminates the need for a plugging device and an intervention run required for the removal of the plugging device. Moreover, utilizing an IHSS 100 or IHSS 300 to set the downhole components allows the components to be set in a completely pressure balanced condition, which eliminates elastic deformation of the downhole components and reduces and/or eliminates the associated loss of downhole component setting loads. Due to these advantages, and others associated with the present disclosure and discussed herein, rig time may be reduced.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee. The indefinite articles "a" or "an," as used in the claims, are defined herein to mean one or more than one of the elements that it introduces.

what is claimed is:

1. A hybrid-tieback seal assembly comprising:

one or more anchoring bodies;

one or more packer seal assemblies;

one or more interventionless hydraulic setting systems coupled to one or more of the anchoring bodies and packer seal assemblies, the one or more interventionless hydraulic setting systems comprising:

a bottom sub;

a hydraulic tubing extending from the bottom sub;

a communication port housing coupled to the bottom sub, the communication port housing having a charge port; a compensating volume, wherein the compensating volume is positioned in an annular space between the hydraulic tubing and the communication port housing;

a floating piston located at one side of the compensating volume, wherein fluid flowing through the charge port applies pressure to the floating piston;

a working volume separated from the compensating volume by one or more hydraulic control devices, wherein the one or more hydraulic control devices regulate fluid flow from the compensating volume to the working volume;

wherein application of a pressure to the compensating volume applies a pressure to the working volume;

wherein releasing the pressure applied to the compensating volume creates a differential pressure across the one or more hydraulic control devices;

wherein in response to the creation of the differential pressure the one or more hydraulic control devices substantially seal the working volume from the compensating volume;

wherein the working volume captures the pressure applied to the working volume when the pressure applied to the compensating volume is released; and a hydraulic piston coupled to the working volume, wherein the hydraulic piston is movable between a first position and a second position.

2. The assembly of claim 1, wherein at least one of the compensating volume and the working volume contains a compressible fluid.

3. The assembly of claim 2, wherein the compressible fluid is a silicone oil.

4. The assembly of claim 1, wherein the hydraulic piston is operable to set one or more of the anchoring bodies and packer seal assemblies when it moves between the first position and the second position.

5. The assembly of claim 1, wherein the one or more hydraulic control devices are selected from a group consisting of a check valve, a restrictor, and a combination thereof.

6. The assembly of claim 1, wherein the one or more packer seal assemblies comprise a packer seal and wherein the packer seal is a metal to metal packer seal.

7. The assembly of claim 1, wherein the one or more anchoring bodies are selected from a group consisting of a hold up body and a hold down body.

8. The assembly of claim 1, wherein the one or more anchoring bodies comprise a locking device and wherein the locking device is one of a lock ring, snap ring, collet, wedge or segmented slip system.

9. A hybrid-tieback seal assembly comprising:

one or more anchoring bodies;

one or more packer seal assemblies;

one or more interventionless hydraulic setting systems coupled to one or more of the anchoring bodies and packer seal assemblies, the one or more interventionless hydraulic setting systems comprising:

a first compensating volume positioned in an annular space between a hydraulic tubing and a communication port housing;

a first working volume positioned in the annular space between the hydraulic tubing and the communication port, wherein the first working volume is located adjacent the first compensating volume and separated from the first compensating volume by one or more hydraulic control devices, and wherein a change in pressure of the first compensating volume changes pressure of the first working volume;

a second working volume positioned in the annular space between the hydraulic tubing and the communication port, wherein the second working volume is located between the first working volume and a second compensating volume in an annular space between the hydraulic tubing and the communication port housing, wherein the second working volume is separated from the second compensating volume by one or more hydraulic control devices, and wherein a change in pressure of the second compensating volume changes pressure of the second working volume;

a pressure delivery port, wherein a shifting sleeve is operable to open and close the pressure delivery port in response to a pressure differential between the first working volume and the second working volume, and wherein the pressure delivery port delivers pressure to one or more of the anchoring bodies and packer seal assemblies.

10. The assembly of claim 9, wherein the second working volume is smaller than the first working volume.

11. The assembly of claim 9, wherein the first working volume and the second working volume are equal, and wherein the second working volume bleeds faster than the first working volume.

12. The assembly of claim 9, wherein at least one of the first compensating volume, the second compensating volume, the first working volume, and the second working volume contains a compressible fluid.

13. The assembly of claim 9, wherein the compressible fluid is a silicone oil.

14. The assembly of claim 9, wherein a first charge port is operable to deliver pressure to the first compensating volume using a first floating piston and a second charge port is operable to deliver pressure to the second compensating volume using a second floating piston.

15. The assembly of claim 9, wherein the shifting sleeve is coupled to a spring, wherein the spring moves the shifting sleeve to close the pressure delivery port if the pressure differential between the first working volume and the second working volume is below a threshold value.

16. The assembly of claim 9, wherein the pressure delivery port delivers pressure to one or more of the anchoring bodies and packer seal assemblies using a hydraulic piston.

17. The assembly of claim 9, wherein the one or more hydraulic control devices are selected from a group consisting of a check valve, a restrictor, and a combination thereof.

18. The assembly of claim 9, wherein the one or more packer seal assemblies comprise a packer seal and wherein the packer seal is a metal to metal packer seal.

19. The assembly of claim 9, wherein the one or more anchoring bodies are selected from a group consisting of a hold up body and a hold down body.

20. The assembly of claim 9, wherein the one or more anchoring bodies comprise a locking device and wherein the locking device is one of a lock ring, snap ring, collet, wedge or segmented slip system.

21. A method to tie a well back to the surface comprising:

running a hybrid-tieback seal assembly into a wellbore, the hybrid-tieback seal assembly comprising one or more anchoring bodies and one or more packer seal assemblies;

landing a wellhead hanger in a wellhead;

setting the anchoring bodies within a host casing; and setting the one or more packer seal assemblies within at least one of a receptacle of a previously installed liner hanger system and a host casing above a previously installed hanger system;

wherein setting any one of the anchoring bodies and packer seal assemblies further comprises the steps of:

applying a pressure to a compensating volume, providing a working volume, wherein the working volume is separated from the compensating volume by one or more hydraulic control devices;

regulating fluid flow between the compensating volume and the working volume using the one or more hydraulic control devices;

wherein application of a pressure to the compensating volume applies a pressure to the working volume;

wherein releasing the pressure applied to the compensating volume creates a differential pressure across the one or more hydraulic control devices;

wherein in response to the creation of the differential pressure the one or more hydraulic control devices substantially seal the working volume from the compensating volume;

wherein the working volume captures the pressure applied to the working volume when the pressure applied to the compensating volume is released; and applying the captured pressure in the working volume to set one or more of the anchoring bodies and packer seal assemblies.

22. The method of claim 21, further comprising pressurizing the hybrid-tieback seal assembly to fully set the packer seal.

23. The method of claim 21, wherein landing the wellhead hanger further comprises locating the hybrid-tieback seal assembly within at least one of the liner hanger system and the host casing.

24. The method of claim 21, wherein landing the wellhead hanger is accomplished regardless of the position of the hybrid-tieback seal assembly within at least one of the liner hanger system and the host casing.

25. The method of claim 21, wherein applying a pressure to the compensating volume comprises flowing a fluid through a charge port, wherein the fluid applies a pressure to a floating piston and the floating piston applies pressure to the compensating volume.

26. The method of claim 21, wherein applying the captured pressure in the working volume to set one or more of the anchoring bodies and packer seal assemblies comprises applying the captured pressure to a hydraulic piston.

27. The method of claim 21, wherein at least one of the compensating volume and the working volume is positioned in an annular space between a hydraulic tubing and a communication port housing.

* * * * *